US012685398B2

(12) United States Patent
Park et al.

(10) Patent No.: US 12,685,398 B2
(45) Date of Patent: Jul. 21, 2026

(54) DISPLAY DEVICE

(71) Applicant: LG ELECTRONICS INC., Seoul (KR)

(72) Inventors: Hye Yong Park, Seoul (KR); Chan Ho Chun, Seoul (KR); Soo Chan Yu, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 92 days.

(21) Appl. No.: 18/720,781

(22) PCT Filed: Dec. 5, 2022

(86) PCT No.: PCT/KR2022/019618
§ 371 (c)(1),
(2) Date: Jun. 17, 2024

(87) PCT Pub. No.: WO2023/113346
PCT Pub. Date: Jun. 22, 2023

(65) Prior Publication Data

US 2025/0049232 A1 Feb. 13, 2025

(30) Foreign Application Priority Data

Dec. 17, 2021 (KR) ..... 10-2021-0181406
May 3, 2022 (KR) ..... 10-2022-0055081
Aug. 24, 2022 (KR) ..... 10-2022-0106399

(51) Int. Cl.
*A47F 3/06* (2006.01)
*A47F 3/00* (2006.01)

(52) U.S. Cl.
CPC ..... *A47F 3/06* (2013.01); *A47F 3/001* (2013.01)

(58) Field of Classification Search
CPC ..... A47L 23/20; A47L 23/205; A47B 61/04; A47F 7/08; A47F 3/001; A47F 3/005; A47F 3/0434; A47F 3/10; A47F 3/11; A47F 3/06; A47F 3/063
See application file for complete search history.

(56) References Cited

U.S. PATENT DOCUMENTS 2,898,171 A * 8/1959 Ehlert ..... A47F 3/063 312/223.5
6,672,092 B2 1/2004 Ruiz et al.
2014/0340879 A1 11/2014 Liu
2018/0127150 A1 5/2018 Adanur et al.

FOREIGN PATENT DOCUMENTS

CN 204878143 U 12/2015
CN 111109872 A * 5/2020 ..... A47B 49/002
CN 111990783 A * 11/2020 ..... A47L 23/205
(Continued)

OTHER PUBLICATIONS

Translation JPH0835769A (Year: 1996).*

*Primary Examiner* — Andrew Roersma
(74) *Attorney, Agent, or Firm* — Birch, Stewart, Kolasch & Birch, LLP

(57) ABSTRACT

A showcase includes a main body, a transparent window, a base, and an air-blowing part. The main body includes a lower body, an intermediate body, and an upper body, and the transparent window includes a first window, a second window, and a third window.

19 Claims, 72 Drawing Sheets

(56) References Cited

FOREIGN PATENT DOCUMENTS

| | | | | | |
|---|---|---|---|---|---|
| CN | 211833708 | U | | 11/2020 | |
| GB | 1287551 | A | * | 8/1972 | ..... A47F 5/00 |
| JP | 8-35769 | A | | 2/1996 | |
| JP | 2000-253964 | A | | 9/2000 | |
| KR | 10-2000-0009653 | A | | 2/2000 | |
| KR | 200438015 | Y1 | * | 1/2008 | ..... B60R 7/043 |
| KR | 10-1091716 | B1 | | 12/2011 | |
| KR | 10-2013-0034367 | A | | 4/2013 | |
| KR | 1020140107876 | A | * | 9/2014 | |
| KR | 10-2014-0134546 | A | | 11/2014 | |
| KR | 2020200002534 | U | * | 11/2020 | ..... A47F 7/08 |
| KR | 20-2021-0000423 | U | | 2/2021 | |
| KR | 102230674 | B1 | * | 3/2021 | ..... A47L 23/205 |
| WO | WO2007/042591 | A1 | | 4/2007 | |
| WO | WO 2011/041821 | A1 | | 4/2011 | |
| WO | WO2013/048146 | A2 | | 4/2013 | |

* cited by examiner

DISPLAY DEVICE

CROSS REFERENCE TO RELATED APPLICATIONS

This application is the National Phase of PCT International Application No. PCT/KR2022/019618, filed on Dec. 5, 2022, which claims priority under 35 U.S.C. 119 (a) to Patent Application Nos. 10-2021-0181406, 10-2022-0055081, and 10-2022-0106399, filed in the Republic of Korea on Dec. 17, 2021, May 3, 2022, and Aug. 24, 2022, respectively, all of which are hereby expressly incorporated by reference into the present application.

TECHNICAL FIELD

The present invention relates to a showcase, and more particularly, to a showcase that manages and displays an article stored therein.

BACKGROUND ART

Only when shoes should be properly kept, the shoes can be worn for a long time without breaking the shape of the shoes. When the shoes are stacked in layers, the shape can be deformed. In general, a shoes cabinet is used for organization and keeping of the shoes.

In recent years, people who collect shoes of popular brands as part of hobby or financial tech have appeared, and a showcase has been disclosed which is configured to keep and display the shoes.

US Patent Publication No. 2018-0127150 (hereinafter, referred to as 'Prior Art Document 1'), entitled "Modular storage container", discloses a modular storage container including a housing, a door panel, a fan, and a light source.

According to Prior Art Document 1 above, the housing has a rectangular parallelepiped box shape having an opening on a front surface thereof. The housing has an accommodation space therein. The door panel opens/closes the opening of the housing, and is configured to be transparent or translucent.

In Prior Art Document 1 above, the fan is installed on a rear panel of the housing. When the fan rotates, air in the accommodation space is ventilated to outside air. An air duct is formed in the housing for an air flow between the outside air and the accommodation space. The light source is installed in an upper panel and illuminates the accommodation space.

According to Prior Art Document 1 above, since internal air of the container is configured to be ventilated to the outside air, a possibility that an internal environment (temperature and humidity) of the container will be influenced by an external environment (temperature and humidity) of the container increases. That is, it may be difficult to control the internal temperature and humidity of the container.

For example, according to Prior Art Document 1 above, since the internal air of the container is just ventilated to the outside air, the humidity of the accommodation space can be continuously maintained when the humidity of the outside air is high like the rainy season. The air may change a color and a shape of the shoe stored in the container, and act to cause the shoe to be contaminated by mold and bacteria which are easy to breed at high temperature and humidity.

As such, in that Prior Art Document 1 above does not consider a technology of maintaining the internal temperature and humidity of the container in an optimal state, there is a risk of deformation or contamination of the shoe in the process of using the container by a user.

Further, according to Prior Art Document 1 above, the inside of the container can be viewed only through a door panel, and the inside of the container cannot be viewed at a left side or a right side of the container, so there is a limit in increasing a display effect of the shoe.

In relation to a technology of displaying the shoes for a commercial purpose, Korean Patent Unexamined Publication No. 2013-0034367 (hereinafter, referred to as 'Prior Art Document 2') discloses a showcase having transmissive display, and the resulting case is configured to include a showcase body, a transparent display means, a turntable, a touch panel, and an LED.

The showcase body has a space capable of storing products such as the shores therein. The transparent display means is installed on a front surface of the showcase body. The products are seated on the turntable, and rotate inside the showcase body by the rotation of the turntable. The LED illuminates the products inside the showcase body.

However, in that Prior Art Document 2 above does not consider a technology of controlling the internal temperature and humidity of the showcase, there is a risk of deformation or contamination of the shoe in a state in which the show is stored inside the showcase.

Further, according to Prior Art Document 2 above, the inside of the showcase can be viewed only through the transparent display means, and the inside of the showcase cannot be viewed at the left side or the right side of the showcase, so there is a limit in increasing the display effect of the shoe.

Korean Patent Unexamined Publication No. 10-2000-0009653 (hereinafter, referred to as 'Prior Art Document 3') discloses a shoes cabinet for s sanitization, and the resulting shoes cabinet is configured to include a body, an infrared radiation unit, a circulation fan, an air circulation passage, a sanitization filter unit, etc.

Prior Art Document 3 above discloses that the shoes are dehumidified, sanitized, and deodorized by far infrared rays and filters while storing the shoes.

However, according to Prior Art Document 3 above, the shoes cannot be displayed.

As described above, conventional devices that accommodate the shoes therein have a limit in the care of the shoes and the display of the shoes.

As a result, in the development of a shoe care device, considering whether the display effect of the shoes can be maximized while constantly maintaining an environment of an internal space (hereinafter, referred to as 'accommodation space') of the shoe care device, whether the accommodation space can be easily opened and closed, whether the shoes can be effectively stored and withdrawn in a state in which the accommodation space is opened, whether structural stability of the shoe care device can be ensured in a state in which the accommodation space is maximally opened, etc., is required.

Moreover, it should be considered whether structural rigidity of a lowest shoe care device can be maintained for a long period even though the shoe care devices are stacked in multiple layers, whether electrical stability can be effectively guaranteed even though the shoe care device is used for a long period, whether an interior effect by the shoe care device can be maximized in addition to the display effect of the shoe, whether internal components are appropriately arranged in a limited space, whether use convenience is excellent, etc., should also be considered, and the development of the shoe care device considering all of the points is required.

DISCLOSURE

Technical Problem

An object to be achieved by the present invention is to provide a showcase of a structure which can manage an item by controlling air in a space accommodating the item, and at the same time, can completely expose the item in various directions as possible to excellently display the item.

An object to be achieved by the present invention is to provide a showcase in which insertion of the item into an accommodation space inside the showcase and withdrawal of the item from the accommodation space are easily conducted when opening the accommodation space inside the showcase, and further, a user easily accesses an inner surface of each of a lower body, a middle body, and an upper body.

An object to be achieved by the present invention is to provide a showcase of a structure in which each showcase is smoothly actuated, and the item can be exposed in various directions as possible even when a plurality of showcases are stacked vertically.

An object to be achieved by the present invention is to provide a showcase which can maintain a stable structure of the showcase even in a state in which a transparent window in which a front surface, a left surface, and a right surface are integrally configured moves forwards to a body as much as possible in order to insert and withdraw the item into and from the showcase.

An object to be achieved by the present invention is to provide a showcase which includes a transparent window in which three surfaces are integrally configured, and when the item accommodated inside the showcase is viewed to an external user through the transparent window, can minimize distortion of the item, and show the item without dividing an entire shape of the item.

An object to be achieved by the present invention is to provide a showcase in which air is circulated and the item is rotated inside the showcase to double both a care effect of the item and a display effect of the item.

An object to be achieved by the present invention is to provide a showcase in which the transparent window and another component can be stably coupled without exposing a coupling portion of the transparent window.

An object to be achieved by the present invention is to provide a showcase in which an area of the transparent window can be maximized, stable coupling between the transparent window and the body can be maintained, and the transparent window can smoothly move, in the showcase in which the transparent window moves to the body.

Technical Solution

A showcase described in this application includes an accommodation space accommodating an item therein. The showcase is configured to include a body, a transparent window, a base, and a blowing part.

The body is configured to include a lower body, a middle body, and an upper body.

The middle body extends upward at a rear side of the lower body. The upper body extends forward at an upper side of the middle body.

The transparent window is configured to include a first window, a second window, and a third window. The first window forms a front surface. The second window forms a left surface of the transparent window. The third window forms a right surface of the transparent window.

The base is fixedly coupled to a lower side of the transparent window. The item may be configured to be placed at an upper side of the base. The base is coupled to the lower body to be movable forward and backward.

The blowing part is positioned in the upper body. The blowing part is configured to circulate air in the accommodation space.

In the showcase, the upper body and the first window may be opened/closed therebetween, the middle body and the second window may be opened/closed therebetween, and the middle body and the third window may be opened/closed therebetween.

The lower side of the second window and the lower side of the third window may be supported on the lower body.

The upper side of the second window and the upper side of the third window may be supported on the upper body.

The transparent window may be configured to include a first curved surface portion and a second curved surface portion.

The first curved surface portion connects the first window and the second window. The first curved surface portion forms a vertical corner of the transparent window, and is configured in a curved surface structure.

The second curved surface portion connects the first window and the second window. The second curved surface portion forms the vertical corner of the transparent window, and is configured in the curved surface structure.

The transparent window is integrally configured.

The transparent window is made of polymethyl methacrylate (PMMA).

The showcase may be configured to include a turntable. The turntable is rotatably coupled around a vertical rotational axis at the upper side of the base.

The showcase may be configured to include a lower guard. The lower guard is fixedly coupled to an outside of a border of the base.

In the showcase, the lower side of the transparent window may be fixedly interposed between the base and the lower guard.

The transparent window may be configured to include a plurality of first through holes. The first through hole is configured in a penetrated hole form at the lower side of each of the first window, the second window, and the third window. The first through hole may be arranged in a horizontal direction.

The base may be configured to include a plurality of second through holes. The second through holes may be formed at locations corresponding to the first through holes at a front side, a left side, and a right side of the base.

The lower guard may be configured to include a plurality of hooks. The hook is projected inward on the inner surface of the lower guard. The hook is configured to be inserted and hooked into the second through hole by passing through the first through hole.

The hook may be configured to include a first hook and a second hook. A hooking location of the first hook and a hooking location of the second hook may be configured to be opposite to each other. The first hook and the second hook may be arranged repeatedly with each other.

The transparent window may be configured to include a first fin portion and a second fin portion. The first fin portion may extend integrally upward at the rear side of the second window. The second fin portion may extend integrally upward at the rear side of the third window.

The upper body may be configured to include a first insertion groove, a first stopper, a second insertion groove, and a second stopper.

The first insertion groove is configured in a narrow gap form so that the first fin portion is inserted and moved. The first insertion groove is formed on the bottom of the upper body in a front and rear direction.

The first stopper is provided in front of the first insertion groove and prevents front movement of the first fin portion.

The second insertion groove is configured in the narrow gap form so that the second fin portion is inserted and moved. The second insertion groove is formed on the bottom of the upper body in the front and rear direction.

The second stopper is provided in front of the second insertion groove and prevents front movement of the second fin portion.

The transparent window may be configured to include a third fin portion and a fourth fin portion. The third fin portion extends integrally backward on a rear end of the second window. The fourth fin portion extends integrally backward on the rear end of the third window.

The middle body is configured to include a third insertion groove and a fourth insertion groove.

The third insertion groove is configured in the narrow gap form so that the third fin portion is inserted. The third insertion groove is formed on the front surface of the middle body in an upper and lower direction.

The fourth insertion groove is configured in the narrow gap form so that the fourth fin portion is inserted. The fourth insertion groove is formed on the front surface of the middle body in the upper and lower direction.

The body may be configured to include a suction port, a discharge port, and an air path.

The suction port is formed on the bottom of the upper body. The discharge port is formed on the bottom of the upper body. The air path is provided inside the upper body, and connects the suction port and the discharge port. The blowing part may be placed in the air path.

The body may be configured to include a heating part. The heating part may be placed in the air path.

The body may be configured to include a first light and a second light. The first light is configured to be formed on the bottom of the upper body and illuminate the accommodation space. The second light is configured to be formed on the bottom of the upper body and illuminate the middle body behind the first light.

Advantageous Effects

A showcase according to an embodiment of the present invention includes a body, a transparent window, a base, and a blowing part. The body includes a lower body, a middle body, and an upper body, and the transparent window includes a first window, a second window, and a third window. When the transparent window is positioned relatively at a rear side, an accommodation space inside the showcase is closed, and when the transparent window is positioned relatively at a front side, the accommodation space is opened. According to an embodiment of the present invention, a showcase can be provided in which air in the accommodation space can be controlled, an item can be completely exposed at a front side, a left side, and a right side, and the item can be effectively managed and displayed.

In a state in which the transparent window and the base move forward to the body, the item can be seated on the base through a space between the upper body and a first window, and the item can be withdrawn from the base. Further, in this case, a user can access an upper space of the item or the base through a space between a space between the middle body and a second window or between the middle body and a third window. Further, in this case, the user easily accesses an inner surface of each of the lower body, the middle body, and the upper body.

According to an embodiment of the present invention, it is convenient to withdraw and insert the item from and into the showcase, and positioning the item is convenient. Further, the transparent window can be integrally formed, an area of the transparent window can be maximized, and a display effect of the item can be increased.

By the showcase according to an embodiment of the present invention, even though a plurality of showcases are stacked vertically, each showcase can be smoothly actuated, and each item accommodated in each showcase can be exposed.

The showcase according to an embodiment of the present invention includes a base and a lower guard, and a lower side of the transparent window is supported on the lower body of the body through the base and the lower guard in a state in a closed state and an opened state of the showcase. The transparent window includes a first fin portion and a second fin portion, and the upper body of the body includes a first insertion groove, a second stopper, a second insertion groove, and a second stopper. In the opened state of the showcase, the accommodation space is opened at the upper side, the left side, and the right side, and both left and right sides at the upper side both left and right sides at the lower side of the transparent window and both are supported by the body. Therefore, in the state in which the body moves forward to the body as possible, the accommodation space can opened at the upper side, the left side, and the right side, and the item can be inserted into the accommodation space or the item can be withdrawn from the accommodation space, and in this case, the upper side and the lower side of each of the second window and the third window are supported by the body, and stable coupling between the body and the transparent body is maintained.

In the showcase according to an embodiment of the present invention, the transparent window is made of polymethyl methacrylate (PMMA), and includes a first curve portion and a second curve portion. According to an embodiment of the present invention, any gap is not formed at a connection portion of the first window and the second window and a connection portion of the first window and the second window, and the aesthetics at the portions are excellent, and foreign substances such as dust can be prevented from being inserted into the accommodation space through the portions. Further, the aesthetics of the transparent window itself is excellent, and the showcase is easily assembled. Further, discoloration of the transparent window can be prevented, and a solid transparent window can be formed. Further, when the item accommodated in the showcase is viewed to an external user through the transparent window, the entire shape of the article is not divided, but integrally viewed, and distortion is prevented.

According to the showcase according to an embodiment of the present invention is configured to include a turntable. Therefore, a showcase can be provided in which both circulation of the air and rotation of the item are conducted in the accommodation space, and as a result, both the care of the item and the display effect of the item are excellent.

The showcase according to an embodiment of the present invention includes the lower guard, and the lower side of the transparent window is interposed to be fixed between the base and the lower guard. The transparent window includes a first through-hole, the base includes a second through-hole, and the lower guard includes a hook configured to be inserted and locked into the second through-hole by passing through the first through-hole. The hook includes a first hook and a second hook, and a locked location of the first hook and a locked location of the second hook may be configured to face each other. As a result, a showcase can be provided which stable coupling can be made without exposing the coupling portion of the transparent window.

According to an embodiment of the present invention, a showcase is provided in which the display effect of the item can be maximized by maximizing an area of the transparent window, stable coupling between the transparent window and the body can be maintained, and the transparent window can smoothly move, in the showcase in which the transparent window moves to the body.

DESCRIPTION OF DRAWINGS

FIG. 21 does not illustrate the shoe.

FIG. 31*a* illustrates a state in which a path cover of the air path is separated.

FIG. 32*a* illustrates an air flow in the accommodation space while the front side of the shoe faces the front side in the first direction.

FIG. 34 does not illustrate the shoe.

MODES FOR THE INVENTION

Figure 1A:
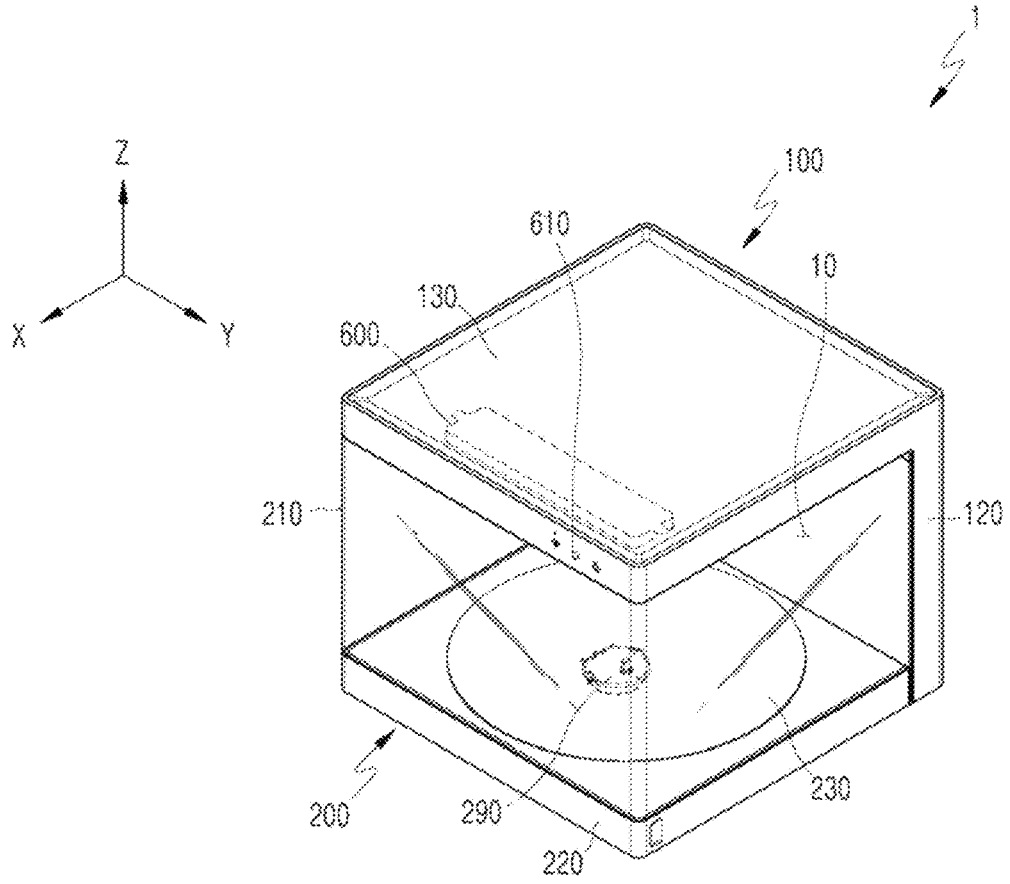
FIG. 1*a* is a perspective view illustrating a showcase according to an embodiment of the present invention.

Hereinafter, embodiments disclosed in this specification will be described in detail with reference to the accompanying drawings and the same or similar components are denoted by the same or similar reference numerals, and duplicated description thereof will be omitted. Suffixes "module" and "unit" for components used in the following description are given or mixed in consideration of easy preparation of the present invention only and do not have their own distinguished meanings or roles. Further, in describing the embodiment disclosed in this specification, a detailed description of related known technologies will be omitted if it is determined that the detailed description makes the gist of the embodiment disclosed in this specification unclear. Further, it is to be understood that the accompanying figures are just used for easily understanding the embodiments disclosed in this specification and a technical spirit disclosed in this specification is not limited by the accompanying figures and all changes, equivalents, or substitutes included in the spirit and the technical scope of the present invention are included.

Terms including an ordinary number, such as first and second, are used for describing various elements, but the elements are not limited by the terms. The terms are used only to discriminate one element from another element.

It should be understood that, when it is described that a component is "connected to" or "accesses" another component, the component may be directly connected to or access the other component or a third component may be present therebetween. In contrast, when it is described that a component is "directly connected to" or "directly accesses" another component, it is understood that no element is present between the element and another element.

A singular form includes a plural form if there is no clearly opposite meaning in the context.

In the present application, it should be understood that term "include" or "have" indicates that a feature, a number, a step, an operation, a component, a part or the combination thereof described in the specification is present, but does not exclude a possibility of presence or addition of one or more other features, numbers, steps, operations, components, parts or combinations thereof, in advance.

The present invention discloses a showcase 1. The showcase 1 is configured to display an item while the item is accommodated therein. The showcase 1 may be configured to care the item so that a physical/chemical state of the item accommodated therein is maintained.

The item described in the present invention may include at least one of shoes, wallets, bags, dolls, toys, plastic models, accessories, and souvenirs. That is, the showcase 1 may be configured to display and care at least one of shoes, wallets, bags, dolls, toys, plastic models, accessories, and souvenirs.

The showcase described in the present invention may be a device that has the shoes among the items as an object to be displayed and cared.

The showcase described in the present invention may be a device that displays and cares items other than the shoes.

Hereinafter, it will be described as an example that the item to be displayed and care is the shoe. The shoe described in the present invention may be replaced with another item other than the shoe.

When the showcase described in the present invention has item A as the object to be displayed and cared, the showcase described in the present invention may be referred to as 'A care device'. When the showcase described in the present invention has the shoes as the object to be displayed and cared, the showcase may be referred to as 'shoes care device'.

When the shoe is directly exposed to dust, water, heat, and/or sunshine, a fiber material of the shoe may be damaged over time, and a color and a form of the shoe may be changed.

In order to keep the shoe in an original state (e.g., a state of the shoe at the time of purchase or a state of a clean shoe) for a long time, the shoe should not be exposed much to light and the shoe should be kept at a place that is not too cold or hot. Further, the shoe needs to be kept at a place at which a temperature and a humidity are appropriately maintained.

Since the shoe made of a leather or suede material is easily colored or has mold, the shoe should be kept in an environment where temperature and humidity are appropriately maintained. A mothball acquired by solidifying pesticides and fragrances have a unique chemical smell that makes it difficult to remove because the smell permeates the shoe when the mothball is kept jointly with the shoe.

Further, when the shoes are stacked in layers, the form of the shoe may be changed by an applied load.

Meanwhile, as described above, in recent years, users who collect shoes of popular brands as part of a hobby or financial tech has increased, and the care of the shoe and the display of the shoe has become important needs of users.

Considering the points, a showcase according to an embodiment of the present invention is configured to safely keep the shoe, establish and adjust an environment (e.g., a predetermined range of temperature, humidity, etc.) required for each shoe, and effectively display the shoe, and increase use convenience of the user.

A first direction X, a second direction Y, and a third direction Z described in the embodiment of the present invention may be directions orthogonal to each other.

The first direction X and the second direction Y may be directions parallel to a horizontal direction, and the third direction Z may be a direction parallel to a vertical direction. When the first direction X is a direction parallel to the front and rear direction, the second direction Y may be a direction parallel to a left and right direction.

In describing embodiments of the present invention, except for a case which is particularly differently limited, the first direction X, the second direction Y, and the third direction Z may be appreciated as a front direction, a left direction, and an upper direction, respectively.

Figure 1B:
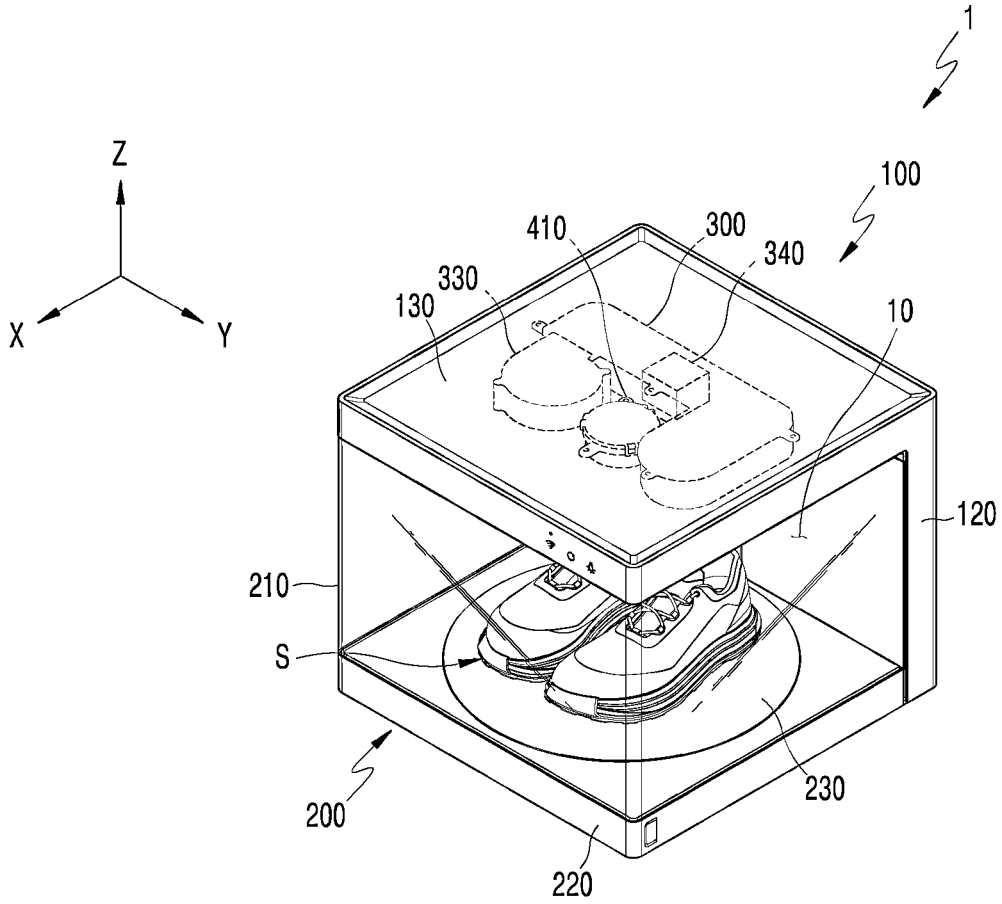
FIG. 1*b* is a perspective view illustrating a state in which an item is stored in an accommodation space of the showcase of FIG. 1*a*.

FIG. 1*a* is a perspective view illustrating a showcase 1 according to an embodiment of the present invention. FIG. 1*a* illustrates a state in which an internal space (hereinafter, referred to as 'accommodation space 10') of the showcase 1 is closed. FIG. 1*b* is a perspective view illustrating a state in which a shoe S is stored in the accommodation space 10 of the showcase 1 of FIG. 1*a*.

Figure 2A:
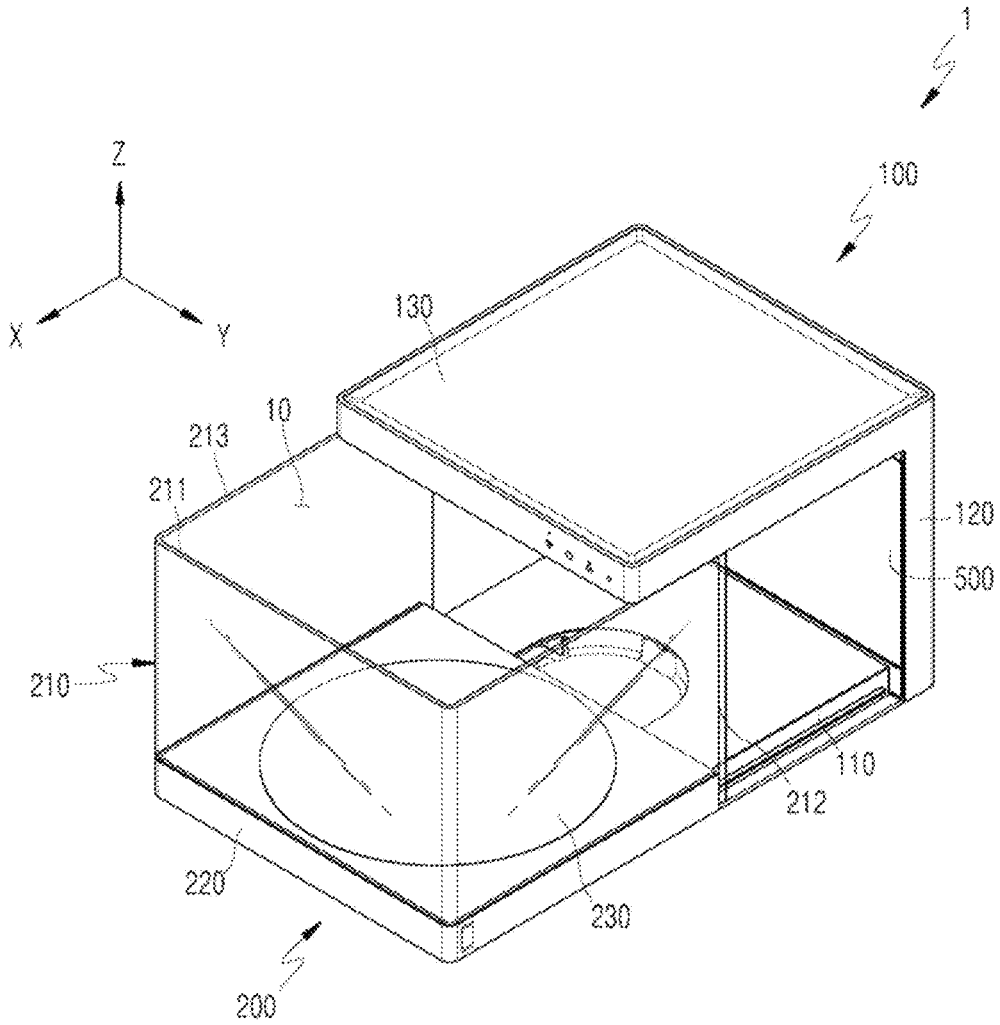
FIG. 2*a* is a perspective view illustrating a state in which the accommodation space of the showcase of FIG. 1*a* is opened.
Figure 2B:
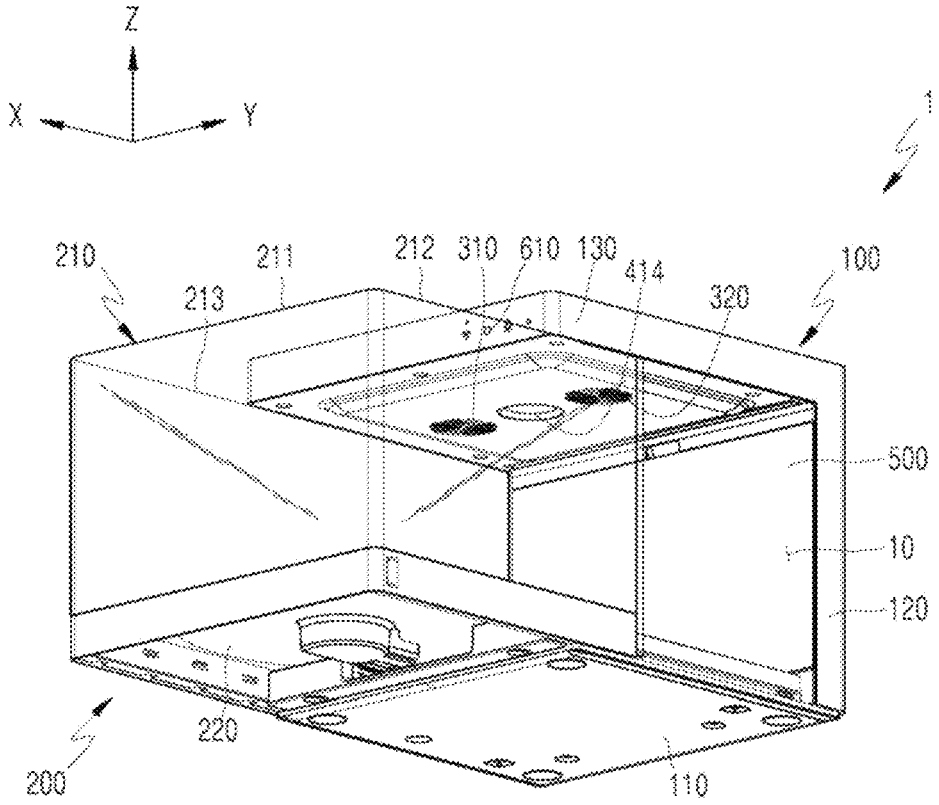
FIG. 2*b* is a perspective view illustrating a view of the showcase of FIG. 2*a* viewed in another direction.

FIG. 2*a* is a perspective view illustrating a state in which the accommodation space 10 of the showcase 1 of FIG. 1*a* is opened. FIG. 2*b* is a perspective view illustrating a view of the showcase of FIG. 2*a* viewed in another direction.

As illustrated in FIGS. 1*a* and 1*b*, the showcase 1 according to the embodiment is configured to include a body 100 and a moving body 200.

The body 100 and the moving body 200 form the accommodation space 10 accommodating the shoe S jointly. The body 100 and the moving body 200 are coupled to move with respect to each other. The moving body 200 may be coupled to the body 100 to reciprocally move in a horizontal direction.

The showcase 1 illustrated in FIG. 1*a* may be changed like the showcase 1 illustrated in FIG. 2*a*. That is, the moving body 200 may slidably move in a first direction X with respect to the body 100, and the showcase 1 is transformed from the closed state to the opened state, and the accommodation space 10 may be opened.

The showcase 1 illustrated in FIG. 2*a* may be changed like the showcase 1 illustrated in FIG. 1*a* again. That is, the moving body 200 may slidably move in an opposite direction to the first direction X with respect to the body 100, and the showcase 1 is transformed from the opened state to the closed state, and the accommodation space 10 may be closed.

As such, in the showcase 1 according to the embodiment of the present invention, the moving body 200 may move the first direction X or the opposite direction to the first direction X with respect to the body 100, and reciprocally move in front and rear directions.

In the state in which the accommodation space 10 is closed, the accommodation space 10 may be sealed from outside air. Therefore, when the shoe S is accommodated in the accommodation space 10 and the accommodation space 10 is closed, a contact of the shoe S with dust and moisture of the outside air may be interrupted.

The body 100 may form an upper surface and a rear surface of the accommodation space 10.

The moving body 200 may form a front surface, a lower surface, and both side surfaces of the accommodation space 10.

The accommodation space 10 may be formed in a hexahedral form. However, the accommodation space 10 of the showcase 1 according to the embodiment of the present invention is not limited to such a shape, and may be configured in various three-dimensional shapes.

The body 100 and the moving body 200 may form an overall appearance of the showcase 1. An exterior of the showcase 1 may be configured in the hexahedral form. That is, in the state in which the body 100 and the moving body 200 are coupled to each other and the accommodation space 10 is closed, the external appearance of the showcase 1 may be configured in the hexahedral form. However, the showcase 1 according to the embodiment of the present invention is not limited to such a shape, and may be configured in various three-dimensional shapes.

The body 100 may include an upper body 130, a middle body 120, and a lower body 110.

The upper body 130 is positioned at an upper side of the accommodation space 10. The upper body 130 forms the upper surface of the accommodation space 10. The upper body 130 may form an uppermost portion of the showcase 1. The upper surface of the upper body 130 may form a flat surface along a substantially horizontal surface. When a plurality of showcases 1 is provided, any one showcase 1 may be placed on the upper surface of the upper body 130 of the other one showcase 1, and the showcases 1 may be stacked on each other.

The lower body 110 is positioned below the accommodation space 10. The lower body 110 may form a lowermost portion of the showcase 1. The lower body 110 may form a bottom portion of the showcase 1.

The middle body 120 is positioned behind the accommodation space 10. The middle body 120 forms the rear surface of the accommodation space 10. The middle body 120 may connect the upper body 130 and the lower body 110 behind the accommodation space 10. The middle body 120 may form a rear wall surface of the showcase 1.

The body 100 is configured to include the upper body 130, the middle body 120, and the lower body 110, and as a result, the body 100 may form a substantially 'C' form on the side view.

As described above, the moving body 200 is configured to move forward and backward with respect to the body 100. The moving body 200 may include a base 220, a transparent window 210, and a turntable 230.

The base 220 may be coupled to the lower body 110 to be slidably movable in the first direction X. The base 220 may form the bottom portion of the moving body 200. The base 220 may be positioned at the upper side of the lower body 110. A bottom surface of the base 220 may be positioned in close contact with or in proximity to the upper surface of the lower body 110.

The transparent window 210 may form of extending upward from the base 220. The transparent window 210 may form the front surface, and both side surfaces (a left surface and a right surface) of the accommodation space 10. The transparent window 210 may be made of a transparent or translucent material.

Light inside and outside the accommodation space 10 may pass through the transparent window 210. The transparent window 210 may be made of a material which is weather-resistant to prevent discoloration. The transparent window 210 may be made of an acrylic (PMMA) material which is weather-resistant and scratch-resistant.

The transparent window 210 may prevent a beam having a predetermined wavelength from being introduced into the accommodation space 10. As an example, the transparent window 210 may be configured to block ultraviolet rays. The ultraviolet rays as an electromagnetic wave in which a wavelength corresponds to 10 to 397 nm shorter than visible rays are light which has a strong chemical action and causes getting sunburn or discoloration.

As an example, an ultraviolet-proof film may be attached to an inner surface or an outer surface of the transparent window 210. Alternatively, the inner surface or the outer surface of the transparent window 210 may be UV-coated with an ultraviolet-proof agent.

The transparent window 210 includes a first window 211, a second window 212, and a third window 213. The first window 211 may form the front surface of the accommodation space 10. The second window 212 may form the left surface of the accommodation space 10. The third window 213 may form the right surface of the accommodation space 10.

In the state in which the shoe S is accommodated in the accommodation space 10, a user may view the shoe S through the transparent window 210. As a result, the showcase 1 may be used as a device which may display the shoe S while keeping and caring the shoe S.

As illustrated in FIGS. 1*a* and 1*b*, in the state in which the moving body 200 is positioned relatively at a rearmost side, the accommodation space 10 may be sealed from the outside air. In this case, the accommodation space 10 may be formed in the hexahedral form. In this case, the moving body 200 may be present at a first location and the showcase 1 is in the closed state.

As illustrated in FIGS. 2*a* and 2*b*, in the state in which the moving body 200 moves in the first direction X, the accommodation space 10 may be opened. In this case, an upper portion of the first window 211 is spaced to a front side in the first direction X from the front surface of the upper body 130 to form a gap (hereinafter, referred to as 'first gap').

In this case, an upper portion of the first window 212 is spaced to a front side in the first direction X from the front surface of the upper body 120 to form a gap (hereinafter, referred to as 'first gap'). The third window 213 is spaced to the front side in the first direction X from a right side surface of the middle body 120 to form a gap (hereinafter, referred to as 'third gap').

In the state in which the moving body 200 moves in the first direction X as much as possible, i.e., in the state in which the moving body 200 is positioned relatively at a frontmost side, the moving body 200 may be present at a second location and the showcase 1 may be in the opened state.

The user may put the shoe S into the accommodation space 10 or withdraw the shoe S from the accommodation space 10 through the first gap. The user may put the shoe S into the accommodation space 10 or withdraw the shoe S from the accommodation space 10 through the first gap. An internal panel 500 may be coupled to the inner surface of the middle body 120 or uncoupled from the inner surface of the middle body 120.

The turntable 230 may form the upper surface on which the shoe S is placed. The upper surface of the turntable 230 may have a circular shape. The turntable 220 may form the lower surface of the accommodation space 10 jointly with the base 220.

The turntable 230 may be rotatably coupled to the base 220 around a vertical axis, i.e., an axis parallel to a third direction Z.

For the rotation of the turntable 230, a motor 290 may be provided in the moving body 200. The motor 290 may be coupled to the base 220. The turntable 230 may rotate in conjunction with the rotation of the motor 290. Rotational force of the motor 290 may be delivered to the turntable 230 through a reducer. The motor 290 may rotate unidirectionally or reciprocally rotate bidirectionally.

The turntable 230 is provided, and as a result, the shoe S may rotate in the accommodation space 10 or a display effect of the shoe S may be enhanced.

The showcase 1 may include an operating button 610 and a controller 600. The operating button 610 may be formed in the body 100. As an example, the operating button 610 may be formed on the front surface of the upper body 130. When the user manipulates the operating button 610, the turntable 230 may rotate or stop. The user manipulates the operating button 610 to adjust a rotational speed of the turntable 230. The user may input a rotation time of the turntable 230 into the controller 600 through the operating button 610.

The user manipulates the operating button 610 to rotate the turntable 230 at a predetermined angle. In the state in which the accommodation space 10 is opened, the user may place the shoe S on the upper surface of the turntable 230 by holding any one part (heel top, lining, tong, etc.) of the shoe S. Thereafter, the user manipulates the operating button 610 to rotate the turntable 230 at a predetermined angle.

As an example, the user manipulates the operating button 610 to rotate the turntable 230 at a predetermined angle so that a front and rear direction of the shoe S coincides with the first direction X. Alternatively, the user manipulates the operating button 610 to rotate the turntable 230 at a predetermined angle so that the front and rear direction of the shoe S form a predetermined angle with the first direction X.

Therefore, even though the user places the shoe S on the upper surface of the turntable 230 while gripping any one part of the shoe S, the shoe S may be placed (displaced) in a direction desired by the user.

A sensor (not illustrated) that senses movement of the moving body 200 may be provided in the body 100. When the accommodation space 10 is closed, the controller 600 may rotate the turntable 230 by a signal of the sensor.

A load sensor (not illustrated) may be provided in the base 220. The load sensor may automatically measure a load of the shoe S placed on the turntable 230. The rotational speed of the turntable 230 according to a measurement value of the load sensor may be set in the controller 600. Alternatively, the user may input the rotational speed of the turntable 230 according to the measurement value of the load sensor into the controller 600 through the operating button 610.

A camera (not illustrated) may be provided in the showcase 1. The camera may automatically shoot the shoe S placed on the turntable 230. The controller 600 may recognize the shape, size, and/or type of the shoe S through a shooting image of the camera.

The rotational speed of the turntable 230 according to the shape, size, and/or type of the shoe S may be set in the controller 600. Alternatively, the user may input the rotational speed of the turntable 230 according to the shape, size, and/or type of the shoe S into the controller 600 through the operating button 610.

The showcase 1 may include an operating sensor. The operating sensor may sense an access of the user. The turntable 230 may be rotated or stopped by the sensing signal of the operating sensor.

Figure 3A:
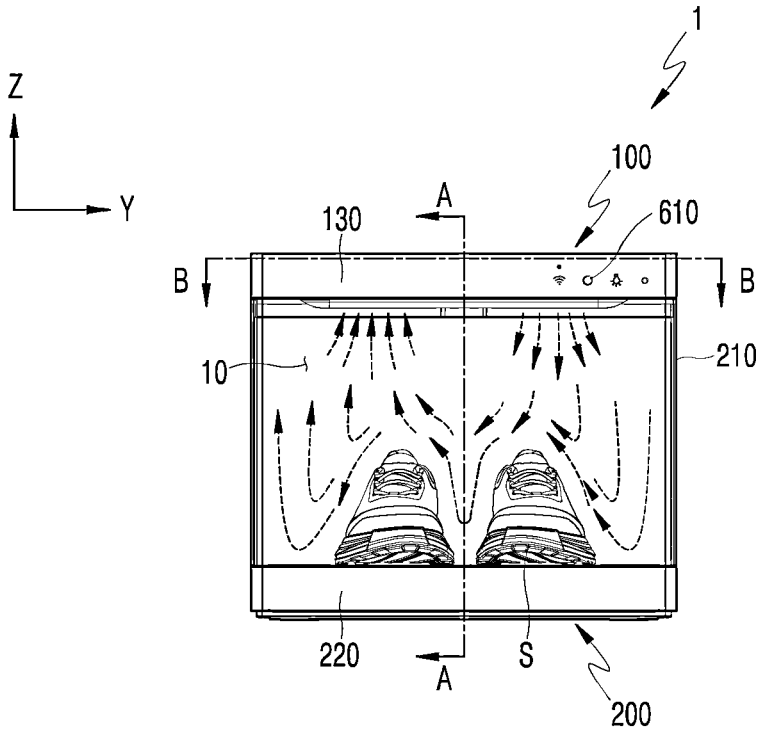
FIG. 3*a* is a side view illustrating a use state of the showcase of FIG. 1*b*.

FIG. 3*a* is a side view illustrating a use state of the showcase 1 of FIG. 1*b*. FIG. 3*a* illustrates a state of illuminating the shoe S in the accommodation space 10.

Figure 3B:
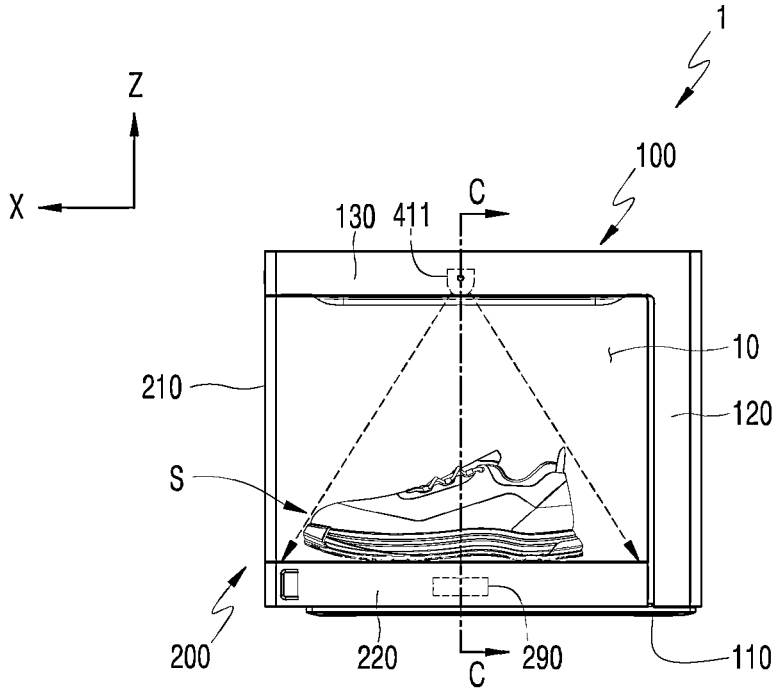
FIG. 3*b* is a front view illustrating the use state of the showcase of FIG. 1*b*.

FIG. 3*b* is a front view illustrating the use state of the showcase 1 of FIG. 1*b*. FIG. 3*b* illustrates an air flow in the accommodation space 10.

The showcase 1 according to the embodiment of the present invention may include a first light 410. The first light 410 may be provided in the upper body 130.

As illustrated in FIG. 3*a*, the first light 410 may illuminate the accommodation space 10. The first light 410 may include a light source 411 and a lens 414.

The light source 411 may intensively irradiate light onto the upper surface of the turntable 230 on which the shoe S is placed. The light of the light source 411 may intensively illuminate the shoe S placed on the upper surface of the turntable 230. When the light 410 is turned, an image of the shoe S stored in the accommodation space 10 may be changed by the light of the light source 411.

The light of the light source 411 may illuminate the accommodation space 10 by passing through the lens 414. An ultraviolet-proof film may be attached to the lens 414 or the ultraviolet-proof agent may be coated on the lens 414 in order to block the ultraviolet rays.

When the user manipulates the operating button 610, the light source 411 may be turned on or off. The user may input an operating time of the light source 411 into the controller 600 through the operating button 610. The user manipulates the operating button 610 to adjust the operating time of the light source 411.

Alternatively, the light source 411 may be turned on or off by the sensing signal of the operating sensor. The controller 600 may turn on-off the light source by the signal of the operating sensor.

Alternatively, the light source 411 may be turned on or off by the sensing signal of the sensor. When the accommodation space 10 is closed, the controller 600 may turn on-off the light source by the signal of the sensor.

Alternatively, the operating time and the operating pattern of the light source according to the measurement value of the load sensor may be set in the controller 600. The user may input the operating time and the operating pattern of the light source 411 according to the measurement value of the load sensor into the controller 600 through the operating button 610.

Alternatively, the operating time and the operating pattern of the light source according to the shape, size, and/or type of the shoe S may be set in the controller 600. The user may input the operating time and the operating pattern of the light source 411 according to the shape, size, and/or type of the shoe S into the controller 600 through the operating button 610.

The light source 411 may be configured to change the color of the light. As an example, the light source 411 may be constituted by Red Green Blue White (RGBW) LEDs. The controller 600 may control current applied to a Red (R) LED, a Green (G) LED, a Blue (B) LED, and a White (W) LED. When the controller 600 controls the current applied to the RGBW LEDs, the aesthetics and a color sense of the shoe S stored in the accommodation space 10 may be variously changed. The user may input a pattern of the current applied to the RGBW LED into the controller 600 through the operating button 610.

Figure 4A:
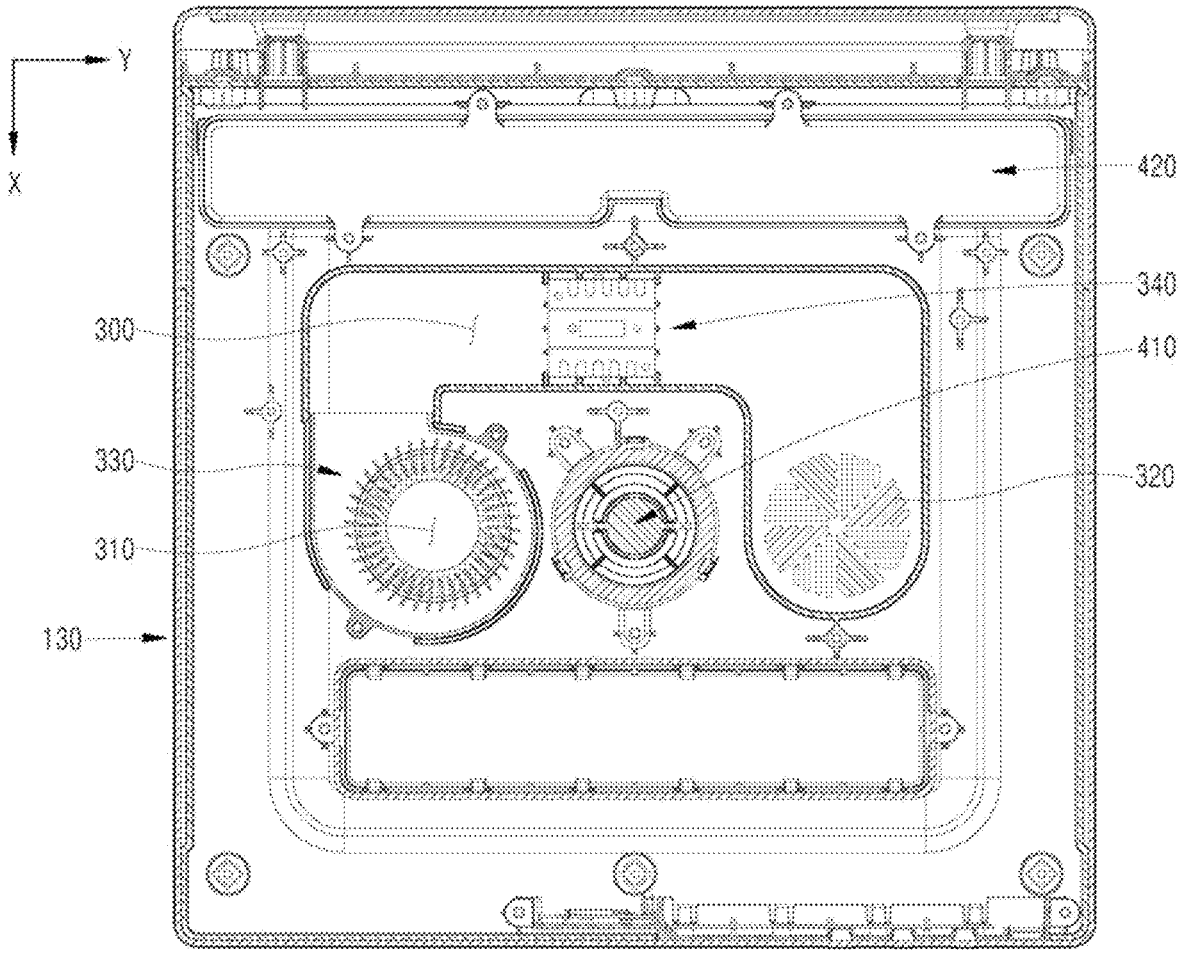
FIG. 4*a* as a cross-sectional view illustrating a body according to an embodiment of the present invention is a diagram an upper body viewed from the top.

FIG. 4*a* as a cross-sectional view illustrating a body 100 according to an embodiment of the present invention is a diagram an upper body 130 viewed from the top. In FIG. 4*a*, in order to show an internal view of the upper body 130, a state in which a first external cabinet 136 of the upper body 130 is removed is illustrated.

Figure 4B:
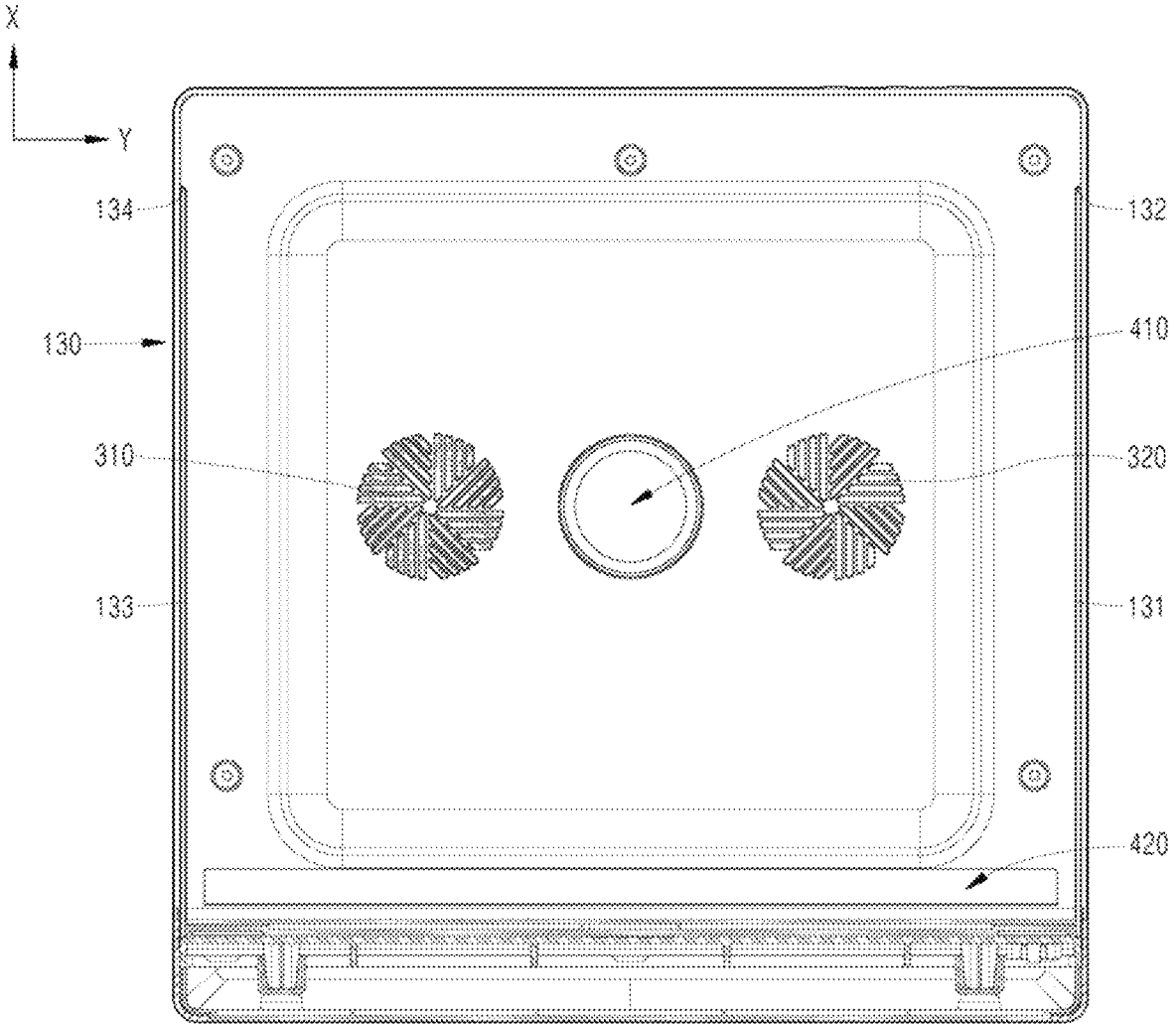
FIG. 4*b* as a cross-sectional view illustrating the body according to an embodiment of the present invention is a diagram illustrating an upper body from the bottom.

FIG. 4*b* as a cross-sectional view illustrating the body 100 according to an embodiment of the present invention is a diagram illustrating the upper body 130 from the bottom.

The body 100 may be configured to include an air path 300. The body 100 may be configured to include a suction port 310 and a discharge port 320.

The air path 300 may be formed in the upper body 130. The air path 300 may be provided inside the upper body 130.

The air path 300 connects the suction port 310 and the discharge port 320. The suction port 310 may form an inlet of the air path 300, and the discharge port 320 may form an outlet of the air path 300.

The suction port 310 may be formed on a bottom surface of the upper body 130. The discharge port 320 may be formed on the bottom surface of the upper body 130.

The air in the accommodation space 10 may be suctioned into the air path 300 through the suction port 310. The air in the air path 300 may be discharged to the accommodation space 10 through the discharge port 320. Therefore, air forcibly blown by a blowing part 330 to be described below may be circulated in the accommodation space 10 and the air path 300.

As illustrated in FIGS. 1*b* and 4*a*, the showcase 1 according to the embodiment of the present invention may include the blowing part 330 and a heating part 340. The blowing part 330 and the heating part 340 may be provided in the upper body 130.

The blowing part 330 is configured to circulate the air in the accommodation space 10.

The blowing part 330 may be positioned in the upper body 130. The blowing part 330 may be placed in the air path 300, and may generate a flow of the air in the air path 300.

The heating part 340 may be configured to directly or indirectly heat the air in the accommodation space 10. The heating part 340 may be placed in the body 100. The heating part 340 may be placed in the air path 300.

The body 100 may be configured to include the first light 410 and a second light 420. The first light 410 may be configured to be formed on the bottom surface of the upper body 130 and to illuminate the accommodation space 10. The second light 420 may be configured to be formed on the bottom surface of the upper body 130 and to illuminate the middle body 120 behind the first light 410.

The heating part 340 may deliver thermal energy to the air which moves in the air path 300. The heating part 340 may be configured to include a heat wire 341.

The blowing part 330 and the heating part 340 may control the temperature and/or humidity of the accommodation space 10.

When the user manipulates the operating button, the blowing part 330 may rotate or stop. The user manipulates the operating button to adjust the rotational speed of the blowing part 330. The user may input the rotation time of the blowing part 330 into the controller through the operating button. The air in the accommodation space 10 may be circulated by operating the blowing part 330, and the air in the accommodation space 10 may maintain a uniform state as a whole.

When the user manipulates the operating button, the heating part 340 may be turned on or off. The user manipulates the operating button to adjust the operating time of the heating part 340. The user may input an operating temperature of the heating part 340 into the controller through the operating button. The temperature of the air heated by the heating part 340 may be selected or adjusted according to characteristics of a used shoe S.

The blowing part 330 and the heating part 340 may be operated for a predetermined time. Further, each of the operating and the stopping of the blowing part 330 and the heating part 340 may be repeatedly conducted for a predetermined time. The time may be decided by the user, or automatically decided by a program.

According to the embodiment of the present invention, the temperature and/or the humidity of the accommodation space 10 may be maintained at an optimal state which is suitable for the characteristics of each shoe S.

Therefore, the showcase 1 according to the embodiment of the present invention may achieve both a shoe display effect of displaying the shoe and a shoe care effect of interrupting deformation or contamination of the shoe.

The blowing part 330 and the heating part 340 may be turned on or off by the sensing signal of the sensor. When the accommodation space 10 is closed, the controller 600 may turn on-off the blowing part 330 and the heating part 340 by the signal of the sensor.

Alternatively, the operating time and the operating pattern of the blowing part 330 and the heating part 340 according to the measurement value of the load sensor may be set in the controller. The user may input the operating time and the operating pattern of the blowing part 330 and the heating part 340 according to the measurement value of the load sensor into the controller through the operating button.

Alternatively, the operating time and the operating pattern of the blowing part 330 and the heating part 340 according to the shape, size, and/or type of the shoe may be set in the controller. The user may input the operating time and the operating pattern of the blowing part 330 and the heating part 340 according to the shape, size, and/or type of the shoe into the controller through the operating button.

Therefore, the showcase 1 according to the embodiment of the present invention controls the temperature and/or the humidity of the accommodation space 10 differently according to a material, a load, the shape, the size, and/or the type of the shoe to completely interrupt the deformation or the contamination of the shoe.

Figure 5A:
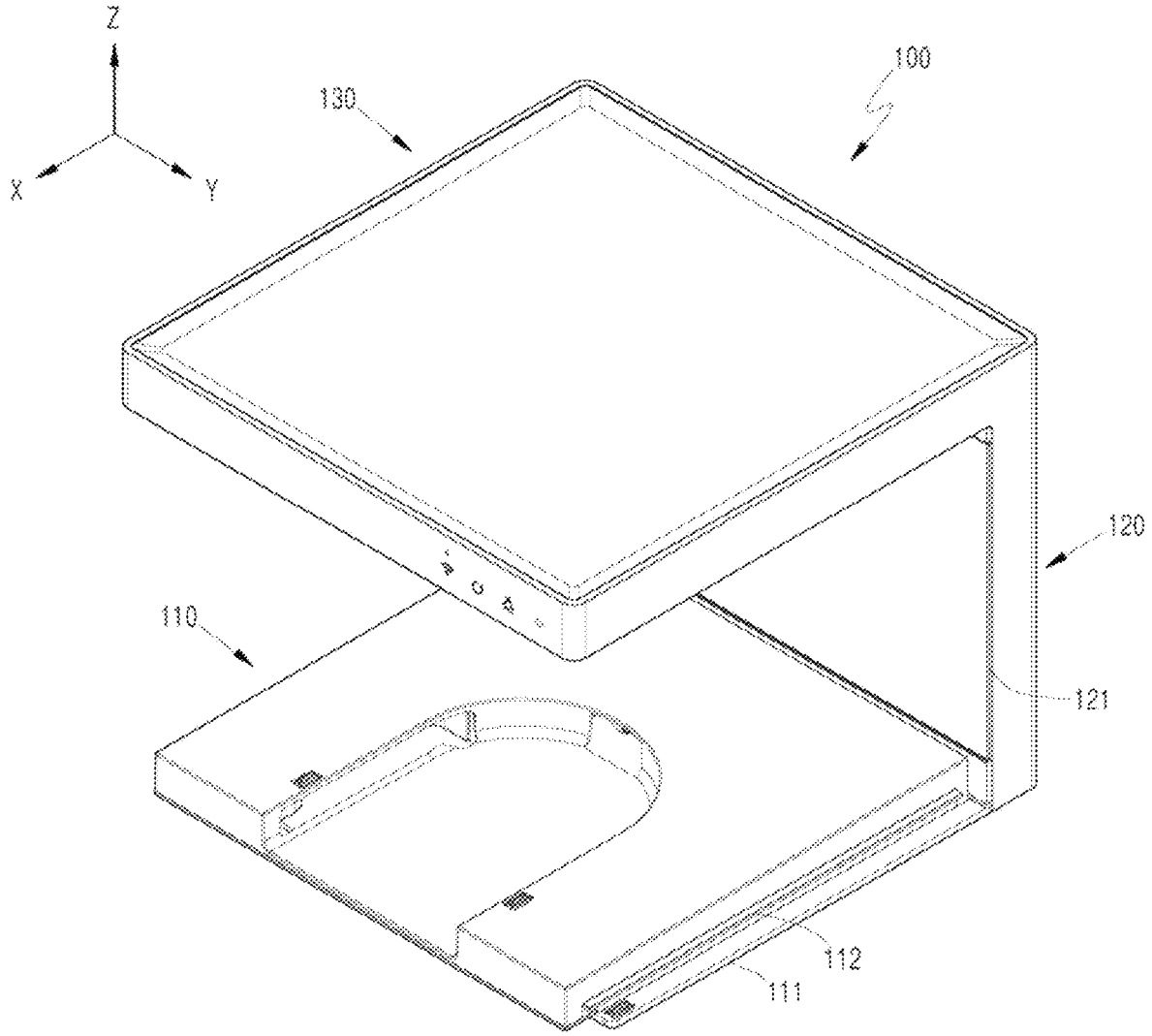
FIG. 5*a* is a perspective view illustrating the body of the showcase according to an embodiment of the present invention.
Figure 5B:
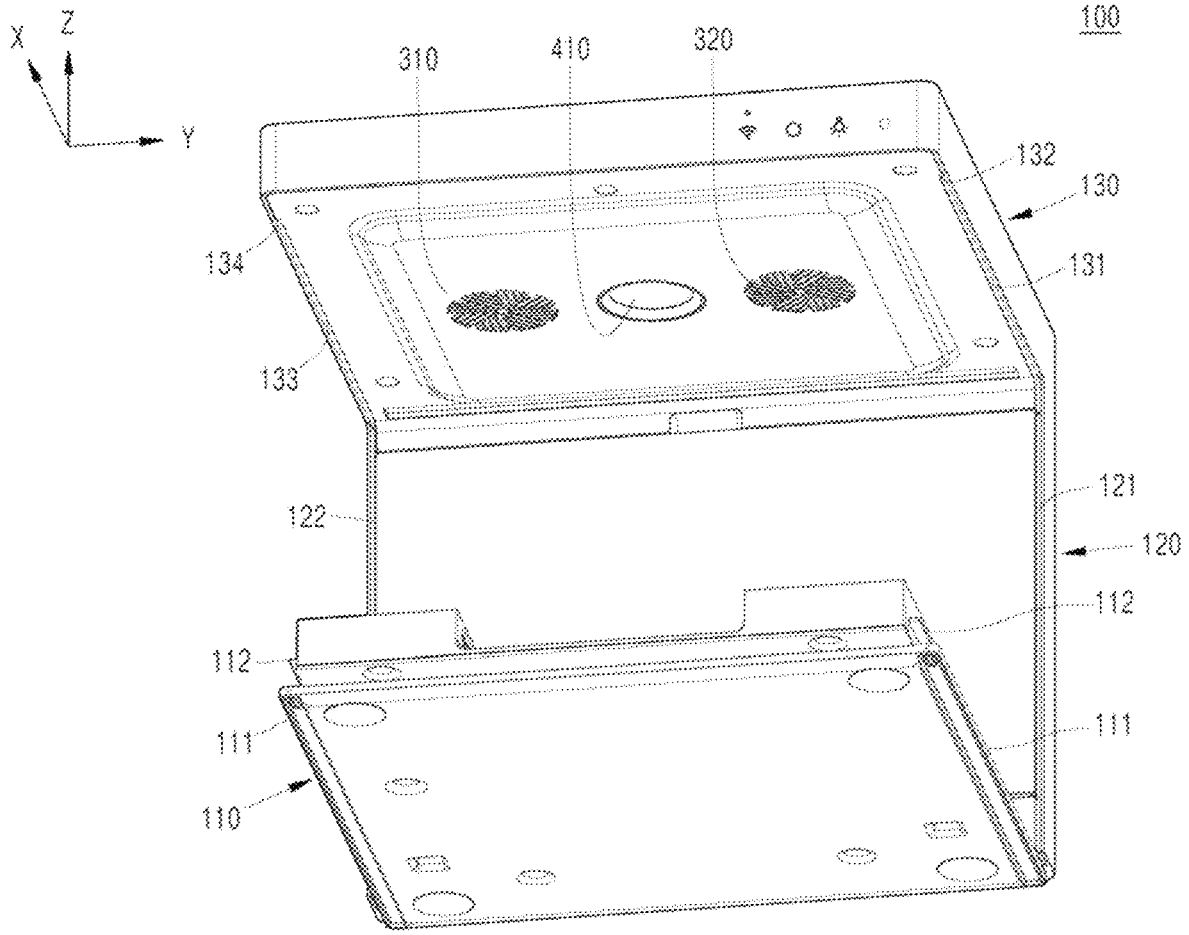
FIG. 5*b* is a perspective view illustrating a view of the body of FIG. 5*a* viewed in another direction.

FIG. 5*a* is a perspective view illustrating the body 100 of the showcase 1 according to the embodiment of the present invention. FIG. 5*b* is a perspective view illustrating a view of the body 100 of FIG. 5*a* viewed in another direction.

Figure 6:
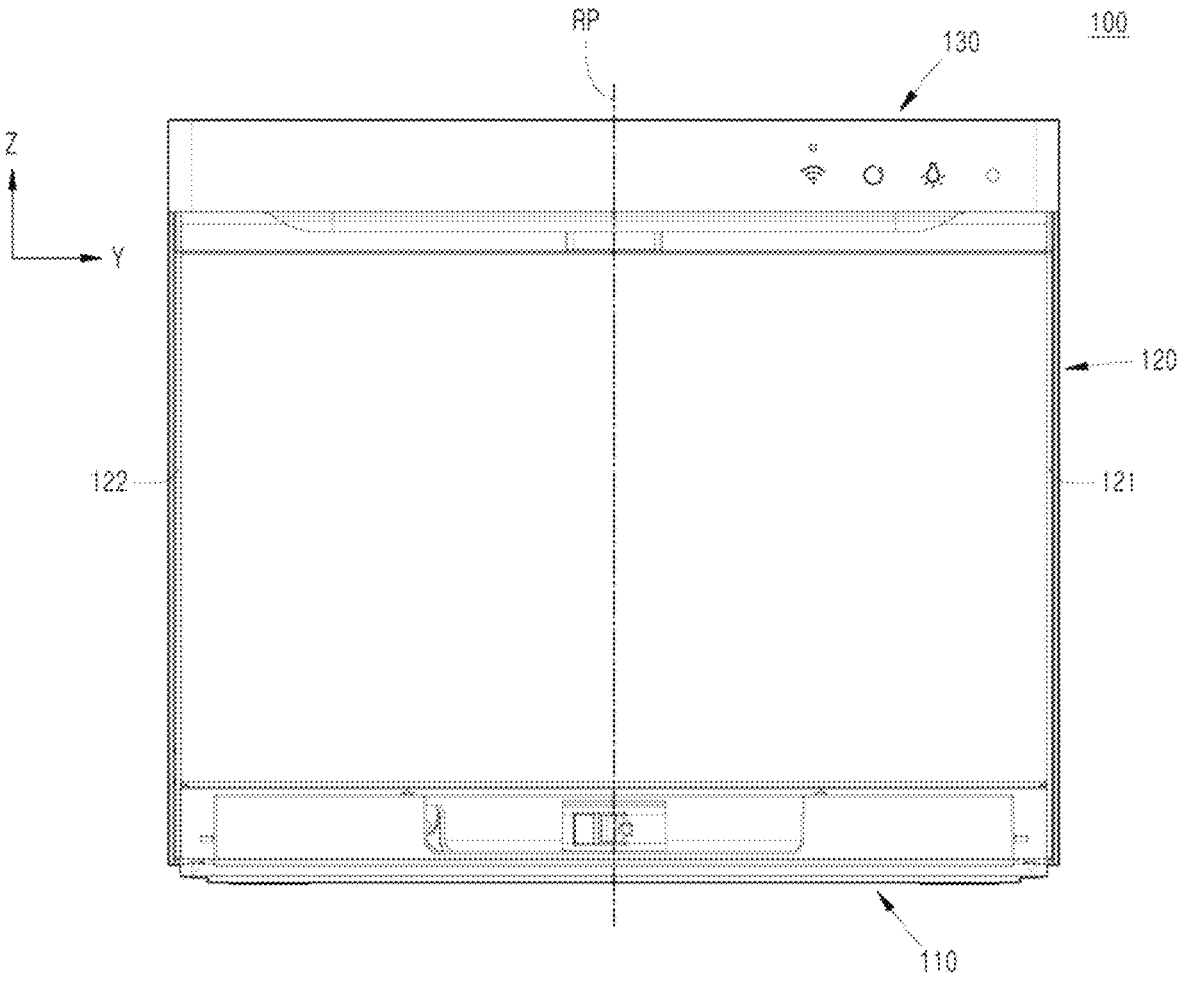
FIG. 6 is a front view illustrating the body of FIG. 5*a*.

FIG. 6 is a front view illustrating the body 100 of FIG. 5*a*.

The lower body 100 of the body 100 forms the bottom surface of the showcase 1. The lower body 110 may be configured to support the lower side of the moving body 200.

The middle body 120 of the body 100 extends upward from a rear side of the lower body 110 and forms a back surface of the showcase 1. The inner surface of the middle body 120 forms the back surface of the accommodation space 10.

The upper body 130 of the body 100 extends forward from the upper side of the middle body 120 and forms the upper surface of the showcase 1. The inner surface of the upper body 130 may forms the upper surface of the accommodation space 10. The upper body 130 may be configured to support the upper side of the moving body 200.

The body 100 may be configured in a symmetric form around a reference plane RP orthogonal to the second direction Y.

Figure 7A:
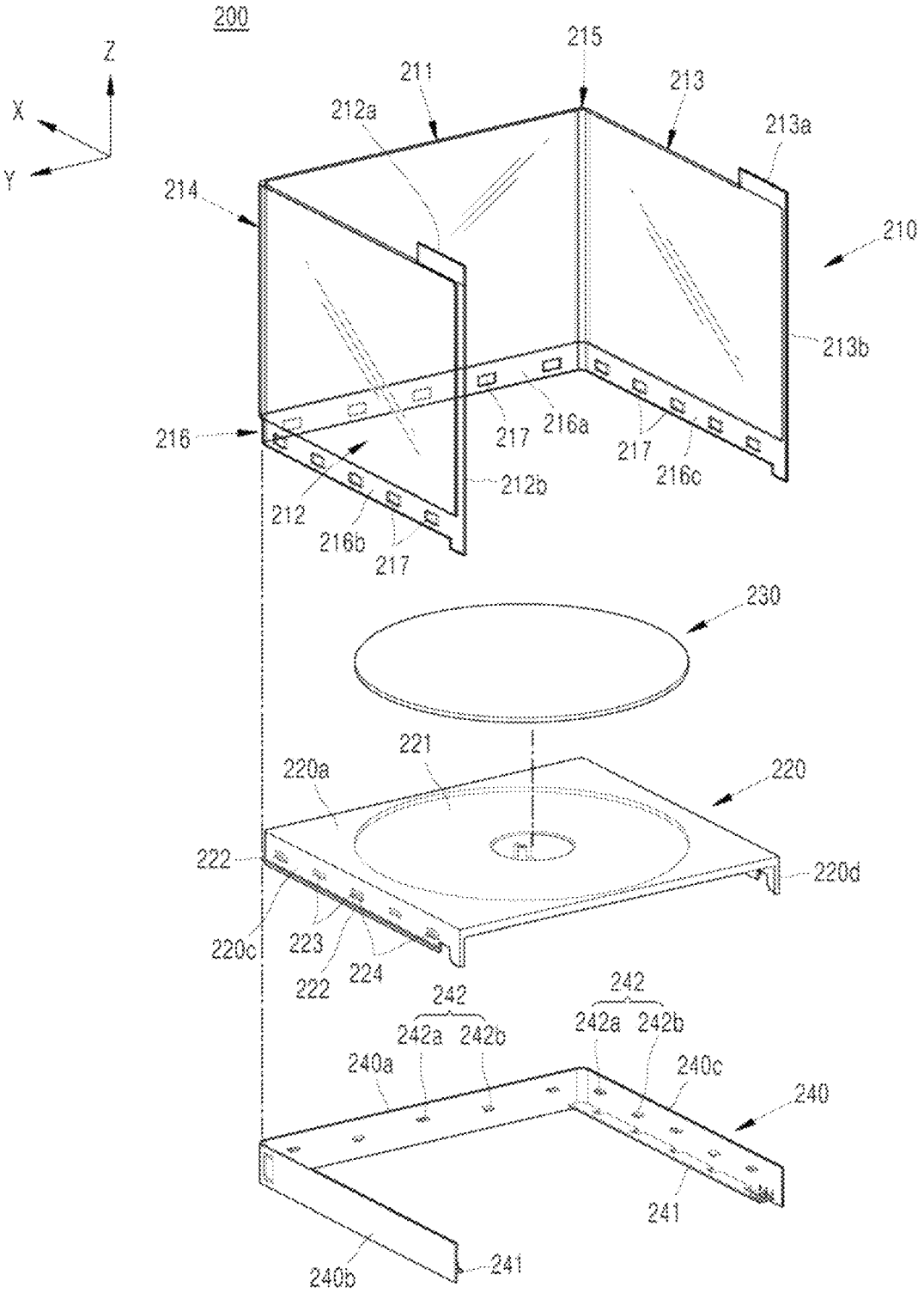
FIG. 7*a* is an exploded perspective view illustrating a moving body of the showcase according to an embodiment of the present invention.
Figure 7B:
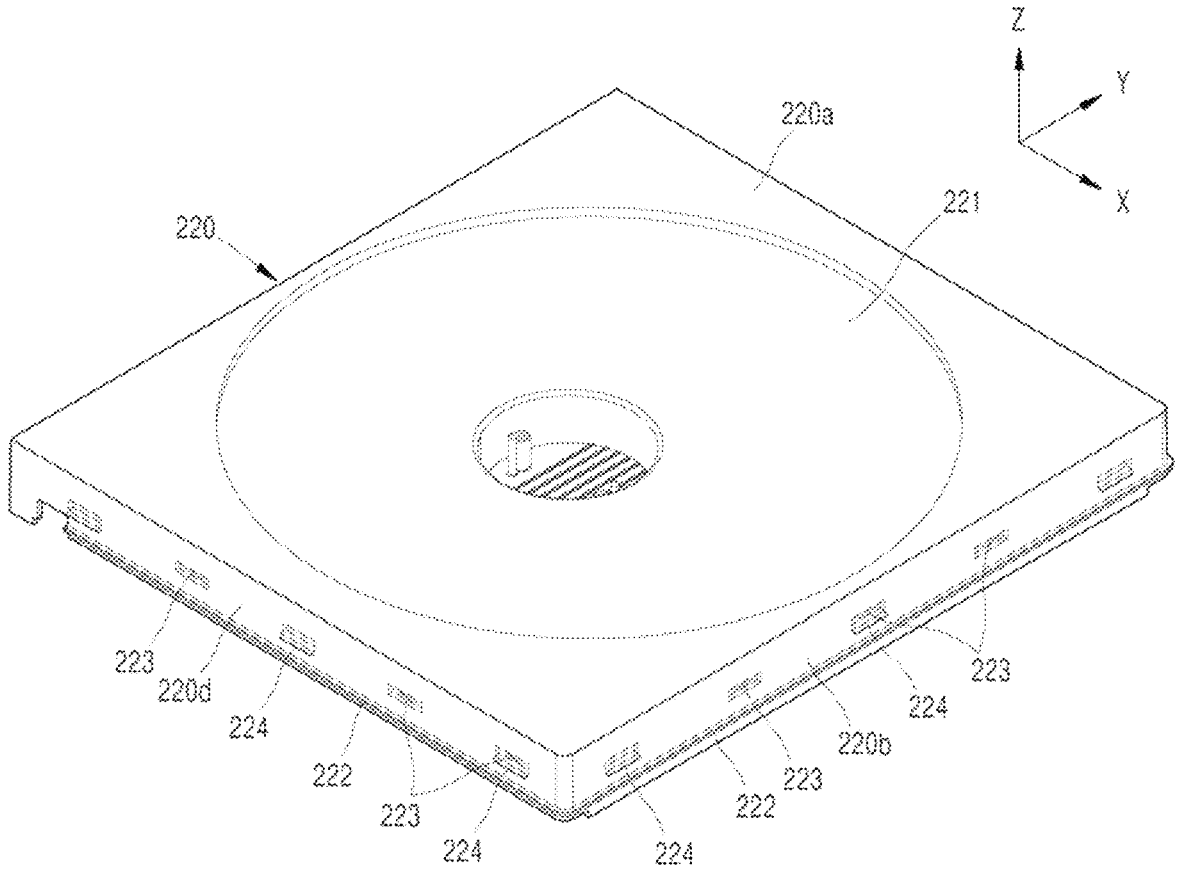
FIG. 7*b* is a perspective view illustrating a view of the base of FIG. 7*a* viewed in another direction.

FIG. 7*a* is an exploded perspective view illustrating the moving body 200 of the showcase 1 according to the embodiment of the present invention. FIG. 7*b* is a perspective view illustrating a view of the base 220 of FIG. 7*a* viewed in another direction.

The moving body 200 forms the accommodation space 10 jointly with the body 100. The moving body 200 may be movably coupled to the body 100 between a first location and a second location. The second location is a location before the first location. The moving body 200 may be coupled to the body 100 to be movable forward and backward with respect to the body 100.

When the moving body 200 is at the first location, the accommodation space 10 is closed and when the moving body 200 is at the second location, the accommodation space 10 is opened.

When the moving body 200 is at the second location, the accommodation space 10 of the showcase 1 is opened at the upper side, the left side, and the right side.

When the moving body 200 moves forward and backward with respect to the body 100, the moving body 200 may be supported by the lower body 110 and the upper body 130.

When the moving body 200 is at the first location, both left and right sides at the upper side and both left and right sides at the lower side of the moving body 200 are supported by the body 100. When the moving body 200 is at the second location, both left and right sides at the upper side and both left and right sides at the lower side of the moving body 200 may be supported by the body 100.

Each component of the moving body 200 will be additionally described below.

Figure 8A:
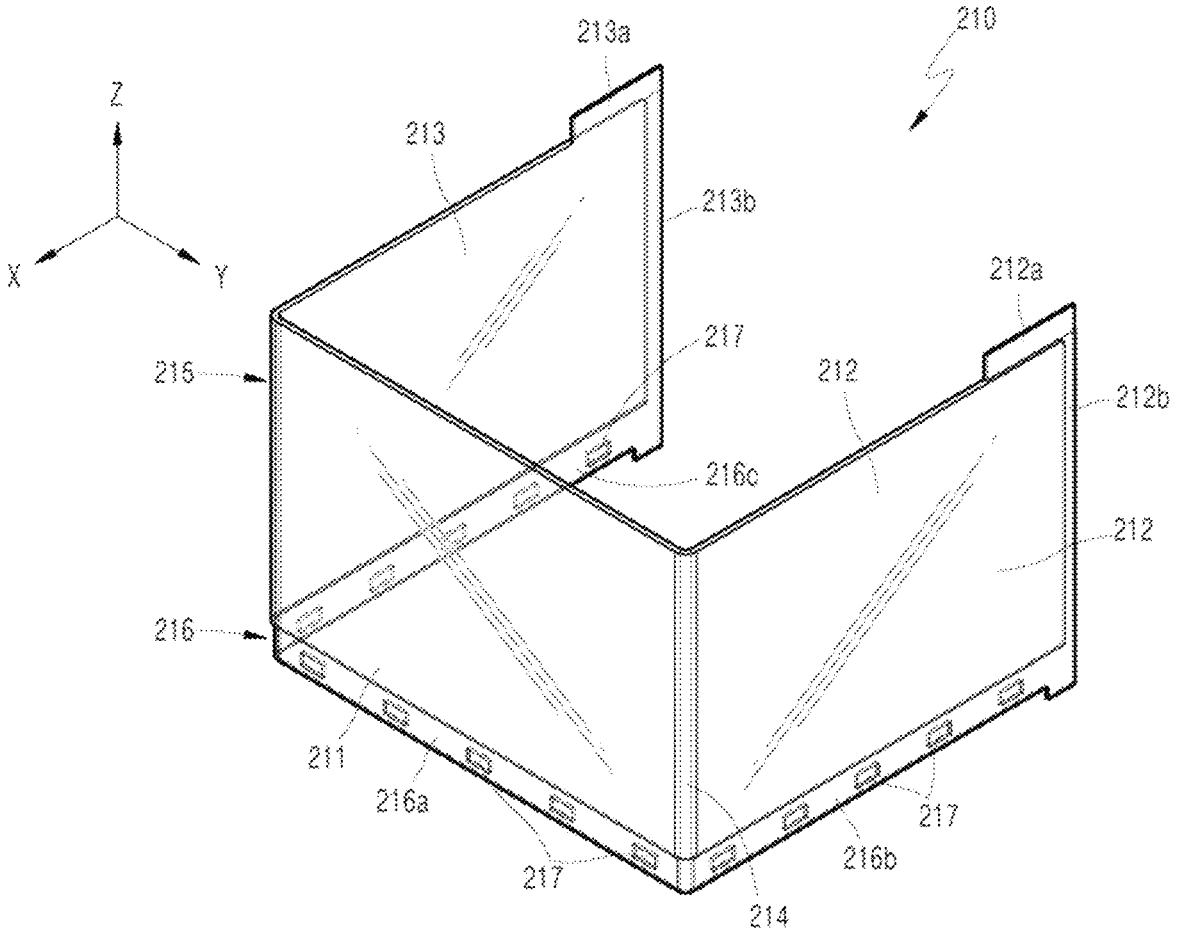
FIG. 8*a* is a perspective view illustrating a transparent window according to an embodiment of the present invention.
Figure 8B:
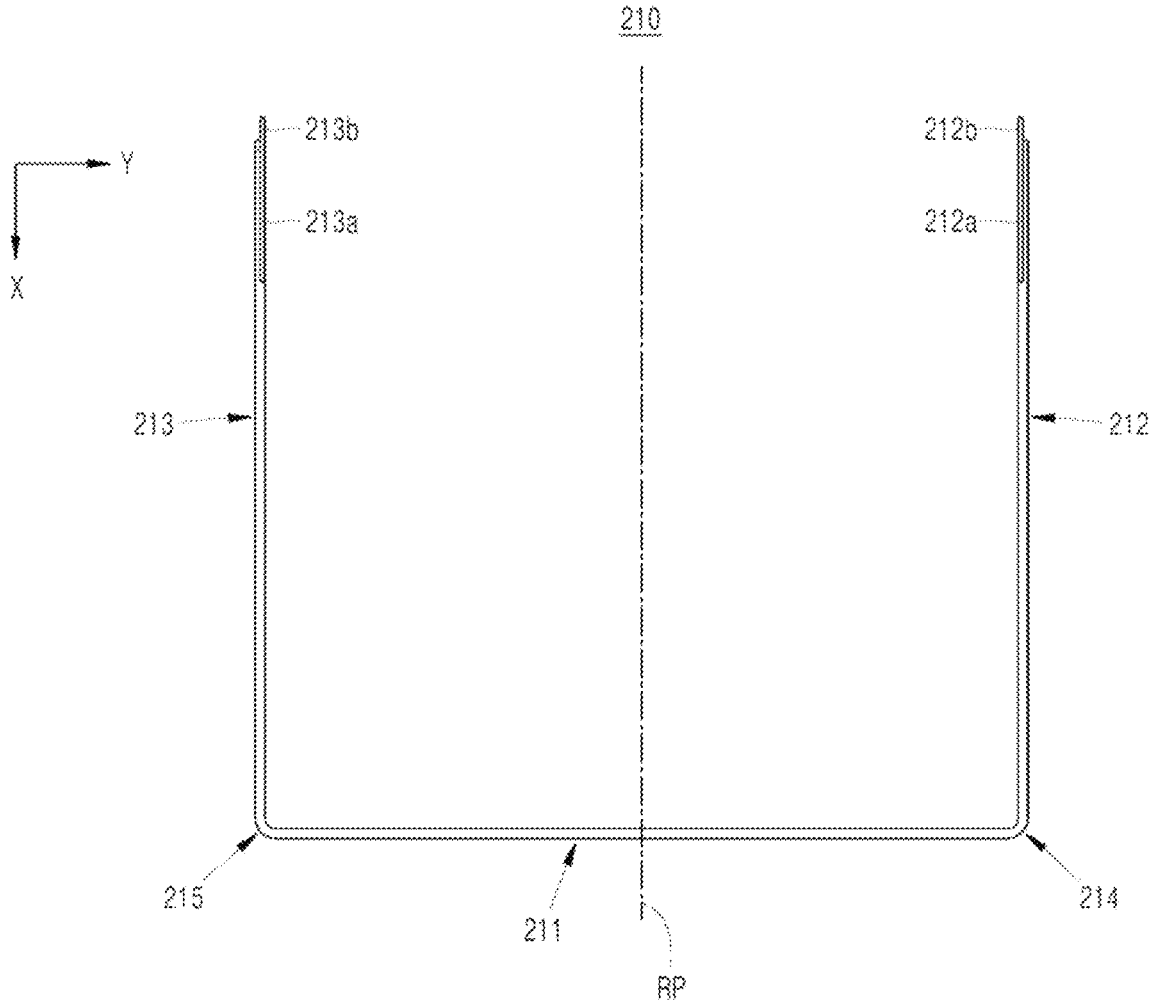
FIG. 8*b* is a plan view illustrating the transparent window of FIG. 8*a*.

FIG. 8*a* is a perspective view illustrating a transparent window 210 according to an embodiment of the present invention. FIG. 8*b* is a plan view illustrating the transparent window 210 of FIG. 8*a*.

In the embodiment of the present invention, the transparent window 210 may be integrally configured. That is, respective parts constituting the transparent window 210 is not configured to be connected or fixed to each other by a fixation means (e.g., a bracket, a clip, a bolt, an adhesive, etc.), but the transparent window 210 may be configured as one body from the time of manufacturing. All parts constituting the transparent window 210 may be made of the same material. All parts constituting the transparent window 210 may be configured to have the same made of the same physical property.

In the showcase 1 according to the embodiment of the present invention, the transparent window 210 may be formed by injection molding.

A substantial part of the transparent window 210 or all parts of the transparent window 210 may be configured to be transparent.

The transparent window 210 may be configured by a combination of plates constituting planes which are distinguished from each other. The plates constituting the transparent window 210 are connected to each other. The plates constituting the transparent window 210 are connected to each other at respective corners. A part where the plates are connected in the transparent window 210 may form a bent form, a curved surface, or a flat surface.

The transparent window 210 may be made of polymethyl methacrylate (PMMA).

The transparent window 210 includes a first window 211, a second window 212, and a third window 213. Each of the first window 211, the second window 212, and the third window 213 is configured to be transparent. Each of the first window 211, the second window 212, and the third window 213 may be configured in a flat plate form. Each of the first window 211, the second window 212, and the third window 213 may be configured in a square plate form. Vertical heights of the respective windows of the first window 211, the second window 212, and the third window 213 may be the same as or similar to each other.

The first window 211 forms the front surface of the showcase 1, the second window 212 forms the left surface of the showcase 1, and the third window 213 forms the right surface of the showcase 1. The second window 212 extends to a rear side from a left end of the first window 211, and the third window 213 extends to the rear side from a right end.

The first window 211 forms the front surface of the transparent window 210, the second window 212 forms the left surface of the transparent window 210, and the third window 213 forms the right surface of the transparent window 210. An inner surface and an outer surface of the first window 211 may form surfaces orthogonal to the first direction. The inner surface and the outer surface of the second window 212 may form surfaces orthogonal to the second direction. The inner surface and the outer surface of the third window 213 may form surfaces orthogonal to the second direction.

The inner surface of the first window 211 forms the front surface of the accommodation space 10. The inner surface of the second window 212 forms the left surface of the accommodation space 10. The inner surface of the third window 213 forms the right surface of the accommodation space 10.

The transparent window 210 includes the first window 211, the second window 212, and the third window 213, and as a result, the transparent window 210 may be configured in a substantially C shape (or ⊂ shape, Π shape, or ⊓ shape) on a plan view.

The transparent window 210 may be configured in a symmetric form around the reference plane RP. The second window 212 and the third window 213 may be configured symmetric to each other around the reference plane RP.

In the showcase 1, the upper body 130 and the first window 211 may be opened/closed to each other, the middle body 120 and the second window 212 may be opened/closed to each other, and the middle body 120 and the third window 213 may be opened/closed to each other.

The lower side of the second window 212 and the lower side of the third window 213 may be supported on the lower body 110.

The upper side of the second window 212 and the upper side of the third window 213 may be supported on the upper body 130.

In the showcase 1 according to the embodiment of the present invention, the transparent window 210 may be integrally formed. In addition, the transparent window 210 may form an area of substantial parts of the front surface, the left surface, and the right surface of the showcase 1. An area of the first window 211 may be configured to correspond to the area of the front surface of the accommodation space 10. The area of the second window 212 may be configured to correspond to the area of the left surface of the accommodation space 10. The area of the third window 213 may be configured to correspond to the area of the right surface of the accommodation space 10.

According to the embodiment of the present invention, the area of the transparent window 210 may be maximized, the shoe S accommodated in the accommodation space 10 may not be blocked, but well viewed at all of the front side, the left side, and the right side, and the display effect of the shoe may be increased.

Unlike the embodiment of the present invention, when the transparent window 210 is formed only on the front surface of the showcase 1, the shoe S may not be viewed at the left side or the right side of the showcase 1, and the display effect of the shoe may not be sufficiently shown.

Unlike the embodiment of the present invention, if the first window 211 and the second window 212 are not integrally configured (further, if the first window 211 and the third window 213 are not integrally configured), a boundary between the first window 211 and the second window 212 (further, a boundary between the first window 211 and the third window 213) is viewed to the user, and the boundary may visually block the shoe inside the accommodation space 10 and the display effect of the shoe may be reduced, and the satisfaction of the user may be lowered. Further, a gap may be generated between the boundaries, and foreign substances may be introduced into the accommodation space 10 through the gap.

The transparent window 210 includes a first curved surface portion 214 and a second curved surface portion 215. Each of the first curved surface portion 214 and the second curved surface portion 215 forms a vertical corner portion of the transparent window 210.

The first curved surface portion 214 is a portion connecting the first window 211 and the second window 212. A cross section of the first curved surface portion 214 may be constantly configured in an upper and lower direction (or third direction). The first curved surface portion 214 is configured in a curved surface structure. Each of the outer surface and the inner surface of the first curved surface portion 214 is configured in a curved surface form which is convex to the outside of the transparent window 210.

The first window 211 and the first curved surface portion 214 may be configured so that a curvature radius is continuously changed. Further, the second window 212 and the first curved surface portion 214 may be configured so that the curvature radius is continuously changed. That is, on an inner surface and an outer surface of a portion connected from the first window 211 to the first curved surface portion 214 and the second window 212, the curvature radius may not be discontinuously changed, but a bent surface may not be formed.

When the inner surfaces and the outer surfaces of the first window 211 and the second window 212 are configured by planes in the transparent window 210, and the transparent window 210 is configured to include the first curved surface portion 214, the curvature radii of the inner surface and the outer surface of the first curved surface portion 214 may be configured as 1 to 50 mm.

The transparent window 210 is configured to include the first curved surface portion 214, and as a result, the show S inside the accommodation space 10 may not be visually blocked through the first curved surface portion 214, but fully viewed to the user.

Further, the first curved surface portion 214 is configured as described above, and as a result, the shoe S inside the accommodation space 10 viewed through the first curved surface portion 214, a portion where the first curved surface portion 214 and the first window 211 are connected, and a portion where the first curved surface portion 214 and the second window 212 are connected may be prevented or minimized from being distorted.

The second curved surface portion 215 is a portion connecting the first window 211 and the third window 213. The cross section of the second curved surface portion 215 may be constantly configured in the upper and lower direction (or third direction). The second curved surface portion 215 is configured in the curved surface structure. Each of the outer surface and the inner surface of the second curved surface portion 215 is configured in the curved surface form which is convex to the outside of the transparent window 210.

The first window 211 and the second curved surface portion 215 may be configured so that the curvature radius is continuously changed. Further, the third window 213 and the second curved surface portion 215 may be configured so that the curvature radius is continuously changed. That is, on the inner surface and the outer surface of a portion connected from the first window 211 to the second curved surface portion 215 and the third window 213, the curvature radius may not be discontinuously changed, but the bent surface may not be formed.

When the inner surfaces and the outer surfaces of the first window 211 and the third window 213 are configured by the planes in the transparent window 213, and the transparent window 210 is configured to include the second curved surface portion 215, the curvature radii of the inner surface and the outer surface of the first curved surface portion 214 may be configured as 1 to 50 mm.

The transparent window 210 is configured to include the second curved surface portion 215, and as a result, the show S inside the accommodation space 10 may not be visually blocked through the second curved surface portion 215, but fully viewed to the user.

Further, the second curved surface portion 215 is configured as described above, and as a result, the shoe S inside the accommodation space 10 viewed through the second curved surface portion 215, a portion where the second curved surface portion 215 and the first window 211 are connected, and a portion where the second curved surface portion 215 and the third window 213 are connected may be prevented or minimized from being distorted.

As described above, according to an embodiment of the present invention, any gap is not formed at a connection portion of the first window 211 and the second window 212 and a connection portion of the first window 211 and the third window 213, and the aesthetics at the portions are excellent, and foreign substances such as dust can be prevented from being inserted into the accommodation space 10 through the portions. Further, the shoe S is not visually blocked, but the shoe S is viewed even through the connection portion of the first window 211 and the second window 212, and the connection portion of the first window 211 and the third window 213. Further, the air in the accommodation space 10 may be controlled, and the shoe S may be fully exposed at the front side, the left side, and the right side of the showcase 1, and both the management of the shoe and the display of the show may be effectively achieved.

Further, by the showcase 1 according to the embodiment of the present invention, even though a plurality of showcases 1 are stacked vertically or arranged horizontally, each showcase 1 may be smoothly operated, and each shoe S accommodated in each showcase 1 may be visually exposed.

The transparent window 210 integrally configured in the showcase 1 according to the embodiment of the present invention is made of polymethyl methacrylate (PMMA), and includes the first curve portion 214 and the second curve portion 215. As a result, the aesthetic of the transparent window 210 itself may be excellent, and the showcase 1 may be easily assembled. Further, discoloration of the transparent window 210 may be prevented, and a solid transparent window 210 may be formed. Further, when the shoe S accommodated in the showcase 1 is viewed to an external user through the transparent window 210, the entire shape of the shoe is not divided, but integrally viewed, and distortion is prevented.

The base 220 is fixedly coupled to the lower side of the transparent window 210 to form a lower portion of the moving body 200. An entire form of the base 220 may be configured as a flat form in the horizontal direction. The base 220 may be configured in the square form on the plan view (see FIGS. 7*a* and 7*b*).

The base 220 may be configured so that the shoe S is placed at the upper side of the base 220. An upper surface 220*a* of the base 220 may be configured substantially in the square form.

The base 220 is positioned at the upper side of the lower body 110. The upper surface 220*a* of the base 220 is positioned at the upper side of the lower body 110. The base 220 is coupled to the lower body 110 to be movable forward and backward.

The moving body 200 may be configured to include the turntable 230. The turntable 230 is rotatably coupled around a perpendicular rotational axis 231 at the upper side of the base 220. The turntable 230 is configured in a circular plate form. The upper surface of the turntable 230 may be configured to be in parallel to the first direction X and the second direction Y.

A turntable accommodation portion 221 accommodating the turntable 230 may be provided in the base 220. The table accommodation portion 221 may be configured in a concave form at the center of the upper surface 220*a* of the base 220. As a result, a height of the upper surface of the table accommodation portion 221 is configured to be a little lower than the height of the upper surface 220*a* of the base 220 except for the table accommodation portion 221. The table accommodation portion 221 may be configured in a circular shape on plan view. A shape and a size of the table accommodation portion 221 are configured to correspond to the shape and the size of the turntable 230.

While the turntable 230 is coupled to the base 220, the height of the upper surface 220*a* of the base 220 except for the table accommodation portion 221 may be configured to correspond to or coincide with the height of the upper surface of the turntable 230.

While the transparent window 210 and the base 220 move forward with respect to the body 100, the shoe may be seated on the base 220 or the show may be withdrawn from the base 220 through the space between the upper body 130 and the first window 211. Further, in this case, the user may access the shoe or an upper space through the space between the middle body 120 and the second window 212 or between the middle body 120 and the third window 213. Further, in this case, the user easily accesses the inner surface of each of the lower body 110, the middle body 120, and the upper body 130 (see FIGS. 2*a* and 2*b*).

According to the embodiment of the present invention, it is convenient to withdraw and insert the shoe from and into the showcase 1, and positioning the shoe is convenient.

As described above, the moving body 200 is configured to include the turntable 230 in the showcase 1 according to the embodiment of the present invention. Therefore, a showcase 1 may be provided in which both circulation of the air and rotation of the shoe are conducted in the accommodation space 10, and as a result, both the management of the shoe and the display effect of the shoe are excellent.

The moving body 200 may be configured to include a lower guard 240. The lower guard 240 is fixedly coupled to an outer side of a border of the base 220. The lower guard 240 is fixedly coupled to a front surface 220*b*, a left surface 220*c*, and a right surface 220*d* of the base 220 (see FIG. 7*a*).

The lower guard 240 may be configured substantially in the C shape (or C shape, II shape, or r shape) on the plan view. On the plan view, the shape of the lower guard 240 may be configured to correspond to the shape of the transparent window 210.

The lower guard 240 may be positioned outside the lower body 110.

The lower guard 240 is configured to include a first lower guard 240*a*, a second lower guard 240*b*, and a third lower guard 240*c*. The lower guard 240 may be integrally configured.

The first lower guard 240*a* forms the front surface of the lower guard 240. The outer surface and the inner surface of the first lower guard 240*a* may be configured to be orthogonal to the first direction X. The second lower guard 240*b* forms the left surface of the lower guard 240. The outer surface and the inner surface of the second lower guard 240*b* may be configured to be orthogonal to the second direction Y. The third lower guard 240*c* forms the right surface of the lower guard 240. The outer surface and the inner surface of the third lower guard 240*c* may be configured to be orthogonal to the second direction Y.

The first lower guard 240*a* may be positioned at the front side of a front end of the lower body 110. The second lower guard 240*b* may be positioned at the left side of a left end of the lower body 110. The third lower guard 240*c* may be positioned at the right side of a right end of the lower body 110.

Figure 9A:
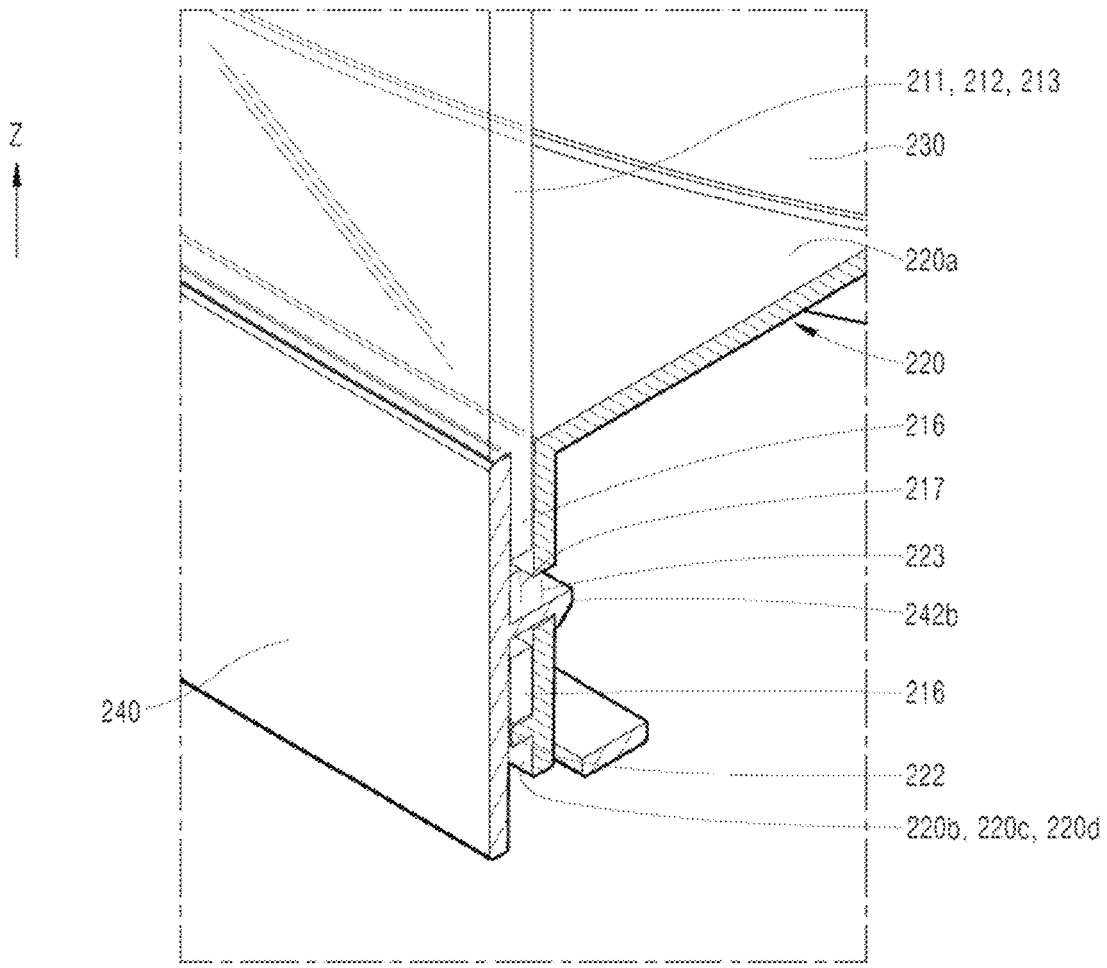
FIG. 9*a* as a cross-sectional perspective view of the moving body of the showcase according to the embodiment of the present invention is a diagram illustrating a cross section of a part where a second hook is formed.

FIG. 9*a* as a cross-sectional perspective view of the moving body 200 of the showcase 1 according to the embodiment of the present invention is a diagram illustrating a cross section of a part where a second hook 242*b* is formed.

Figure 9B:
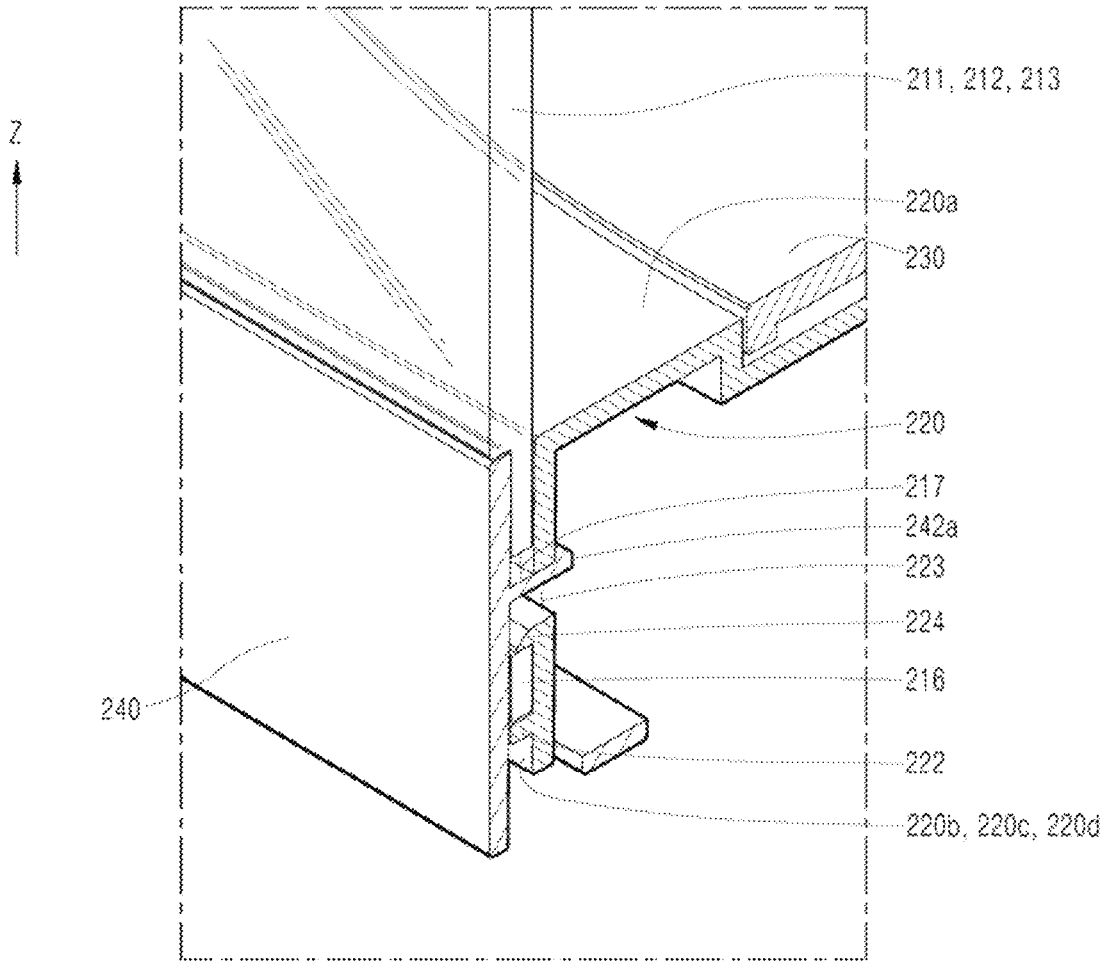
FIG. 9*b* as a cross-sectional perspective view of the moving body of the showcase according to the embodiment of the present invention is a diagram illustrating a cross section of a part where a hooking jaw is formed.

FIG. 9*b* as a cross-sectional perspective view of the moving body 200 of the showcase 1 according to the embodiment of the present invention is a diagram illustrating a cross section of a part where a hooking jaw 224 is formed.

Figure 10A:
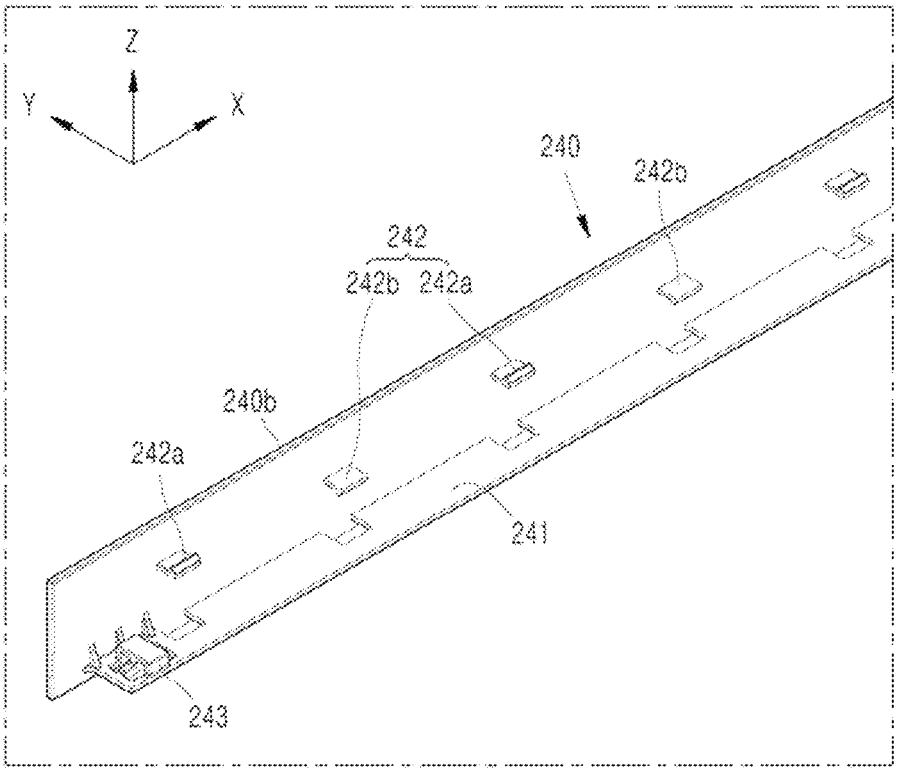
FIG. 10*a* is a perspective view illustrating a part of the lower guard of the showcase according to the embodiment of the present invention.

FIG. 10*a* is a perspective view illustrating a part of the lower guard 240 of the showcase 1 according to the embodiment of the present invention.

Figure 10B:
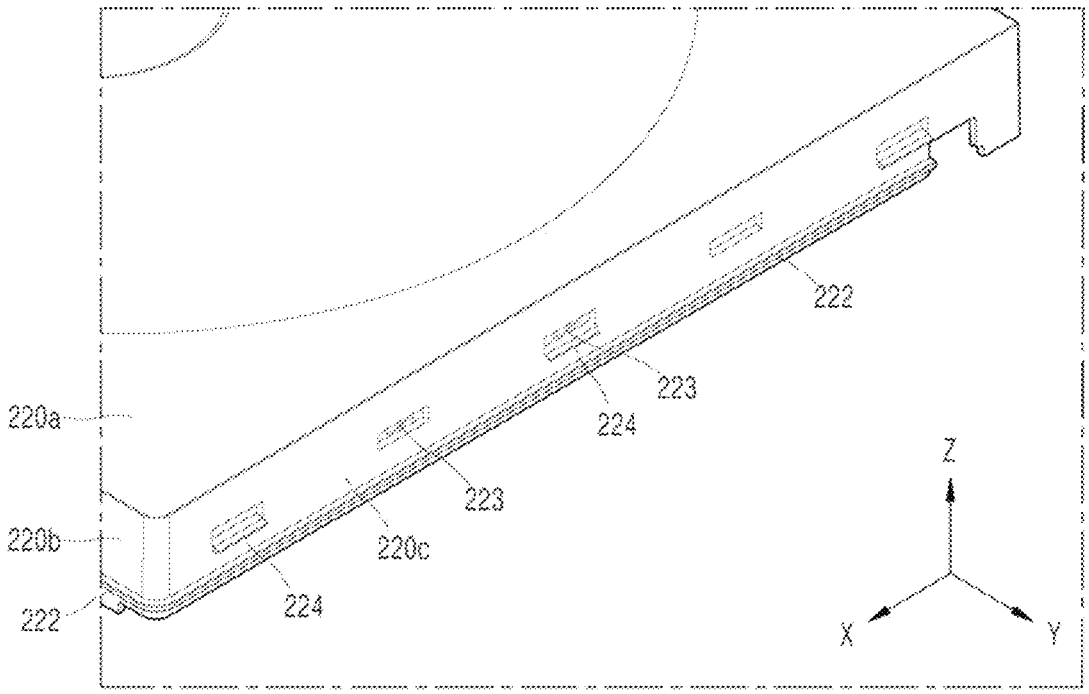
FIG. 10*b* is a perspective view illustrating a part of the base of the showcase according to the embodiment of the present invention.

FIG. 10*b* is a perspective view illustrating a part of the base 220 of the showcase 1 according to the embodiment of the present invention.

In the showcase 1 according to the embodiment of the present invention, the lower side of the transparent window 210 may be fixedly interposed between the base 220 and the lower guard 240.

The transparent window 210 may be configured to include a concealment portion 216.

The concealment portion 216 extends to the lower side from the first window 211, the second window 212, and the third window 213. The concealment portion 216 may be divided into a first concealment portion 216*a*, a second concealment portion 216*b*, and a third concealment portion 216*c*. The first concealment portion 216*a* extends to the lower side from a lower end of the first window 211. The second concealment portion 216*b* extends to the lower side from the lower end of the second window 212. The third concealment portion 216*c* extends to the lower side from the lower end of the third window 213.

The front surface 220*b*, the left surface 220*c*, and the right surface 220*d* of the base 220 are in close contact with the inner surface of the concealment portion 216.

The inner surface of the lower guard 240 is in close contact with the outer surface of the concealment portion 216, and fixed to the base 220.

The transparent window 210 may be configured to include a plurality of first through holes 217.

The first through hole 217 is configured in a hole form penetrating the transparent window 210 at the lower side of each of the first window 211, the second window 212, and the third window 213.

The first through hole 217 may be arranged in the horizontal direction. The first through hole 217 formed at the lower side of the first window 211 is arranged in the second direction Y. The first through hole 217 formed at the lower side of the second window 212 is arranged in the first direction X, and the first through hole 217 formed at the lower side of the third window 213 is also arranged in the first direction X.

The first through hole 217 may be formed in the concealment portion 216. That is, the first through hole 217 may be configured in the hole form penetrating the concealment portion 216. The first through hole 217 may be formed in each of the first concealment portion 216*a*, the second concealment portion 216*b*, and the third concealment portion 216*c*.

The base 220 may be configured to include a plurality of second through holes 223. The second through hole 223 is formed on each of the front surface 220*b*, the left surface 220*c*, and the right surface 220*d* of the base 220.

The second through hole 223 formed on the front surface 220*b* of the base 220 is arranged in the second direction Y. The second through hole 223 formed on the left surface 220*c* of the base 220 is arranged in the first direction X, and the second through hole 223 formed on the right surface 220*d* of the base 220 is also arranged in the first direction X.

The second through-hole 223 may be formed at a location corresponding to the first though hole 217.

The lower guard 240 may be configured to include a plurality of hooks 242. The hook 242 protrudes inward on the inner surface of the lower guard 240. The hook 242 protrudes in an inner direction on the inner surface of each of the first lower guard 240*a*, the second lower guard 240*b*, and the third lower guard 240*c*.

The hook 242 is configured to be inserted and hooked into the second through hole 223 by passing through the first through hole 217.

The hook 242 may be configured to include a first hook 242*a* and a second hook 242*b*. A hooking location of the first hook 242*a* and a hooking location of the second hook 242*b* may be configured to be opposite to each other. For example, when the first hook 242*a* is hooked to the upper side of the second through hole 223, the second hook 242*b* may be hooked to the lower side of the second through hole 223. Alternatively, when the first hook 242*a* is hooked to the lower side of the second through hole 223, the second hook 242*b* may be hooked to the upper side of the second through hole 223 (see FIGS. 9*a* and 9*b*).

The first hook 242*a* and the second hook 242*b* may be arranged repeatedly with each other in the horizontal direction.

A seating rib 222 supporting the lower end of the transparent window 210 may be formed in the base 220. The seating rib 222 may protrude outward on the border of the base 220. The seating rib 222 may protrude outward on the front surface 220*b*, the left surface 220*c*, and the right surface 220*d* of the base 220.

The hooking jaw 224 may be formed in the base 220. The hooking jaw 224 protrudes outward on a lower border of the entire or a partial second through hole 223. The hooking jaw 224 formed on the front surface 220*b* of the base 220 protrudes to the front side, the hooking jaw 224 formed on the left surface 220*c* of the base 220 protrudes to the left side, and the hooking jaw 224 formed on the right surface 220*d* of the base 220 protrudes to the right side.

While the base 220 and the transparent window 210 are assembled, the lower end of the transparent window 210 (the lower end of the concealment portion 216) is seated on the upper surface of the seating rib 222, and the hooking jaw 224 of the base 220 is inserted into the first through hole 217 and hooked to the lower side of the first through hole 217. In this case, the hook 242 (in particular, the first hook 242*a*) is positioned at the upper side of the hooking jaw 224. As a result, the base 220 and the transparent window 210 may be more stably coupled (see FIG. 9*b*).

As described above, in the showcase 1 according to the embodiment of the present invention, the base 220 forms a bottom part of the moving body 200. The front surface 220*b*, the left surface 220*c*, and the right surface 220*d* of the base 220 are in close contact with the inner surface of the concealment portion 216 of the transparent window 210, the inner surface of the lower guard 240 is in close contact with the outer surface of the concealment portion 216, and the lower guard 240 is fixed to the base 220.

The lower side of the transparent window 210 is fixed by the base 220 and the lower guard 240 to form a rigid coupling structure of the moving body 200. Further, an area of a transparent part (transparent window 210) in the moving body 200 may be maximally secured.

As described above, the hook 242 of the lower guard 240 is configured to be inserted and hooked into the second through hole 223 of the base 220 by passing through the first through hole 217 of the transparent window 210. In addition, a hooking location of the first hook 242*a* and a hooking location of the second hook 242*b* may be configured to be opposite to each other. As a result, while the coupling portion (concealment portion 216) of the transparent window 210 is not externally visually exposed, the transparent window 210, the base 220, and the lower guard 240 may be stably coupled.

The outer surface of the concealment portion 216 is stepped to be dented on the outer surfaces of the first window 211, the second window 212, and the third window 213. The outer surface of the first concealment portion 216*a* may be configured to be dented inward on the outer surface of the first window 211, the outer surface of the second concealment portion 216*b* may be configured to be dented inward on the outer surface of the second window 212, and the outer surface of the third concealment portion 216*c* may be configured to be dented inward on the outer surface of the third window 213.

The inner surface of the first concealment portion 216*a* may form the same plane as the inner surface of the first window 211, the inner surface of the second concealment portion 216*b* may form the same plane as the inner surface of the second window 212, and inner surface of the third concealment portion 216*c* may form the same plane as the inner surface of the third window 213.

While the concealment portion 216 of the transparent window 210 and the lower guard 240 are coupled, a total thickness of the concealment portion 216 and the lower guard 240 may be configured to correspond to a thickness of each of the first window 211, the second window 212, and the third window 213. The total thickness of the first concealment portion 216*a* and the first lower guard 240 may be configured to correspond to the thickness of the first window 211. The total thickness of the second concealment portion 216*b* and the second lower guard 240*b* may be configured to correspond to the thickness of the second window 212. The total thickness of the third concealment portion 216*c* and the third lower guard 240*c* may be configured to correspond to the thickness of the third window 213 (see FIGS. 9*a* and 9*b*).

A height of an upper end of the concealment portion 216, a height of the upper end of the lower guard 240, and a height of the upper end of the base 220 may be configured to correspond to each other (see FIGS. 9*a* and 9*b*).

As configured as above, a showcase 1 may be provided in which the transparent window 210, the base 220, and the lower guard 240 are stably coupled at the lower side of the moving body 200, the aesthetics of the moving body 200 may be enhanced.

Figure 11A:
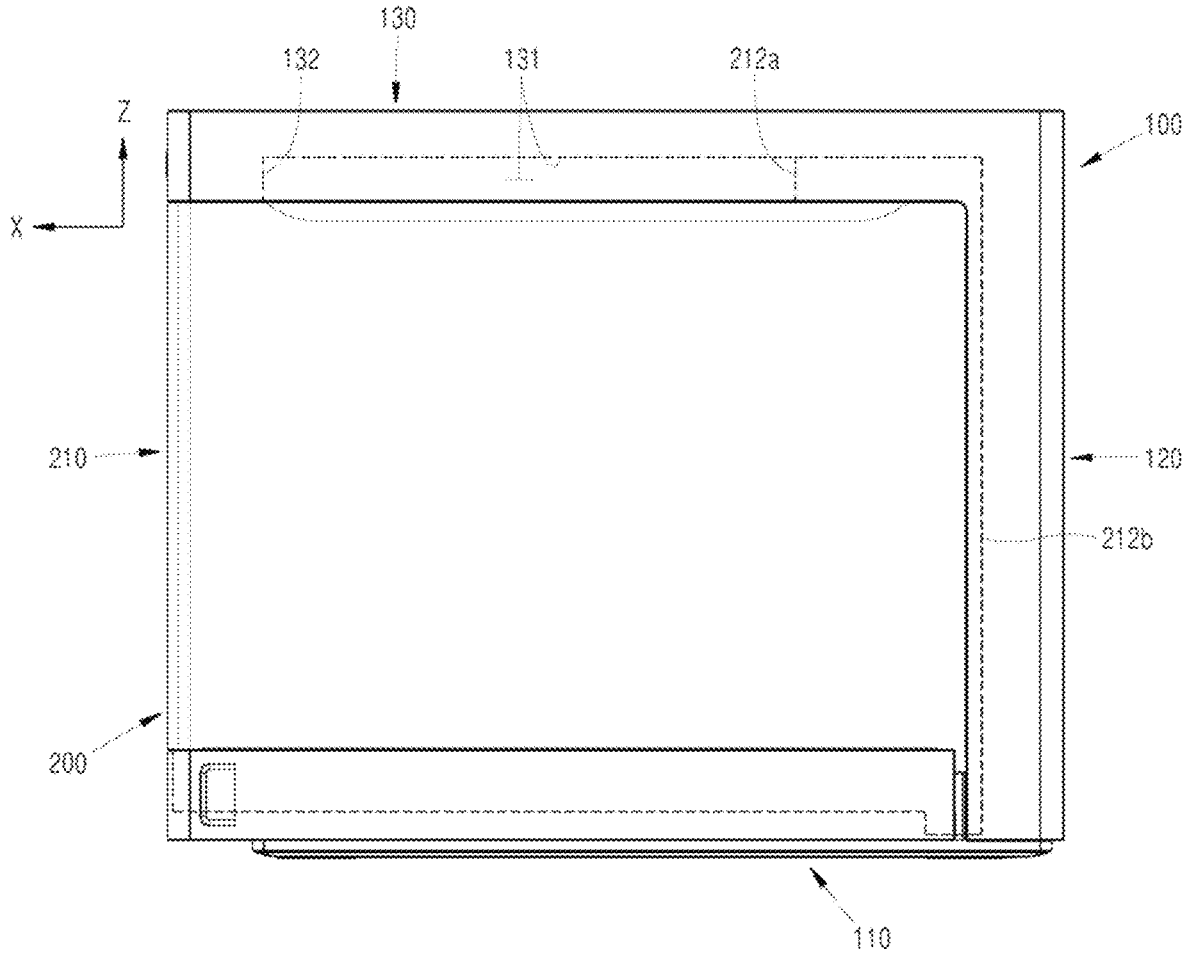
FIG. 11*a* is a side view illustrating a closed state of the showcase according to the embodiment of the present invention.

FIG. 11*a* is a side view illustrating a closed state of the showcase 1 according to the embodiment of the present invention.

Figure 11B:
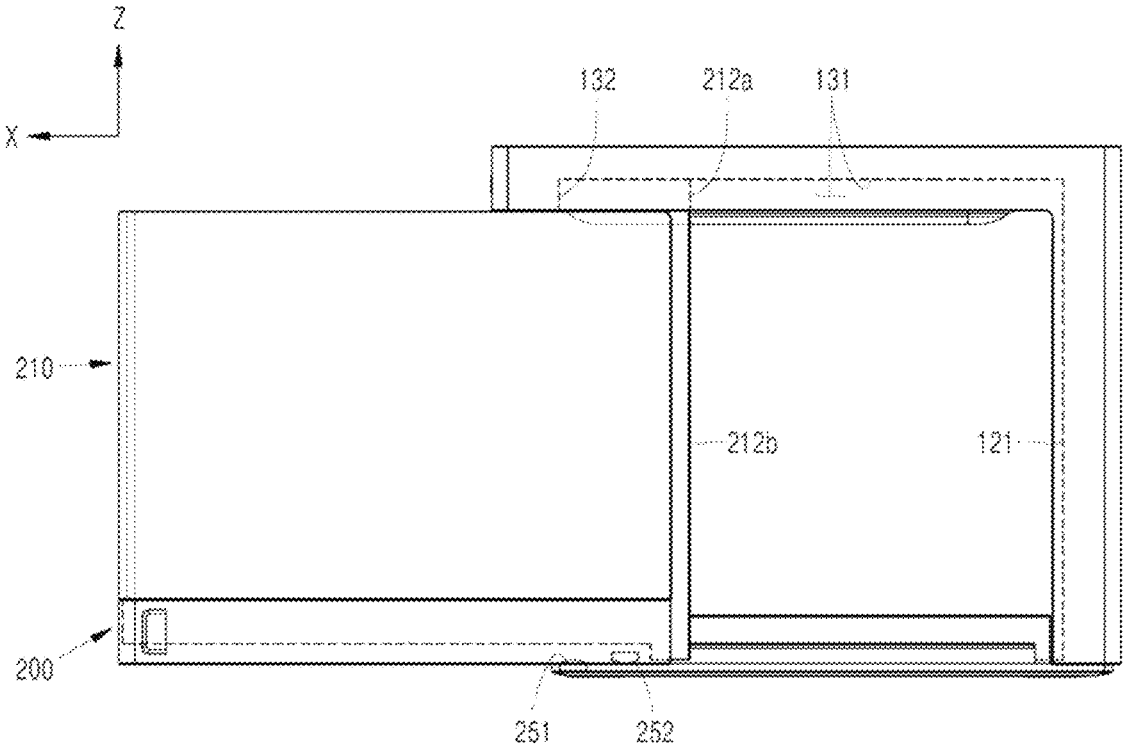
FIG. 11*b* is a side view illustrating an opened state of the showcase according to the embodiment of the present invention.

FIG. 11*b* is a side view illustrating an opened state of the showcase 1 according to the embodiment of the present invention.

The transparent window 210 may be configured to include a first fin portion 212*a* and a second fin portion 213*a* (see FIG. 8*a*).

The first fin portion 212*a* extends to the upper side from the rear side of the second window 212. The first fin portion 212*a* is configured to protrude upward on a rear upper end of the second window 212.

The first fin portion 212*a* is configured in a flat plate form. The first fin portion 212*a* configured integrally with the second window 212 may be configured to be transparent.

The inner surface of the first fin portion 212*a* may form the same plane as the inner surface of the second window 212. The outer surface of the first fin portion 212*a* may form the same plane as the inner surface of the second window 212.

The inner surface of the first fin portion 212*a* may be configured to be stepped with the inner surface of the second window 212. The outer surface of the first fin portion 212*a* may be configured to be stepped with the inner surface of the second window 212.

The second fin portion 213*a* extends upward on the rear side of the third window 213. The second fin portion 213*a* is configured to protrude upward on the rear upper end of the third window 213.

The second fin portion 213*a* is configured in the flat plate form. The second fin portion 213*a* configured integrally with the third window 213 may be configured to be transparent.

The inner surface of the second fin portion 213*a* may form the same plane as the inner surface of the third window 213. The inner surface of the second fin portion 213*a* may form the same plane as the inner surface of the third window 213.

The inner surface of the second fin portion 213*a* may be configured to be stepped with the inner surface of the third window 213. The outer surface of the second fin portion 213*a* may be configured to be stepped with the inner surface of the third window 213.

The upper body 130 may be configured to include a first insertion groove 131, a first stopper 132, a second insertion groove 133, and a second stopper 134 (see FIGS. 4*a* and 5*b*).

The first insertion groove 131 is configured in a narrow gap or slit form so that the first fin portion 212*a* is inserted and moves. The first insertion groove 131 is formed on the bottom of the upper body 130 in the first direction.

The first stopper 132 is configured to be provided in front of the first insertion groove 131 to prevent forward movement of the first fin portion 212*a*. When the moving body 200 is at the second location, the front end of the first fin portion 212*a* touches the rear end of the first stopper 132.

The second insertion groove 133 is configured in the narrow gap or slit form so that the second fin portion 213*a* is inserted and moves. The second insertion groove 133 is formed on the bottom of the upper body 130 in the first direction.

The second stopper 134 is configured to be provided in front of the second insertion groove 133 to prevent forward movement of the second fin portion 213*a*. When the moving body 200 is at the second location, the front end of the second fin portion 213*a* touches the rear end of the second stopper 134.

As configured as described above, when the moving body 200 moves between the first location and the second location with respect to the body 100, the first fin portion 212*a* may slidably move stably forward and backward along the first insertion groove 131, and the second fin portion 213*a* may slidably move stably forward and backward along the second insertion groove 133.

In addition, when the moving body 200 is at the second location, the first fin portion 212*a* is prevented from forward movement while being inserted into the first insertion groove 131 by the first stopper 132, and the second fin portion 213*a* is prevented from forward movement while being inserted into the second insertion groove 133 by the second stopper 134, and the upper side of the moving body 200 is stably supported by the body 100.

As described above, in the showcase 1 according to the embodiment of the present invention, at the first location and the second location, the lower side of the transparent window 210 is supported on the lower body 110 of the body 100 through the base 220 and the lower guard 240. In addition, when the moving body 200 is at the second location, both the left and right sides at the upper side and both the left and right sides at the lower side of the moving body 200 are supported by the body 100. Therefore, in the state in which the moving body 200 moves forward with respect to the body 100 as possible, the accommodation space 10 may be opened at the upper side, the left side, and the right side, and the shoe may be inserted into the accommodation space 10 or the shoe may be withdrawn from the accommodation space 10, and in this case, the upper side and the lower side of each of the second window 212 and the third window 213 are supported by the body 100, and stable coupling between the body 100 and the moving body 200 is maintained.

The transparent window 210 may be configured to include a third fin portion 212*b* and a fourth fin portion 213*b* (see FIG. 8*a*).

The third fin portion 212*b* extends backward on the rear end of the second window 212.

The third fin portion 212*b* is configured to protrude backward on the rear end of the second window 212.

The third fin portion 212*b* is configured in the flat plate form. The third fin portion 212*b* configured integrally with the second window 212 may be configured to be transparent.

The inner surface of the third fin portion 212*b* may form the same plane as the inner surface of the second window 212. The outer surface of the third fin portion 212*b* may form the same plane as the inner surface of the second window 212.

The inner surface of the third fin portion 212*b* may be configured to be stepped with the inner surface of the second window 212. The outer surface of the third fin portion 212*b* may be configured to be stepped with the inner surface of the second window 212.

The inner surface of the third fin portion 212*b* may form the same plane as the inner surface of the first fin portion 212*a* and the outer surface of the third fin portion 212*b* may form the same plane as the outer surface of the first fin portion 212*a*.

A thickness of the third fin portion 212*b* may be configured to be the same as the thickness of the first fin portion 212*a*. Each of the thickness of the first fin portion 212*a* and the thickness of the third fin portion 212*b* may be configured to be thinner than the thickness of the second window 212.

The fourth fin portion 213*b* extends backward on the rear end of the third window 213.

The fourth fin portion 213*b* is configured to protrude backward on the rear end of the third window 213.

The fourth fin portion 213*b* is configured in the flat plate form. The fourth fin portion 213*b* configured integrally with the third window 213 may be configured to be transparent.

The inner surface of the fourth fin portion 213*b* may form the same plane as the inner surface of the third window 213. The outer surface of the fourth fin portion 213*b* may form the same plane as the inner surface of the third window 213.

The inner surface of the fourth fin portion 213*b* may be configured to be stepped with the inner surface of the third window 213. The outer surface of the fourth fin portion 213*b* may be configured to be stepped with the inner surface of the third window 213.

The inner surface of the fourth fin portion 212*b* may form the same plane as the inner surface of the second fin portion 213*a* and the outer surface of the fourth fin portion 213*b* may form the same plane as the outer surface of the second fin portion 213*a*.

The thickness of the fourth fin portion 213*b* may be configured to be the same as the thickness of the second fin portion 213*a*. Each of the thickness of the second fin portion 213*a* and the thickness of the fourth fin portion 213*b* may be configured to be thinner than the thickness of the third window 213.

The middle body 120 may be configured to include a third insertion groove 121 and a fourth insertion groove 122. The third insertion groove 121 is configured in the narrow gap or slit form so that the third fin portion 212*b* is inserted. The third insertion groove 121 is formed on the front surface of the middle body 120 in the third direction. The fourth insertion groove 122 is configured in the narrow gap or slit form so that the fourth fin portion 213*b* is inserted. The fourth insertion groove 122 is formed on the front surface of the middle body 120 in the third direction (see FIGS. 5*b* and 6).

As configured as described above, when the moving body 200 is at the first location, the third fin portion 212*b* is inserted into the third insertion groove 121 and the fourth fin portion 213*b* is inserted into the fourth insertion groove 122, and the moving body 200 and the body 100 are stably coupled, and the accommodation space 10 is effectively sealed.

Figure 12:
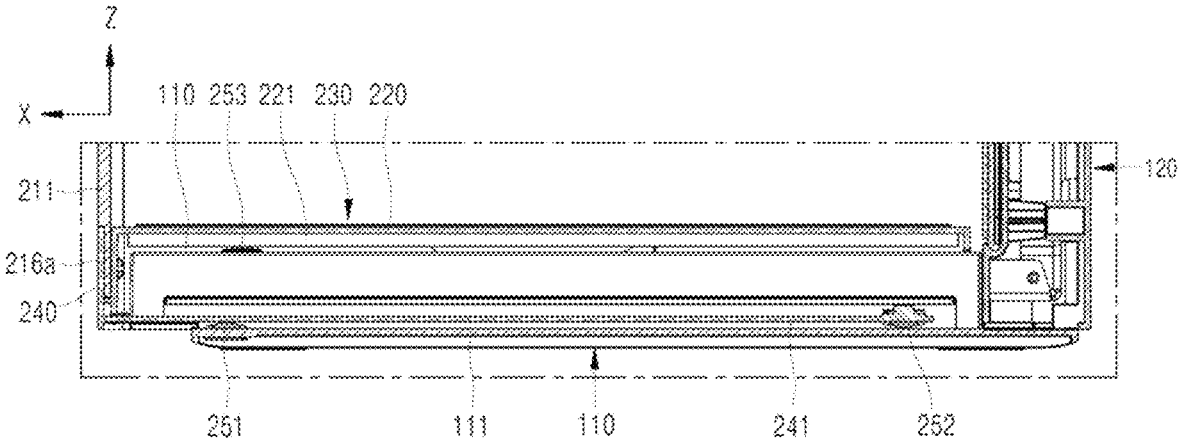
FIG. 12 is a cross-sectional view illustrating a lower side of the showcase according to the embodiment of the present invention.

FIG. 12 is a cross-sectional view illustrating the lower side of the showcase 1 according to the embodiment of the present invention.

Figure 13A:
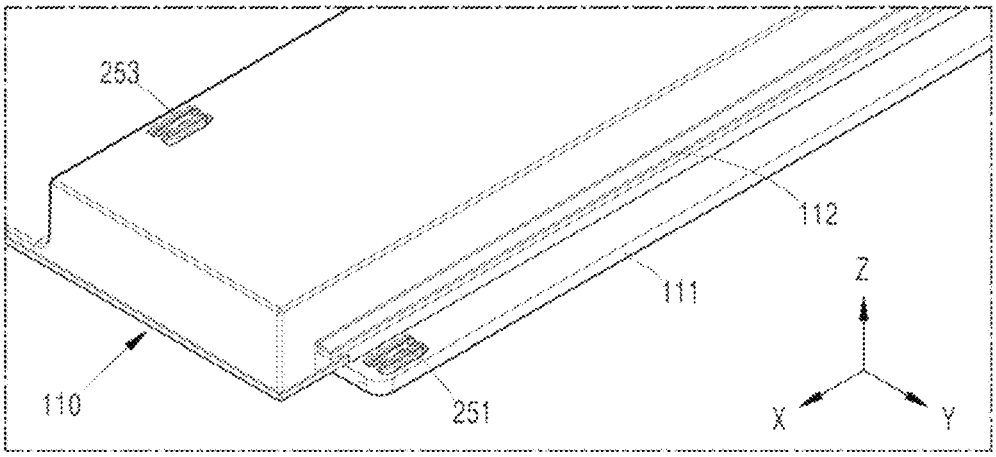
FIG. 13*a* is a perspective view illustrating a left front portion of the body according to the embodiment of the present invention and FIG. 13*b* is a perspective view illustrating a right front portion of the body according to the embodiment of the present invention.
Figure 13B:
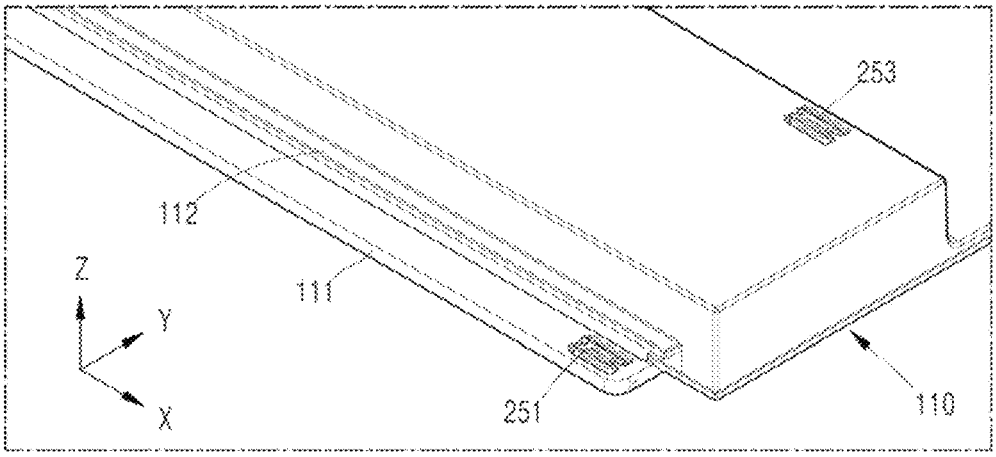

FIG. 13*a* is a perspective view illustrating a left front portion of the body 100 according to the embodiment of the present invention and FIG. 13*b* is a perspective view illustrating a right front portion of the body 100 according to the embodiment of the present invention.

Figure 14A:
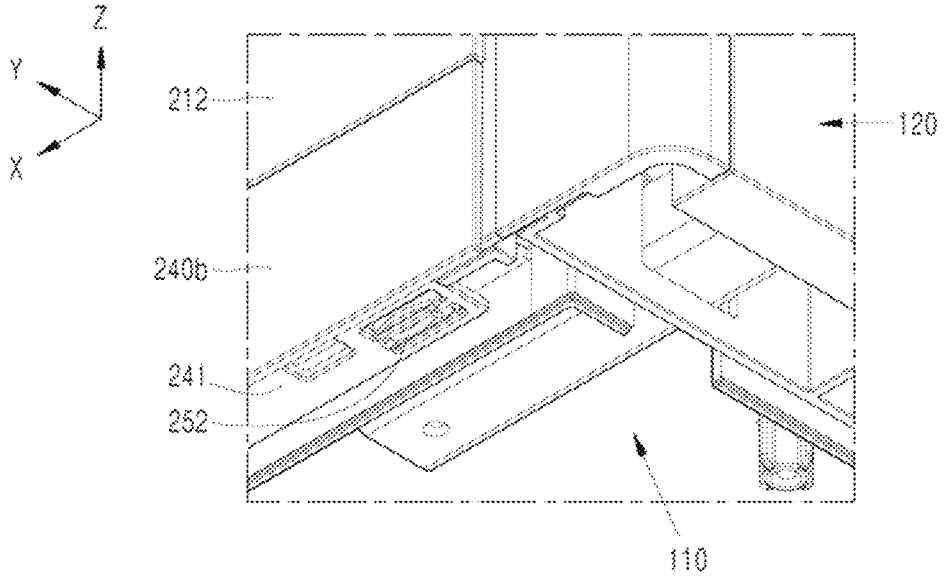
FIG. 14*a* is a bottom perspective view illustrating a left rear portion of the showcase according to the embodiment of the present invention and FIG. 14*b* is a bottom perspective view illustrating a right rear portion of the showcase according to the embodiment of the present invention.
Figure 14B:
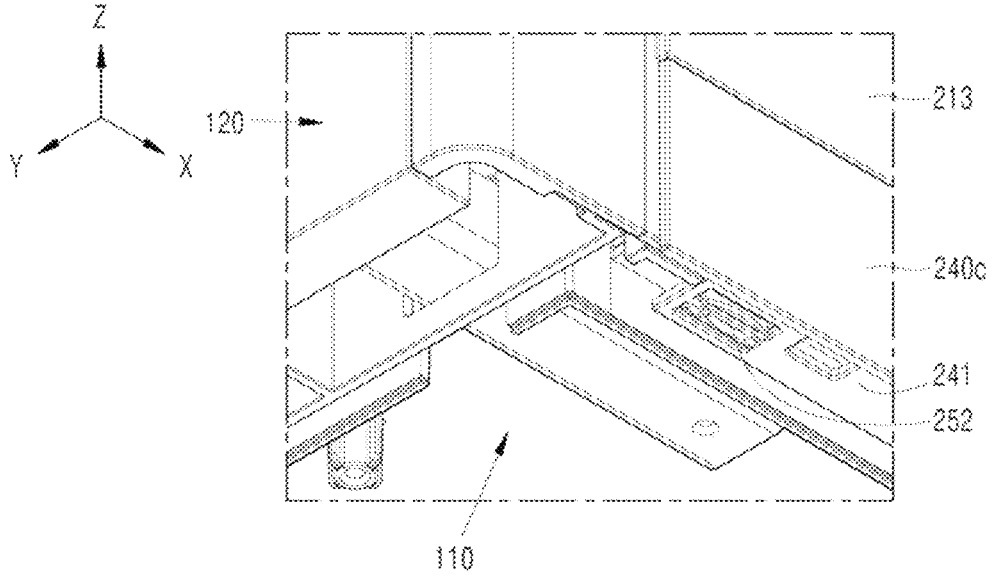

FIG. 14*a* is a bottom perspective view illustrating a left rear portion of the showcase 1 according to the embodiment of the present invention and FIG. 14*b* is a bottom perspective view illustrating a right rear portion of the showcase 1 according to the embodiment of the present invention. In FIGS. 14*a* and 14*b*, a state in which the bottom of the lower body 110 is removed is illustrated so that an internal view of the lower body 110 of the body is shown.

Figure 15:
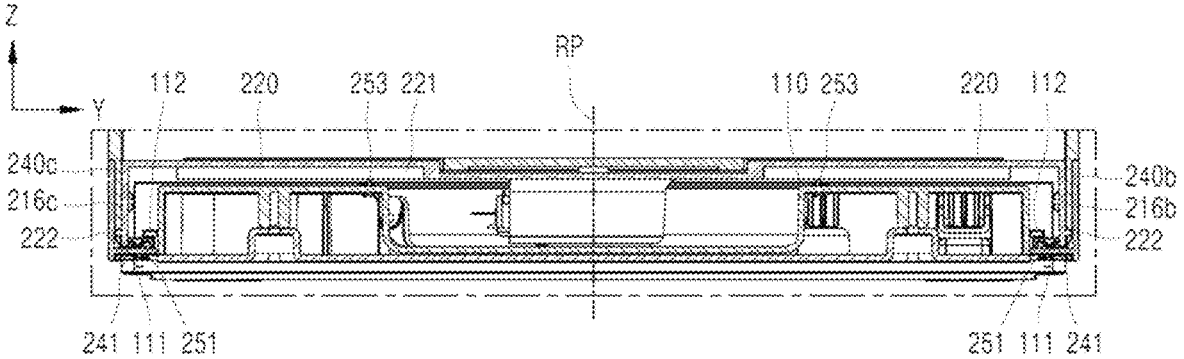
FIG. 15 is a cross-sectional view illustrating the lower side of the showcase according to the embodiment of the present invention.

FIG. 15 is a cross-sectional view illustrating the lower side of the showcase 1 according to the embodiment of the present invention.

Figure 16A:
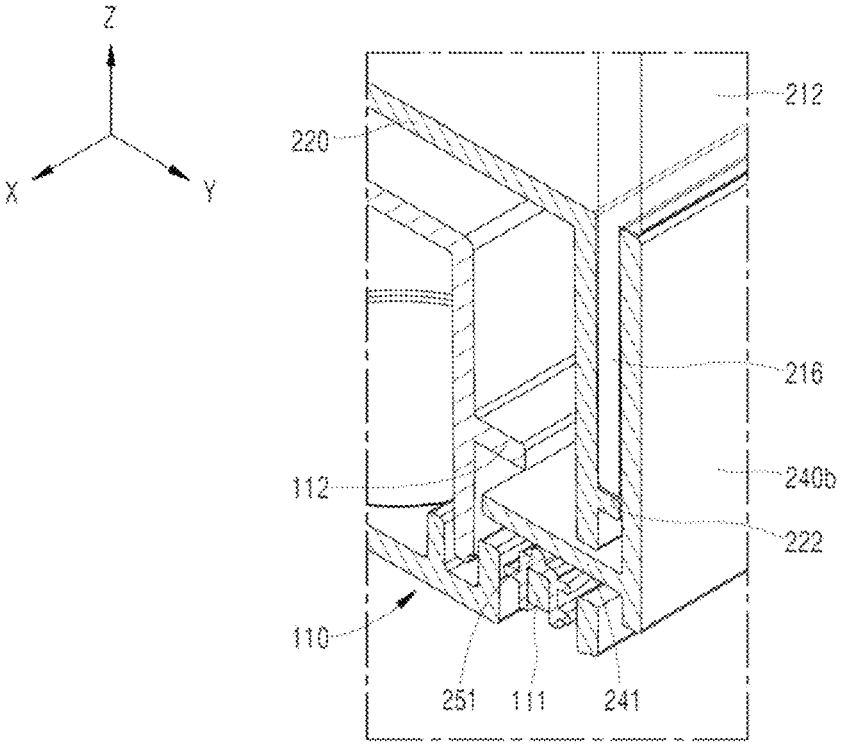
FIG. 16*a* as a cross-sectional perspective view of the showcase according to the embodiment of the present invention is a diagram illustrating a cross section of a portion where a left first slider is formed.

FIG. 16*a* as a cross-sectional perspective view of the showcase 1 according to the embodiment of the present invention is a diagram illustrating a cross section of a portion where a left first slider 251 is formed.

Figure 16B:
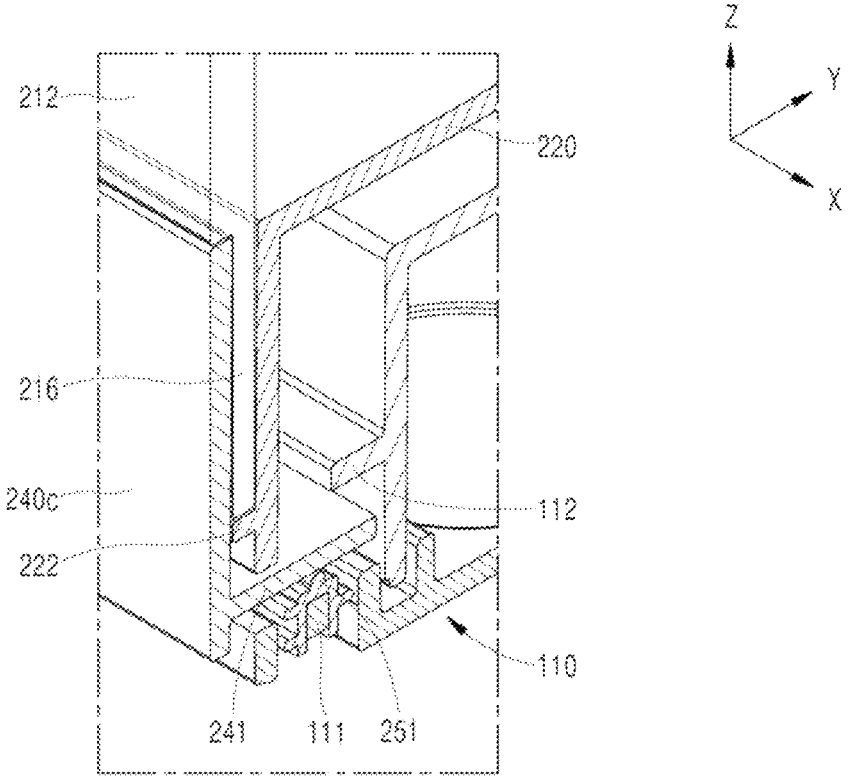
FIG. 16*b* as a cross-sectional perspective view of the showcase according to the embodiment of the present invention is a diagram illustrating a cross section of a portion where a right first slider is formed.

FIG. 16*b* as a cross-sectional perspective view of the showcase 1 according to the embodiment of the present invention is a diagram illustrating a cross section of a portion where a right first slider 251 is formed.

Figure 17A:
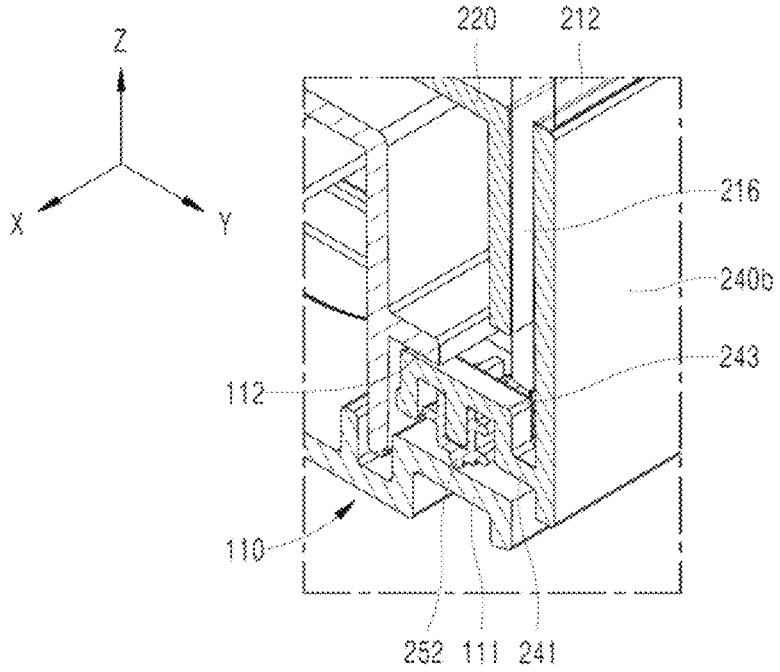
FIG. 17*a* as a cross-sectional perspective view of the showcase according to the embodiment of the present invention is a diagram illustrating a cross section of a portion where a left second slider is formed.

FIG. 17*a* as a cross-sectional perspective view of the showcase 1 according to the embodiment of the present invention is a diagram illustrating a cross section of a portion where a left second slider 252 is formed.

Figure 17B:
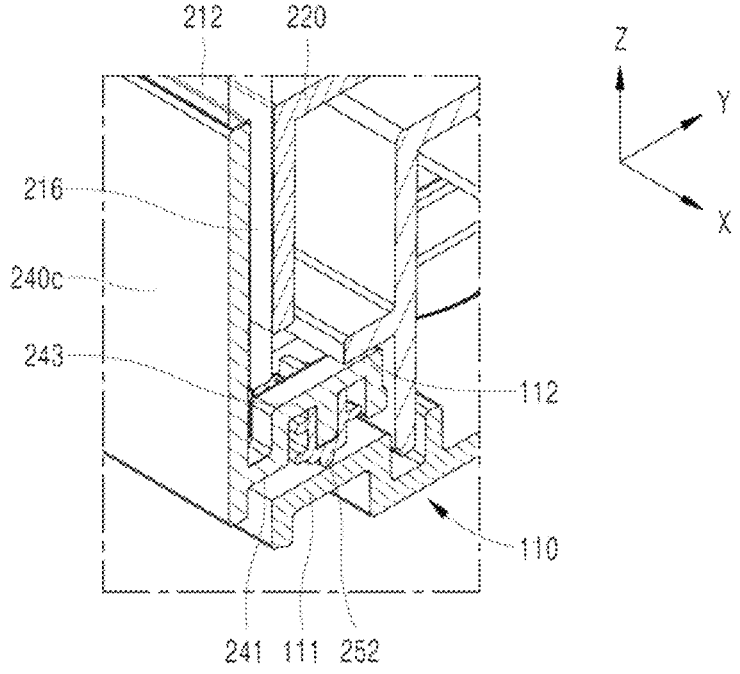
FIG. 17*b* as a cross-sectional perspective view of the showcase according to the embodiment of the present invention is a diagram illustrating a cross section of a portion where a right second slider is formed.

FIG. 17*b* as a cross-sectional perspective view of the showcase 1 according to the embodiment of the present invention is a diagram illustrating a cross section of a portion where a right second slider 252 is formed.

The showcase 1 according to the embodiment of the present invention includes one or more sliders. The slider may be divided into a first slider 251, a second slider 252, and a third slider 253. Each slider may be made of lubricant engineering plastic. Each slider may be made of polyacetal (POM). Each slider may prevent or reduce a friction which may be generated when the moving body 200 moves with respect to the body 100, and support a load of the moving body 200. A showcase 1 may be provided, which includes the slider to simplify the structure of the slider itself and an assembly structure of the slider.

The lower body 110 is positioned at the lower side of the base 220. The lower body 110 includes a first guide 111. The first guide 111 protrudes outward on each of the left surface and the right surface of the lower body 110. That is, the first guide 111 is provided at each of the left side and the right side of the lower body 110. The first guide 111 is formed in the front and rear direction.

The moving body 200 is configured to include a second guide 241.

The second guide 241 is coupled to the lower sides of the first window 211 and the second window 212.

The second guide 241 may protrude inward on the inner surface of the lower guard 240. The second guide 241 protrudes inward on the inner surface of the second lower guard 240*b*. Further, the second guide 241 protrudes inward on the inner surface of the third lower guard 240*c*.

The second guide 241 is placed in line with the first guide 111 at the upper side of the first guide 111. The first guide 111 and the second guide 241 are spaced apart from each other in line.

The showcase 1 is configured to include the first slider 251. The first slider 251 is configured to be fixed to any one of the first guide 111 and the second guide 241, and to contact the other one. The first slider 251 may be made of the lubricant engineering plastic.

The first slider 251 may be configured to be fixed to the front side of the first guide 111 and to be convex toward the second guide 241, and to contact the lower surface of the second guide 241. The first slider 251 may be configured to be in point-contact with the lower surface of the second guide 241.

In the showcase 1, a plurality of first sliders 251 may be provided.

When a pair of first sliders 251 are provided, one first slider 251 may be fixed to the left first guide 111 of the showcase 1 and the other one first slider 251 may be fixed to the right first guide 111 of the showcase 1.

When two pairs or more of first sliders 251 are provided, two or more first sliders 251 may be fixed to the left first guide 111 of the showcase 1 and two or more first sliders 251 may be fixed to the right first guide 111 of the showcase 1. In this case, the plurality of first sliders 251 may be arranged in the first direction X.

The first slider 251 and the first guide 111 may be coupled to engage with each other. The first slider 251 and the first guide 111 may be coupled to forcibly fit with each other. While a groove is formed in the first slider 251 and a part of the first guide 111 forcibly fits in the groove of the first slider 251, the first slider 251 may be fixed to the first guide 111. While the groove is formed in the first guide 111 and a part of the first guide 251 forcibly fits in the groove of the first guide 111, the first slider 251 may be fixed to the first guide 111.

The showcase 1 may be configured to include the second slider 252. The second slider 252 is positioned before the first slider 251. The second slider 252 may be configured to be fixed to the rear side of the second guide 241 and to be convex toward the first guide 111, and to contact the upper surface of the first guide 111. The second slider 252 may be configured to be in point-contact with the upper surface of the first guide 111.

A slider fixation portion 243 may be formed in the second guide 241. The slider fixation portion 243 is configured integrally with the second guide 241. The slider fixation portion 243 may form a part of the second guide 241. The second slider 252 is fixed to the slider fixation portion 243.

The second slider 252 and the slider fixation portion 243 may be coupled to engage with each other. The second slider 252 and the slider fixation portion 243 may be coupled to forcibly fit with each other. While the groove is formed in the second slider 252 and a part of the second slider fixation portion 243 forcibly fits in the groove of the second slider 252, the second slider 252 may be fixed to the slide fixation portion 243. While the groove is formed in the slider fixation portion 243 and a part of the second slider 252 forcibly fits in the groove of the slider fixation portion 243, the second slider 252 may be fixed to the slide fixation portion 243. In the showcase 1, a plurality of second sliders 252 may be provided.

When a pair of second sliders 252 are provided, one second slider 252 may be fixed to the left second guide 241 of the showcase 2 and the other one second slider 252 may be fixed to the right second guide 241 of the showcase 1.

When two pairs or more of second sliders 252 are provided, two or more second sliders 252 may be fixed to the left second guide 241 of the showcase 1 and two or more second sliders 252 may be fixed to the right second guide 241 of the showcase 1. In this case, the plurality of second sliders 252 may be arranged in the first direction X.

The first slider 251 and the second slider 252 may be made of polyacetal (POM).

As described above, in the showcase 1 according to the embodiment of the present invention, the first slider 251 is provided between the first guide 111 and the second guide 241 at both the left and right sides of the showcase 1, and as a result, the moving body 200 may smoothly move with respect to the body 100.

Further, the showcase 1 according to the embodiment of the present invention includes the second slider 252, and the first slider 251 and the second slider 252 are provided between the first guide 111 and the second guide 241 at both the left and right sides of the showcase 1, respectively, and as a result, the moving body 200 may smoothly move with respect to the body 100. Further, the first slider 251 and the second slider 252 may be prevented from being viewed externally, and foreign substances such as dust may be prevented from penetrating the first slider 251 and the second slider 252.

While the first slider 251 and the second slider 252 preventing the friction are made of the lubricant engineering plastic, the first slider 251 is fixed to the first guide 111 and the second slider 252 is fixed to the second guide 241, and as a result, a structure of a means capable of preventing the friction may be simplified and the moving body 200 may smoothly move forward and backward.

When the moving body 200 moves forward with respect to the body 100 in the showcase 1 according to the embodiment of the present invention, the second slider 252 may not cross the first slider 251 and the first slider 251 may serve as a stopper that tops the movement of the second slider 252.

The body 100 may be configured to include a third guide 112. The third guide 112 protrudes outward on each of the left surface and the right surface of the lower body 110, and is formed in the front and rear direction. The third guide 112 is positioned above of the second guide 241.

The third guide 122 is positioned inside the lower guard 240. One third guide 122 is positioned inside the second lower guard 240*b*, and the other one third guide 112 is positioned inside the third lower guard 240*c*.

The second guide 241 may be positioned outside the left surface or the right side of the lower body 110.

The third guide 112 prevents the second guide 241 from moving upward. That is, the third guide 112 prevents the moving body 200 form moving upward with respect to the body 100.

Therefore, unintended separation of the moving body 200 with respect to the body 100 may be prevented, and the moving body 200 may slidably move stably in the front and rear direction with respect to the body 100.

Figure 18:
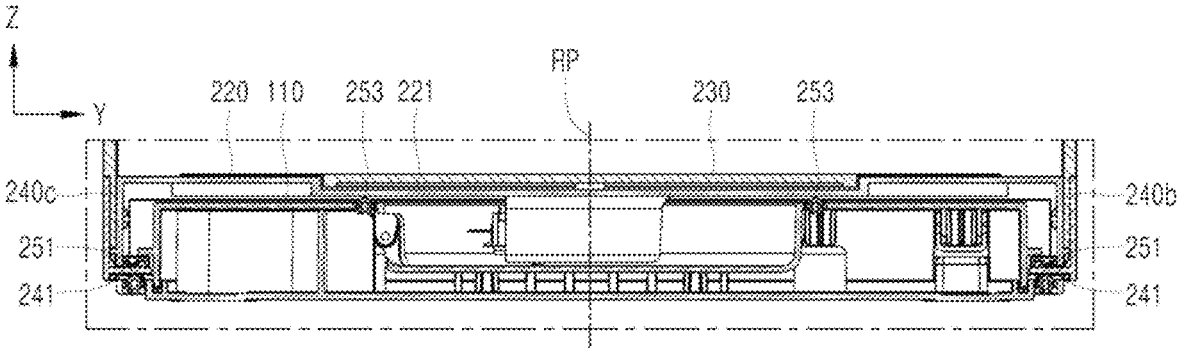
FIG. 18 is a cross-sectional view illustrating the lower side of the showcase according to the embodiment of the present invention.

FIG. 18 is a cross-sectional view illustrating the lower side of the showcase 1 according to the embodiment of the present invention.

Figure 19A:
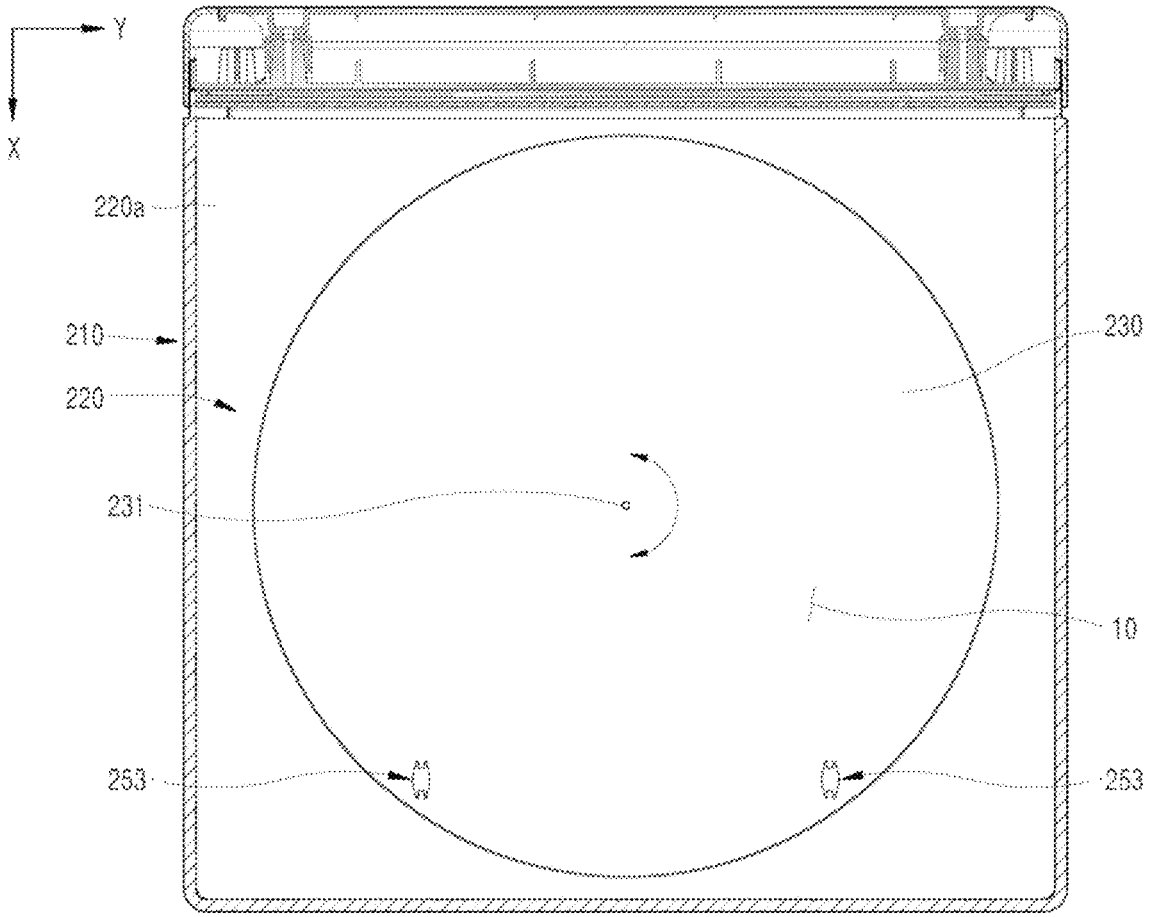
FIG. 19*a* is a plan cross-sectional view illustrating a closed state of the showcase according to the embodiment of the present invention.

FIG. 19*a* is a plan cross-sectional view illustrating a closed state of the showcase 1 according to the embodiment of the present invention.

Figure 19B:
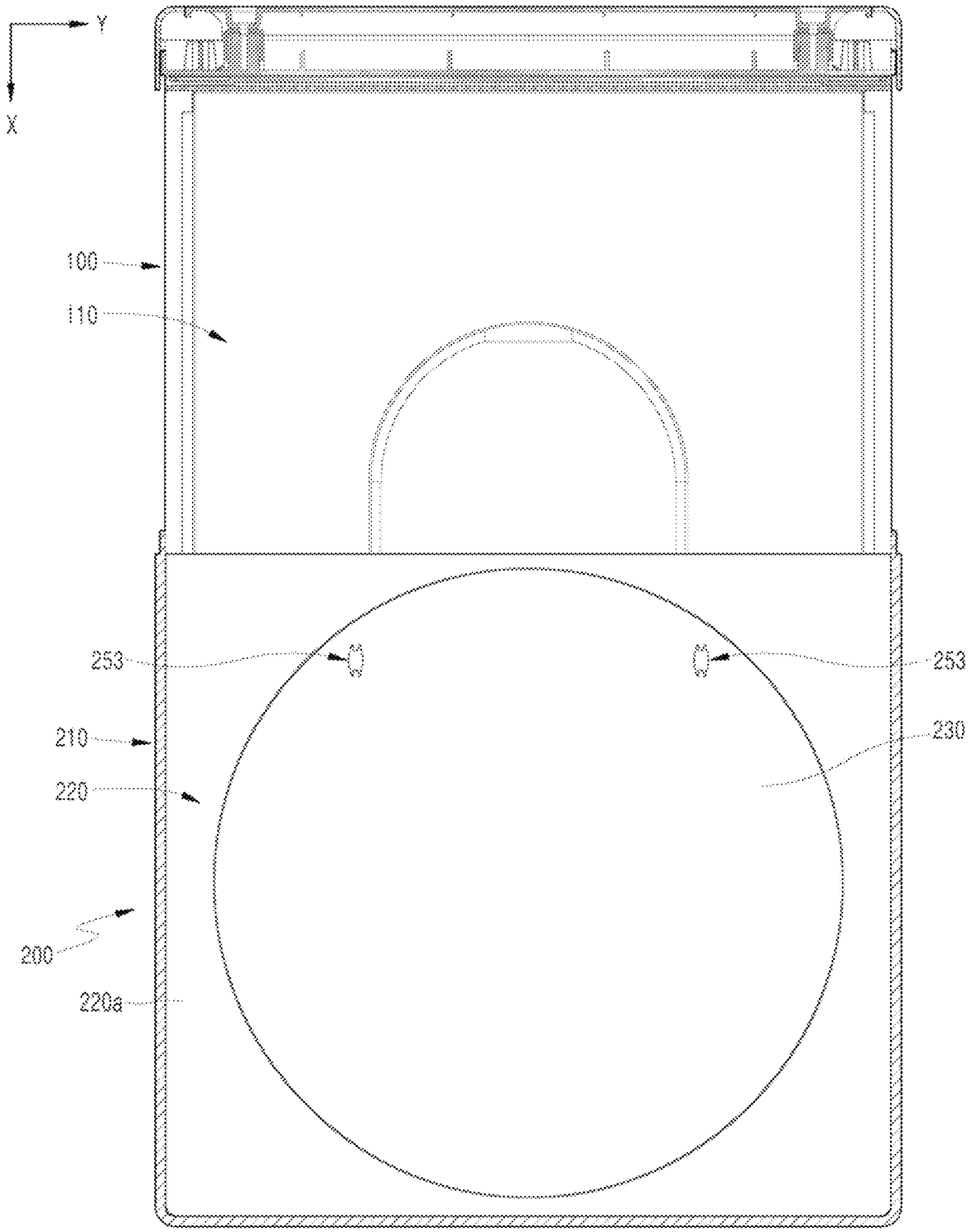
FIG. 19*b* is a plan cross-sectional view illustrating an opened state of the showcase according to the embodiment of the present invention.

FIG. 19*b* is a plan cross-sectional view illustrating an opened state of the showcase 1 according to the embodiment of the present invention.

The body 100 may be configured to include a third slider 253. The third slider 253 is fixed to the lower body 110. The third slider 253 is configured to be fixed to the front side of the lower body 110 and to be convex toward the base 220 to contact the lower surface of the base 220. The third slider 253 may be configured to be in point-contact with the lower surface of the base 220.

The third slider 253 may be configured to be in point-contact with the bottom of the table accommodation portion 221.

The third slider 253 may be made of the lubricant engineering plastic. The third slider 253 may be made of polyacetal (POM).

A pair of third sliders 253 may be provided, and may be configured to be horizontally symmetric to each other around the reference plane RP passing through the center of the showcase 1 in the front and rear direction.

In the showcase 1, the third slider 253 may be configured to be positioned in an area of the turntable 230 on the plan view. On the plan view, when the moving body 200 is positioned at the first location, the third slider 253 may be configured to be positioned in the area of the turntable 230 and when the moving body 200 is positioned at the second location, the third slider 253 may be configured to be positioned in the area of the turntable 230.

In the showcase 1 according to the embodiment of the present invention, when the moving body 200 is positioned at the first location, the third slider 253 may be in contact with the bottom of the table accommodation portion 221 and further, when the moving body 200 is positioned at the second location, the third slider 253 may be configured to be in contact with the bottom of the table accommodation portion.

When the moving body 200 moves forward and backward with respect to the body 100, the third slider 253 may be configured to be positioned in the area of the turntable 230 on the plan view.

Therefore, when the moving body 200 moves with respect to the body 100, the turntable 230 and the table accommodation portion 221 are continuously supported by the third slider 253, and the turntable 230 and the turntable accommodation portion 221 on which the shoe S is placed may be prevented from drooped or the friction between the base 220 and the lower body 110 may be prevented from being generated.

Figure 20A:
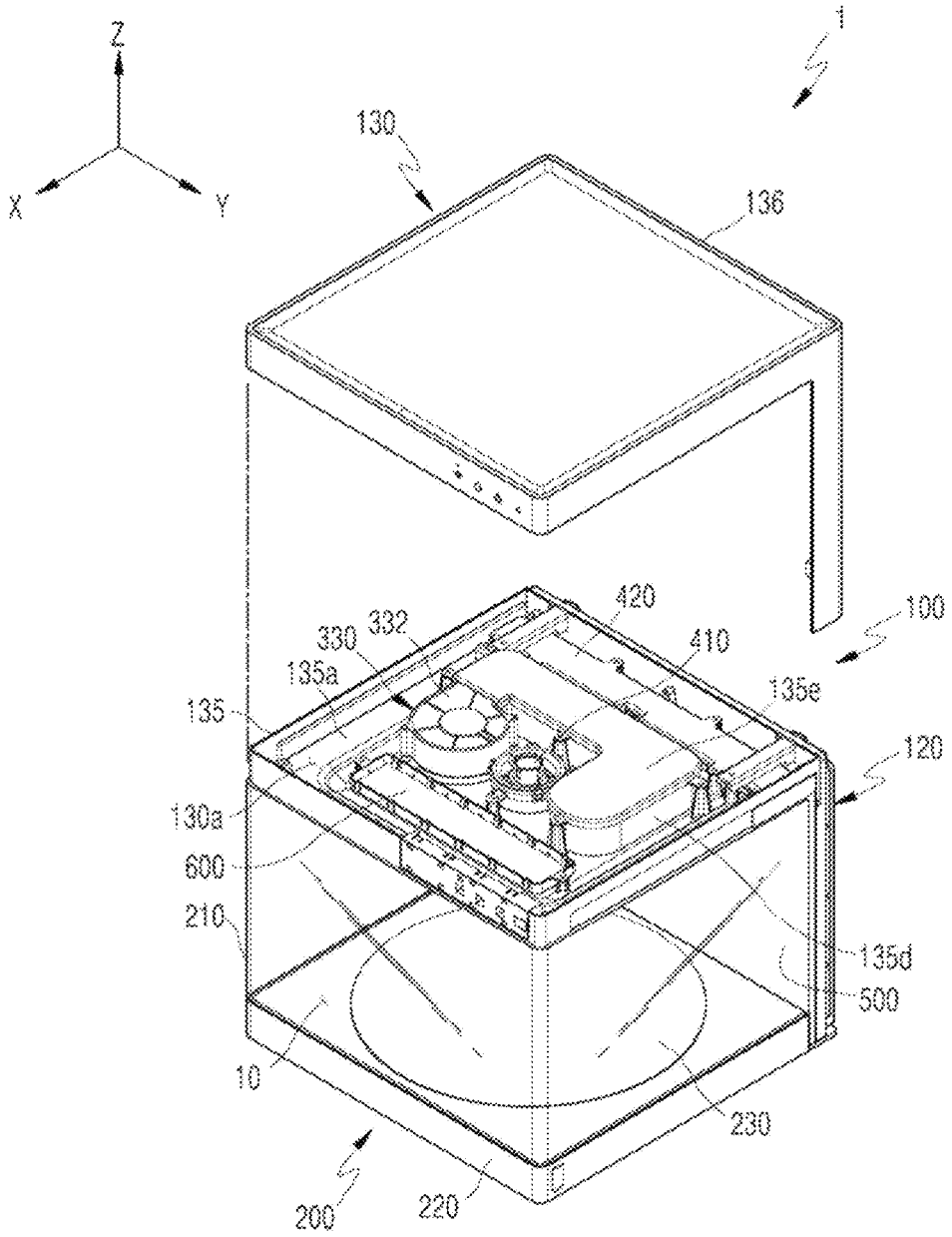
FIG. 20*a* is a perspective view illustrating a state in which a first external cabinet is separated from the body of the showcase of FIG. 1*a*.

FIG. 20*a* is a perspective view illustrating a state in which a first external cabinet 136 is separated from the body 100 of the showcase 1 of FIG. 1*a*.

Figure 20B:
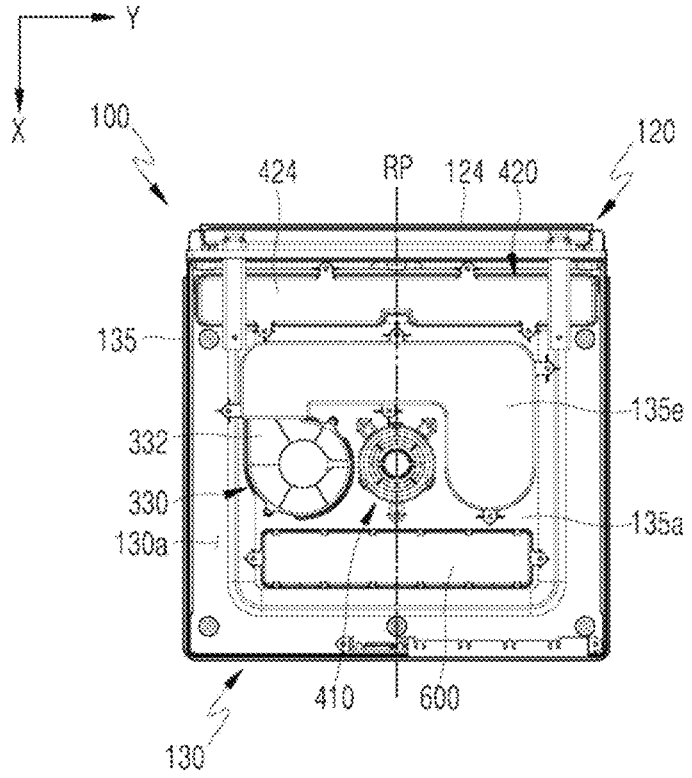
FIG. 20*b* is a plan view illustrating a state in which the first external cabinet is removed from the body of the showcase of FIG. 1*a*.

FIG. 20*b* is a plan view illustrating a state in which the first external cabinet 136 is removed from the body 100 of the showcase 1 of FIG. 1*a*.

Figure 21:
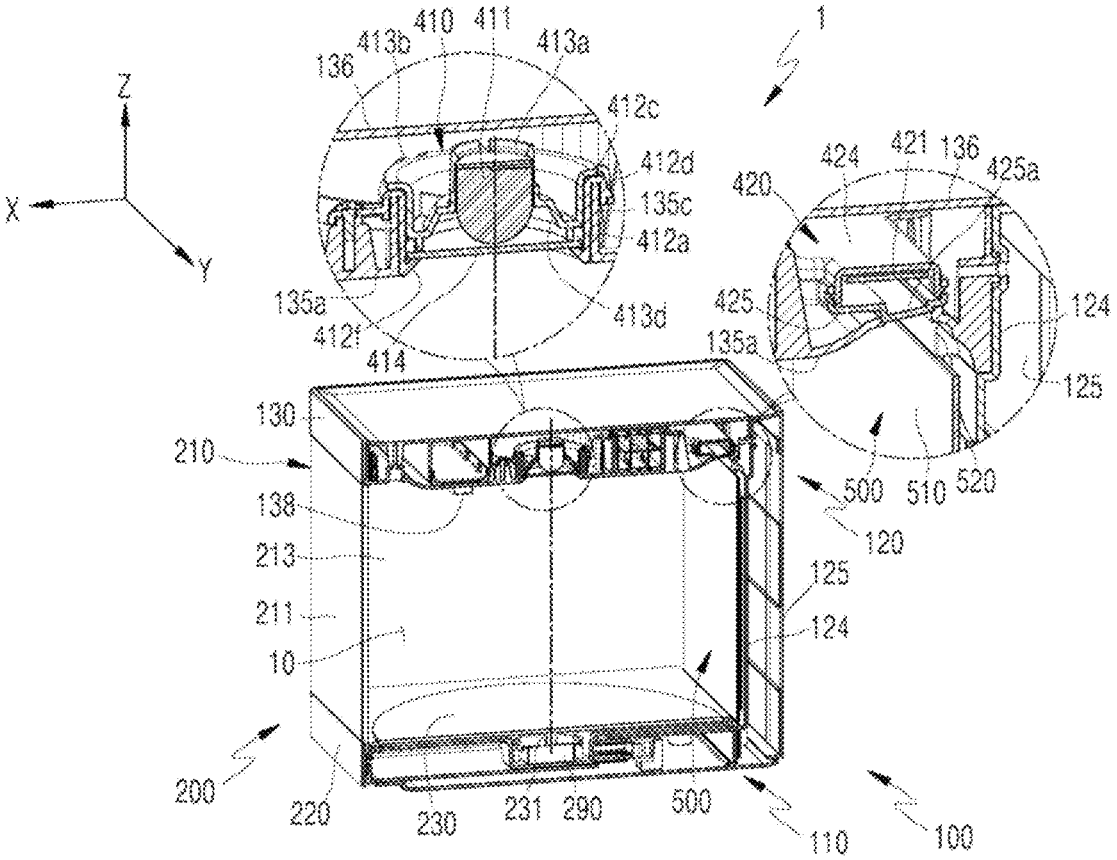
FIG. 21 is a perspective cross-sectional view of the showcase of FIG. 3*a* taken along line A-A.

FIG. 21 is a perspective cross-sectional view of the showcase 1 of FIG. 3*a* taken along line A-A. FIG. 21 does not illustrate the shoe S.

As illustrated in FIGS. 20*a* to 21, the showcase 1 may include a body 100, a moving body 200, a blowing part 330, a first light 410, and a second light 420.

The body 100 and the moving body 200 may form the accommodation space 10 accommodating the shoe S jointly. The body 100 and the moving body 200 may be coupled to move with respect to each other. The moving body 200 may be coupled to the body 100 to reciprocally move in the front and rear direction.

The body 100 may include the upper body 130. The upper body 130 may be positioned above the accommodation space 10. The upper body 130 may have an upper space 130*a* of which gas flow is disconnected from the accommodation space therein. The upper space 130*a* may have a hexahedral shape in which lengths in the first direction X and the second direction Y are larger than a length in the third direction Z.

The upper body 130 may include a first internal cabinet 135 and a first external cabinet 136. The first internal cabinet 135 and the first external cabinet 136 may form the accommodation space 10 jointly.

As illustrated in FIG. 20*a*, the first internal cabinet 135 may have a rectangular box shape opened upward. The first internal cabinet 135 may have an air flow path 300 connected to the accommodation space 10. The first internal cabinet 135 may include an upper bottom plate 135*a*.

The upper bottom plate 135*a* may partition the accommodation space 10 and the upper space 130*a*. The lower surface of the upper bottom plate 135*a* may form the top of the accommodation space 10. The upper surface of the top bottom plate 135*a* may form the bottom of the upper space 130*a*. The upper bottom plate 135*a* may have a plate shape which is wide in the horizontal direction.

The blowing part 330 is a component that circulates air in the accommodation space 10. The blowing part 330 and the air flow path 300 may be provided on the upper surface of the upper bottom plate 135*a*.

The blowing part 330 may include a fan 331 and a fan housing 332. The fan 331 may pressure-feed the air by a rotary motion of an impeller. The fan housing 332 may constitute a part of the air flow path 300.

As illustrated in FIG. 20*b*, the suction port 310 and the discharge port 320 may be formed on the upper bottom plate 135*a*.

The air in the accommodation space 10 may be suctioned into the air flow path 300 through the suction port 310. The air in the air flow path 300 may be discharged to the accommodation space 10 through the discharge port 320. Therefore, air forcibly blown by the blowing part 330 may be circulated in the accommodation space 10 and the air path 300.

As illustrated in FIG. 21, the moving body 200 may include the transparent window 210, the base 220, and the turntable 230.

The body 100 may include the lower body 110. The lower body 110 may be positioned below the accommodation space 10.

The base 220 may be coupled to the lower body 110 to be relatively movable in the front and rear direction so as to open/close the accommodation space 10. The transparent window 210 may be coupled to the base 220. The transparent window 210 may form the front surface, and both side surfaces (a left surface and a right surface) of the accommodation space 10.

The turntable 230 may be rotatably coupled to the base 220 around a vertical axis 231. The base 220 and the turntable 230 may form the lower surface of the accommodation space 10 jointly. The upper surface of the turntable 230 may have the circular shape around the vertical axis 231.

The motor 290 may be provided in the base 220. The motor 290 may deliver the rotary movement to the turntable 230. The rotational axis 231 of the turntable 230 may be in line with the vertical direction.

The axis of the motor 290 may be directly coupled to the rotational axis 231 of the turntable 230. The vertical axis 231 may mean the rotational axis 231 of the turntable 230. An alternate long and short dash line illustrated in FIG. 21 may mean an extension line of the vertical axis 231.

A power supply (not illustrated) may be provided in the base 220. The power supply may supply power to the motor 290. The controller 600 may control the power supplied to the motor 290 from the power supply.

Figure 22:
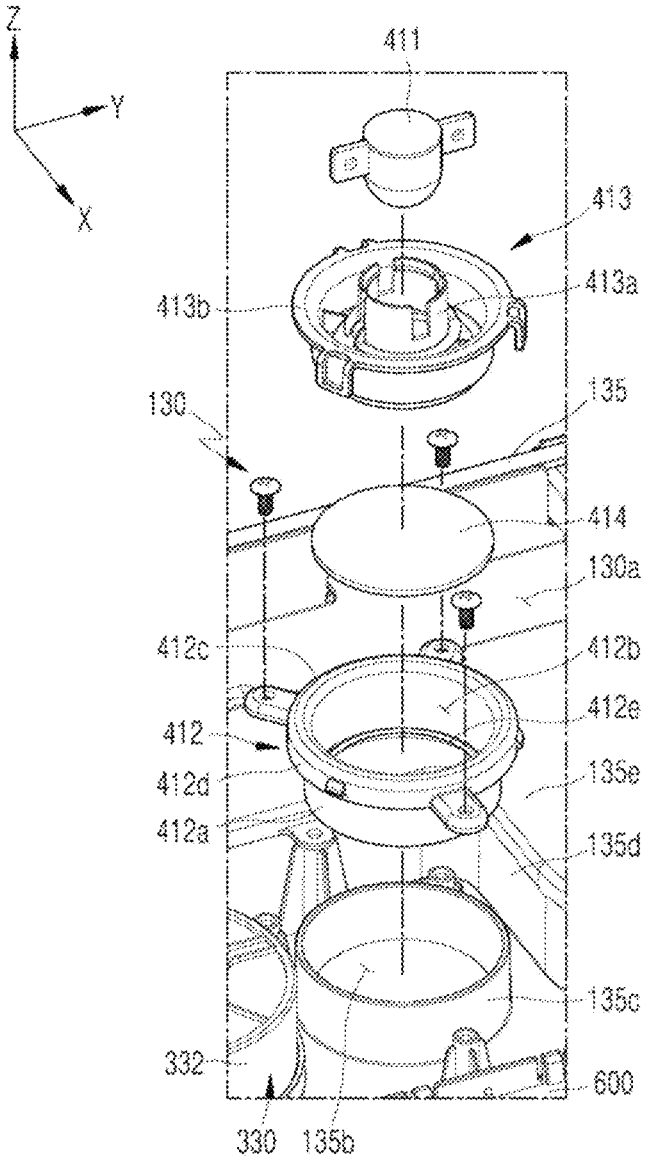
FIG. 22 is an exploded perspective view of the first light of the showcase of FIG. 20*b*.

FIG. 22 is an exploded perspective view of the first light 410 of the showcase 1 of FIG. 20*b*.

As illustrated in FIGS. 21 and 22, the first light 410 may irradiate light to the upper surface of the turntable 230 on which the shoe S is placed on the extension line of the vertical axis 231. The first light 410 may be coupled to the upper bottom plate 135*a*.

The first light 410 may include a light source 411, an insertion housing 412, a mounting housing 413, and a lens 414.

The light source 411 may irradiate the light to the accommodation space 10. A power supply (not illustrated) may be provided in the base 220. The power supply may supply the power to the light source 411. The controller 600 may control the power supplied to the light source 411 from the power supply.

The light source 411 may be provided on the extension line of the vertical axis 231. The accommodation space 10 may be parallel to the first direction X which is the horizontal direction and form a symmetry based on the reference surface RP which is a vertical surface. The extension line of the vertical axis 231 may be positioned within the reference plane RP.

The light of the light source 411 may illuminate the shoe S placed on the bottom of the accommodation space 10. When the light 410 is turned, an image of the shoe S stored in the accommodation space 10 may be changed by the light of the light source 411.

When the user manipulates the operating button 610, the light source 411 may be turned on or off. The user may input an operating time of the light source 411 into the controller 600 through the operating button 610. The user manipulates the operating button 610 to adjust the operating time of the light source 411.

The light source 411 may be provided as an LED. Both terminals of the light source 411 may be extended from light source 411 in the horizontal direction. Both terminals may be extended in opposite directions to each other.

The light source 411 may be formed by a white LED emitting white light. The light source 411 may illustrate the shoe S accommodation in the accommodation space 10. Therefore, in the state in which the light around the showcase 1 is turned off or weak, the visibility of the shoe S stored in the accommodation space 10 may be enhanced. Therefore, the display effect of the shoe S stored in the accommodation space 10 may be enhanced.

Alternatively, the light source 411 may be configured to change the color of the light. As an example, the light source 411 may be formed by a Red Green Blue White (RGBW) LED. The controller 600 may control current applied to a Red (R) LED, a Green (G) LED, a Blue (B) LED, and a White (W) LED.

When the controller 600 controls the current applied to the RGBW LEDs, the aesthetics and a color sense of the shoe S stored in the accommodation space 10 may be variously changed. The user may input a pattern of the current applied to the RGBW LED into the controller 600 through the operating button 610.

A main hole 135*b* and a circular projection portion 135*c* may be formed on the upper bottom plate 135*a*. The circular projection portion 135*c* may be formed to extend upward at the edge of the main hole 135*b*. The main hole 135*b* may extend in the upper and lower direction by the inner surface of the circular projection portion 135*c*.

As illustrated in FIGS. 21 and 22, the insertion housing 412 may include an insertion sleeve 412*a*, a first insertion bending portion 412*c*, and a second insertion bending portion 412*d*.

The insertion sleeve 412*a* may have a circular pipe shape. The inner surface of the insertion sleeve 412*a* may form a circular hole 412*b* through which the light of the light source 411 passes. The insertion sleeve 412*a* may be inserted into the main hole 135*b*. The outer surface of the insertion sleeve 412*a* may be opposed to the inner surface of the circular projection portion 135*c*.

The first insertion bending portion 412*c* may be formed to extend outward on the outer surface of the insertion sleeve 412*a*. The first insertion bending portion 412*c* may be seated on the top of the circular projection portion 135*c*.

The second insertion bending portion 412*d* may be formed to extend downward from the first insertion bending portion 412*c*. An upper portion of the circular projection portion 135*c* may be inserted between the insertion sleeve 412*a* and the insertion bending portion. Therefore, a gas flow of the upper space 130*a* and the accommodation space 10 through the circular projection portion 135*c* and the insertion housing 412 may be stopped.

A step portion 412*e* may be formed on the inner surface of the insertion sleeve 412*a* in the circumferential direction. The step portion 412*e* may form a second reflection surface 412*f* that reflects the light of the light source 411, which penetrates the lens 414. The second reflection surface 412*f* may form an axial symmetry around the vertical axis 231. The second reflection surface 412*f* may reflect the light of the light source 411 to the accommodation space 10.

As illustrated in FIGS. 21 and 22, the mounting housing 413 may include a mounting sleeve 413*a*, a mounting bending portion 413*b*, and a closed projection portion 413*c*.

The light source 411 may be coupled to the mounting sleeve 413*a*. The light source 411 may be inserted into the inside of the mounting sleeve 413*a*. A plurality of grooves into which both terminals of the light source 411 are inserted downward may be formed in the mounting sleeve 413*a*. The grooves of the mounting sleeve 413*a* may be formed in opposite directions to each other around the vertical axis 231.

A diameter of an upper end portion of the mounting sleeve 413*a* may be smaller than the diameter of the light source 411. In the process in which the light source 411 is inserted into the inside of the mounting sleeve 413*a*, the mounting sleeve 413*a* may be bending-deformed outward. When both terminals of the light source 411 are completely inserted into the grooves of the mounting sleeve 413*a*, the mounting sleeve 413*a* may be elastically restored. A protrusion may be formed on the inner surface of the upper end portion of the mounting sleeve 413*a*. Therefore, the mounting sleeve 413*a* may prevent detachment of the light source 411.

The mounting sleeve 413*a* may be inserted into the inside of the insertion sleeve 412*a*. The outer surface of the mounting sleeve 413*a* may be opposed to the inner surface of the insertion sleeve 412*a*.

A lower portion of the mounting sleeve 413*a* may form a first reflection surface 413*d* that reflects the light of the light source 411 toward the lens 414. The first reflection surface 413*d* may form the axial symmetry around the vertical axis 231. The first reflection surface 413*d* may reflect the light of the light source 413 to the accommodation space 10.

The mounting bending portion 413*b* may be formed to extend outward on the outer surface of the mounting sleeve 413*a*. The mounting bending portion 413*b* may be seated on the top of the first insertion bending portion 412*c*.

A hook may be formed at any one of the mounting bending portion 413*b* and the second insertion bending portion 412*d*. In addition, a portion to which the hook is hooked may be formed at the other one of the mounting bending portion 413*b* and the second insertion bending portion 412*d*. Therefore, as the mounting bending portion 413*b* is seated on the top of the first insertion bending portion 412*c*, a coupling force may be formed between the insertion housing 412 and the mounting housing 413.

The closed projection portion 413*c* may extend downward on the lower end of the mounting sleeve 413*a*. The closed projection portion 413*c* may be formed around the vertical axis 231 in the circumferential direction.

The lens 414 may be inserted into the inside of the insertion sleeve 412*a*. The lens 414 may be mounted on the top of the step portion 412*e*. The top of the step portion 412*e* may form a contact surface with the lens 414 in the circumferential direction.

As the mounting sleeve 413*a* is inserted into the inside of the insertion sleeve 412*a*, the lens 414 may be in close contact with the bottom of the closed projection portion 413*c*. Therefore, the lens 414 may close the circular hole 412*b*. Therefore, the gas flow of the upper space 130*a* and the accommodation space 10 through the circular hole 412*b* may be stopped.

The light of the light source 411 may illuminate the accommodation space 10 by passing through the lens 414. An ultraviolet-proof film may be attached to the lens 414 or the ultraviolet-proof agent may be coated on the lens 414 in order to block the ultraviolet rays.

As illustrated in FIG. 21, the body 100 may include the middle body 120. The middle body 120 may form the rear surface of the accommodation space 10.

The internal panel 500 may be coupled to the front surface of the middle body 120 in the accommodation space 10. Therefore, the turntable 500 may form the rear surface of the accommodation space 10 jointly with the middle body 120. The internal panel 500 may be detachably coupled to the middle body 120. As an example, the internal panel 500 may be coupled to the front surface of the middle body 120 by a magnetic force.

The front surface of the middle body 120 may generally form the plane. The internal panel 500 may have the thin plate shape. The rear surface of the internal panel 500 may be in close contact with the front surface of the middle body 120. The front surface and/or the rear surface of the internal panel 500 may form a similar shape and a similar area to the front surface of the middle body 120.

Therefore, even though the internal panel 500 is coupled or not coupled to the middle body 120, the hexahedral shape and size of the accommodation space 10 may be maintained substantially constantly. Therefore, even though the internal panel 500 is coupled or not coupled to the middle body 120, the accommodation space 10 may show predetermined aesthetics based on the shape and the size.

The front surface of the internal panel 500 may be made of the same or similar material as the front surface of the middle body 120.

Therefore, even though the internal panel 500 is coupled or not coupled to the middle body 120, the light of the first light 410 and the second light 420 reflected on the rear surface of the accommodation space 10 may be delivered to a vision of a person who sees the shoe S to be the same or similar. Therefore, even though the internal panel 500 is coupled or not coupled to the middle body 120, the accommodation space 10 may show predetermined aesthetics based on the light.

The internal panel 500 may be configured to accommodate an image sheet 550. The image sheet 500 may mean a sheet including an image to the letter. As an example, the image sheet 550 may be a sheet printed with a photo, a picture, or a letter.

The internal panel 500 may form an insertion space 500*c* accommodating the image sheet 550. The internal panel 500 may include a transparent or translucent material so as to expose the image sheet 550 to the accommodation space 10.

The image sheet 550 may be exposed to the vision of the person who sees the shoe S accommodated in the showcase 1. Therefore, the user of the showcase 1 may display the photo and the picture on the rear surface of the accommodation space 10.

The insertion space 500*c* may be opened to the upper side. The image sheet 550 may be inserted into the insertion space 500*c* through an upper opening. The image sheet 550 inserted into the insertion space 500*c* may be withdrawn to the outside through the upper opening. Therefore, the user of the showcase 1 may display various photos and pictures on the rear surface of the accommodation space 10.

Figure 23:
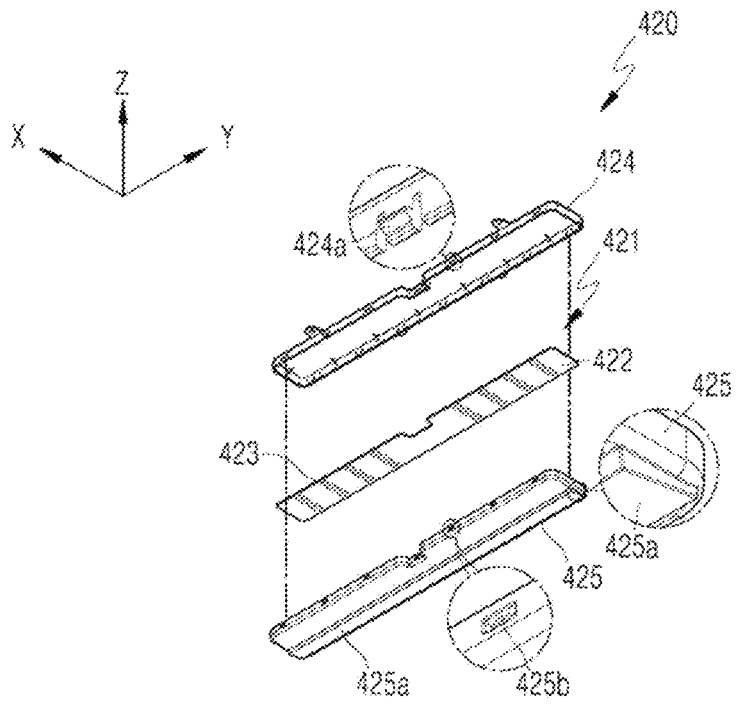
FIG. 23 is an exploded perspective view of the second light of the showcase of FIG. 20*b*.

FIG. 23 is an exploded perspective view of the second light 420 of the showcase 1 of FIG. 20*b*.

As illustrated in FIGS. 21 and 23, the second light 420 may illuminate the rear surface of the accommodation space 10. The second light 420 may be parallel to the first direction X which is the horizontal direction and form the symmetry based on the reference surface RP which is the vertical surface. The extension line of the vertical axis 231 may be positioned within the reference plane RP.

The second light 420 may include a light source module 421, a heat dissipation cover 424, and a transmission cover 425.

As illustrated in FIGS. 20*b* and 23, the light source module 421 may be formed to be long in the second direction Y. The light source module 421 may be formed by an LED module. The light source module 421 may include a module substrate 422 and a plurality of white LEDs.

A power supply (not illustrated) may be provided in the base 220. The power supply may supply power to the light source module 421. The controller 600 may control the power supplied to the light source module 421 from the power supply.

The module substrate 422 may be formed to be long in the second direction Y. The plurality of LEDs may be placed on the bottom of the module substrate 422 at a predetermined gap in the second direction Y. Therefore, light which the light source module 421 irradiates onto the rear surface of the accommodation space 10 may form a substantially constant illuminance in the second direction Y.

Therefore, the visibility of the rear surface of the accommodation space 10 is enhanced, and as a result, the display effect of the image sheet 550 accommodated in the internal panel 500 may be enhanced. In particular, in the state in which the light around the showcase 1 is turned off or weak, the display effect of the image sheet 550 accommodated in the internal panel 500 may be enhanced.

Alternatively, the light source module 421 may be configured to change the color of the light. As an example, the light source module 421 may be constituted by the module substrate 422 and a plurality of Red Green Blue White (RGBW) LEDs. The controller 600 may control current applied to a Red (R) LED, a Green (G) LED, a Blue (B) LED, and a White (W) LED.

When the controller 600 controls the current applied to the RGBW LEDs, the aesthetics and the color sense of the rear surface of the accommodation space 10 may be variously changed. The user may input a pattern of the current applied to the RGBW LED 423 into the controller 600 through the operating button 610.

Meanwhile, a wavelength of the light of the second light 420 may vary depending on the temperature and/or the humidity of the accommodation space 10. Here, a change range of the wavelength may be a wavelength range of visible light. That is, the change range of the wavelength may be 400 to 700 nm.

As illustrated in FIG. 21, a measurement sensor 138 measuring the temperature and/or the humidity may be installed at one side of the accommodation space 10. The measurement sensor 138 may be installed in the upper body 130, the middle body 120, or the base 220. As an example, the measurement sensor 138 may be installed on the upper bottom plate 135*a*. The controller 600 may receive a measurement value of the measurement sensor 138.

The controller 600 may control the current applied to the RGBW LED 423 according to the measurement value of the measurement sensor 138. The wavelength of the light emitted by the second light 420 may vary depending on the measurement value of the measurement sensor 138. Therefore, a color stimulus of the light reflected on the rear surface of the accommodation space 10 may vary depending on the measurement value of the measurement sensor 138.

The color stimulus is a term that means a stimulus which reflected light of a colored object gives to the color sense of the eye. When the eye of the person is stimulated by the light, there are three color senses of sensing red, green, and blue, and the color may be displayed by a stimulus amount (triple stimulus value) for three color senses.

A current amount applied to the RGBW LED 423 may be set in the controller 600 according to the measurement value of the measurement sensor 138. Alternatively, the user may input the current amount applied to the RGBW LED 423 according to the measurement value of the measurement sensor 138 into the controller 600 through the operating button 610.

An appropriate temperature range may be input into the controller 600. The appropriate temperature range may mean a temperature range suitable for keeping the shoe S. The controller 600 may change the current amount applied to the RGBW LED 423 according to the measurement value of the measurement sensor 138 being within the appropriate temperature range.

As an example, when the measurement value of the measurement sensor 138 is within the appropriate temperature range, the controller 600 may apply the current to the RGBW LED 423 so that the second light 420 emits green or blue light.

As an example, when the measurement value of the measurement sensor 138 is out of the appropriate temperature range, the controller 600 may apply the current to the RGBW LED 423 so that the second light 420 emits red light.

Alternatively, when the measurement value of the measurement sensor 138 is out of the appropriate temperature range, the controller 600 may apply the current to the RGBW LED 423 so that the second light 420 continuously flashes light of a specific color.

An appropriate humidity range may be input into the controller 600. The appropriate humidity range may mean a humidity range suitable for keeping the shoe S. The controller 600 may change the current amount applied to the RGBW LED 423 according to the measurement value of the measurement sensor 138 being within the appropriate humidity range.

As an example, when the measurement value of the measurement sensor 138 is within the appropriate humidity range, the controller 600 may apply the current to the RGBW LED 423 so that the second light 420 emits the green or blue light.

As an example, when the measurement value of the measurement sensor 138 is out of the appropriate humidity range, the controller 600 may apply the current to the RGBW LED 423 so that the second light 420 emits the red light.

Alternatively, when the measurement value of the measurement sensor 138 is out of the appropriate humidity range, the controller 600 may apply the current to the RGBW LED 423 so that the second light 420 continuously flashes light of a specific color.

As illustrated in FIGS. 21 and 23, the heat dissipation cover 424 and the transmission cover 425 may be formed to be long in the second direction Y.

The light source module 421 may be connected to the heat dissipation cover 424. The heat dissipation cover 424 may form the opening at the lower side thereof. The transmission cover 425 may be coupled to at the heat dissipation cover 424 so as to seal the opening of the heat dissipation cover 424.

A hook 424*a* may be formed in any one of the heat dissipation cover 424 and the transmission cover 425. A holing hole 425*b* to which the hook 424*a* is hooked may be formed in any one of the heat dissipation cover 424 and the transmission cover 425. As the transmission cover 425 seals the opening of the heat dissipation cover 424, the hook 424*a* may be hooked to the hooking hole 425*b*. Therefore, the coupling force may be formed between the heat dissipation cover 424 and the transmission cover 425.

Therefore, the heat dissipation cover 424 and the transmission cover 425 may form a space (hereinafter, referred to as 'light source space') accommodating the light source module 421 jointly. The light source space may be formed to be long in the second direction Y.

The top of the module substrate 422 may be coupled to the heat dissipation cover 424 above the light source space. Thermal energy of the light source module 421 may be delivered to the heat dissipation cover 424. The heat dissipation cover 424 may discharge heat of the light source module 421 to the upper space 130*a*. The heat dissipation cover 424 may be made of a metallic material having high thermal conductance.

The LED 423 may be provided on the bottom of the module substrate 422. The transmission cover 425 may include a transmission portion 425*a* that penetrates light of the light source module 421. The transmission portion 425*a* may be formed to be long in the second direction Y.

Therefore, the light of the light source module 421 which penetrates the transmission portion 425*a* may form a substantially constant illuminance in the second direction Y. The transmission cover 425 may be made of a transparent glass or resin material. The front surface of the transmission cover 425 except for the transmission portion 425*a* may be coated with an opaque material.

A hole (hereinafter, referred to as 'rear surface hole') into which the transmission portion 425*a* is inserted may be formed on the upper bottom plate 135*a*. The rear surface hole may be formed to be long in the second direction Y. The transmission portion 425*a* may be inserted into the rear surface hole. The outer surface of the transmission portion 425*a* may be in close contact with the inner surface of the rear surface hole. Therefore, the gas flow of the upper space 130*a* and the accommodation space 10 through the transmission cover 425 and the inner surface of the rear surface hole may be stopped.

Figure 24A:
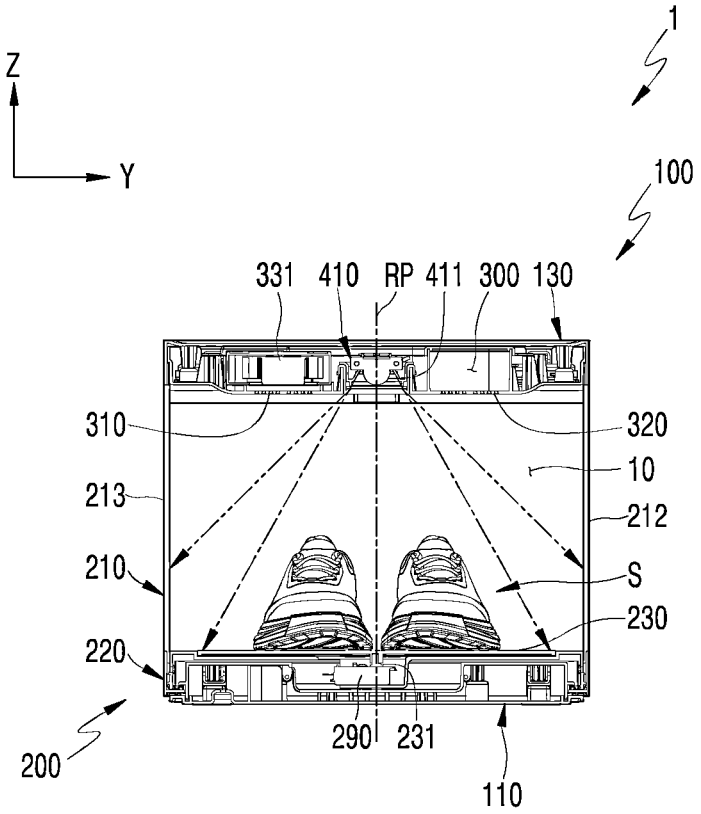
FIG. 24*a* is a cross-sectional view of the showcase of FIG. 3*b* taken along line C-C.
Figure 24B:
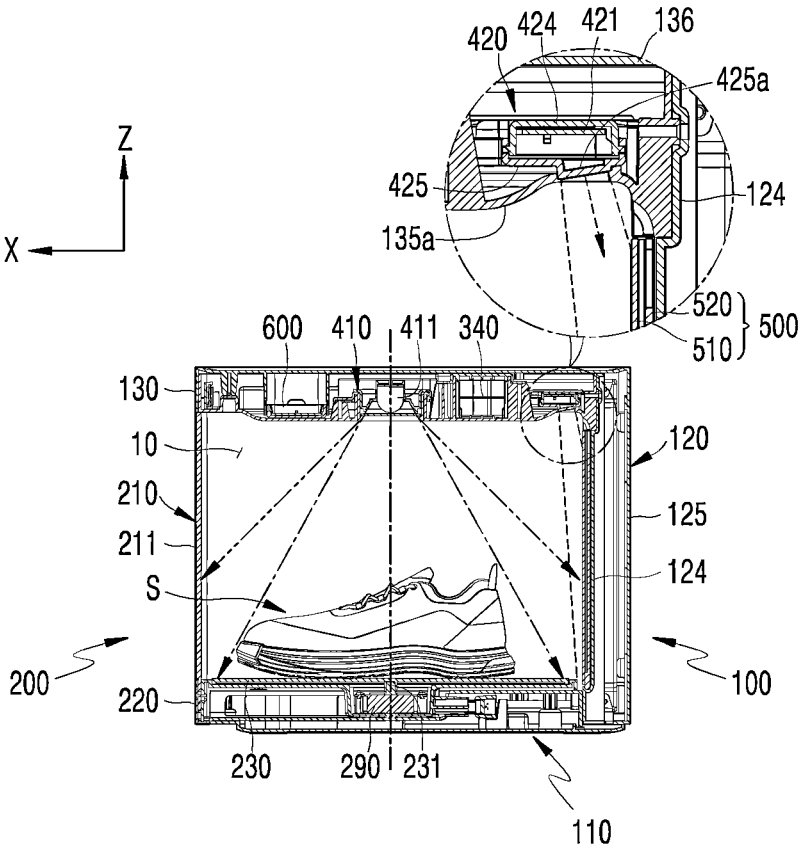
FIG. 24*b* is a cross-sectional view of the showcase of FIG. 3*a* taken along line A-A.

FIG. 24*a* is a cross-sectional view of the showcase 1 of FIG. 3*b* taken along line C-C. FIG. 24*b* is a cross-sectional view of the showcase 1 of FIG. 3*a* taken along line A-A. The alternate long and short dash line illustrated in FIG. 24*b* may mean the extension line of the vertical axis 231.

The accommodation space 10 may be parallel to the first direction X which is the horizontal direction and form the symmetry based on the reference surface RP which is the vertical surface. The extension line of the vertical axis 231 may be positioned within the reference plane RP.

As illustrated in FIGS. 24*a* and 24*b*, the light source 411 may be provided on the extension line of the vertical axis 231. The first light 410 may irradiate light to the top of the turntable 230 on which the shoe S is placed on the extension line of the vertical axis 231.

An alternate long and short dash line arrow illustrated in FIGS. 24*a* and 24*b* may mean the extension line of the first reflection surface 413*d*. An alternate long and two short dashes line arrow illustrated in FIGS. 24*a* and 24*b* may mean the extension line of the second reflection surface 412*f*.

As described above, in the state in which the accommodation space 10 is opened, the user may place the shoe S on the top of the turntable 230 by holding any one part (heel top, lining, tong, etc.) of the shoe S.

Thereafter, the user manipulates the operating button 610 to rotate the turntable 230 at a predetermined angle so that the front and rear direction of the shoe S coincides with the first direction X.

Alternatively, the user manipulates the operating button 610 to rotate the turntable 230 at a predetermined angle so that the front and rear direction of the shoe S form a predetermined angle with the first direction X. Alternatively, the user manipulates the operating button 610 to continuously rotate the turntable 230.

A beam angle of the first light 410 may form the axial symmetry around the vertical axis 231. Therefore, the light emitted by the first light 410 may form the same illuminance around the vertical axis 231 in the circumferential direction.

Therefore, light reflected on the surface of the shoe S may maintain the same color stimulus regardless of a direction which the front and rear direction of the shoe S faces. Therefore, the aesthetics and the color sense of the shoe S stored in the accommodation space 10 may be maintained to be the same regardless of the direction which the front and rear direction of the shoe S faces.

As described above, the transparent window 210 may form the front surface, and both side surfaces (the left surface and the right surface) of the accommodation space 10. The transparent window 210 may include the first window 211, the second window 212, and the third window 213.

The first window 211 may form the front surface of the accommodation space 10. The second window 212 may form the left surface of the accommodation space 10. The third window 213 may form the right surface of the accommodation space 10.

Therefore, the user may observe the shoe S accommodated in the accommodation space 10 at the front side, the left side, and the right side. Further, the user may observe the shoe S accommodated in the accommodation space 10 between front side and the left side and between the front side and the right side of the accommodation space 10.

The beam angle of the first light 410 forms the axial symmetry around the vertical axis 231, and as a result, the light reflected on the surface of the shoe S may maintain the same color stimulus regardless of the location of the user based on the accommodation space 10. Therefore, the aesthetics and the color sense of the shoe S stored in the accommodation space 10 may be maintained to be the same.

Hereinafter, for easy understanding of the present invention, a space between the extension line of the vertical axis 231 and the extension line of the first reflection surface 413*d* will be referred to as 'first space'. In addition, a space between the extension line of the first reflection surface 413*d* and the extension line of the second reflection surface 412*f* will be referred to as 'second space'.

As illustrated in FIG. 21, the first reflection surface 413*d* may be provided next to the light source 411 around the extension line of the vertical axis 231. The second reflection surface 412*f* may be provided below the first reflection surface 413*d*. The first reflection surface 413*d* and the second reflection surface 412*f* may form a surface reflecting the light of the light source 411 toward the accommodation space 10.

The second reflection surface 412*f* may be spaced apart from the extension line of the vertical axis 231 further than the first reflection surface 413*d*. In addition, the extension line of the second reflection surface 412*f* may be spaced apart from the vertical axis 231 further than the extension line of the first reflection surface 413*d*. Therefore, the light reflected by the second reflection surface 412*f* may form a lower illuminance than the light reflected by the first reflection surface 413*d*.

As illustrated in FIGS. 24*a* and 24*b*, the light of the first light 410 may form a higher illuminance in the first space than the second space. The extension line of the first reflection surface 413*d* may face the edge of the turntable 230. Therefore, the first light 410 may intensively illuminate the shoe S placed on the top of the turntable 230. Therefore, the display effect of the shoe S placed on the top of the turntable 230 may be enhanced.

When the shoe S is placed close to the edge of the turntable 230 based on the vertical axis 231, a part of the shoe S may be positioned in the second space. Further, when the shoe S is formed to be long in the vertical direction like boots, a part of the shoe S may be positioned in the second space.

The light of the first light 410 forms a lower illuminance in the second space than the first space, a part of the shoe S positioned in the second space may be illuminated. Therefore, even though a part of the shoe S is positioned outside the first space, the first light 410 may wholly illuminate the shoe S placed on the top of the turntable 230.

Therefore, even though a part of the shoe S is positioned in the second space, the light reflected on the surface of the shoe S may generally maintain the same color stimulus. Therefore, the aesthetics and the color sense of the shoe S stored in the accommodation space 10 may be generally maintained to be the same.

The dotted line illustrated in FIG. 24*b* may mean the progress of the light of the second light 420 penetrating a transmission surface. A dotted-line arrow illustrated in the enlarged diagram of FIG. 24*b* may mean a normal direction of the transmission surface.

According to the Snell's law, when light is incident on a boundary surface of two media having different densities, the reflectance of the light increases as an incident angle increases. Therefore, the transmission portion 425*a* may penetrate the light of the light source module 421 having a smaller incident angle toward the accommodation space 10.

In addition, the transmission portion 425*a* may reflect the light of the light source module 421 having a larger incident angle. Therefore, the light of the light source module 421 which penetrates the transmission portion 425*a* may form a high illuminance around the normal direction of the bottom of the transmission portion 425*a*.

As illustrated in FIG. 24*b*, the normal direction of the bottom of the transmission portion 425*a*, which contacts the accommodation space 10 may face the front surface of the internal panel 500. The top of the transmission portion 425*a* may form a surface parallel to the bottom. Therefore, the second light 420 may intensively illuminate the rear surface of the accommodation space 10.

Therefore, the visibility of the rear surface of the accommodation space 10 is enhanced, and as a result, the display effect of the image sheet 550 accommodated in the internal panel 500 may be enhanced. In particular, in the state in which the light around the showcase 1 is turned off or weak, the display effect of the image sheet 550 accommodated in the internal panel 500 may be enhanced.

Figure 25A:
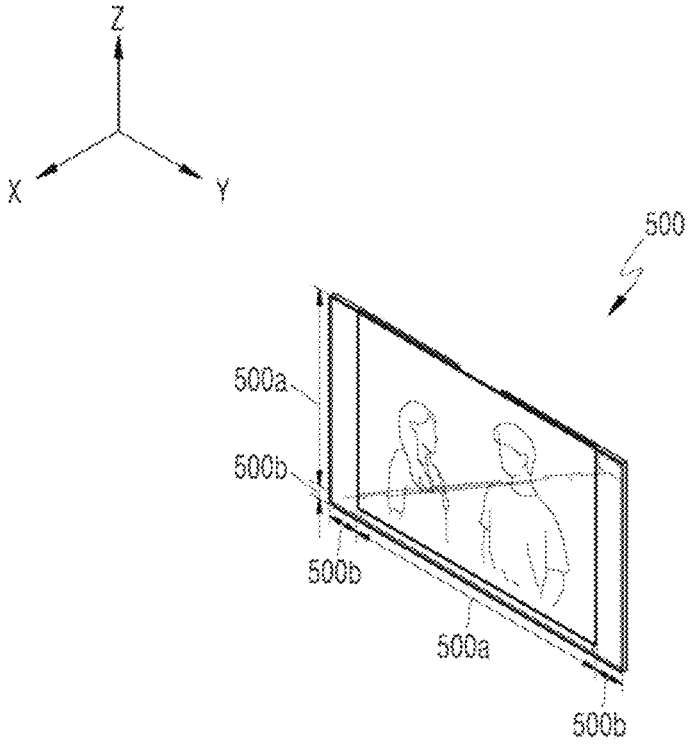
FIG. 25*a* is a perspective view illustrating a state in which the image sheet is inserted into the insertion space of the internal panel.

FIG. 25*a* is a perspective view illustrating a state in which the image sheet 550 is inserted into the insertion space 500*c* of the internal panel 500.

Figure 25B:
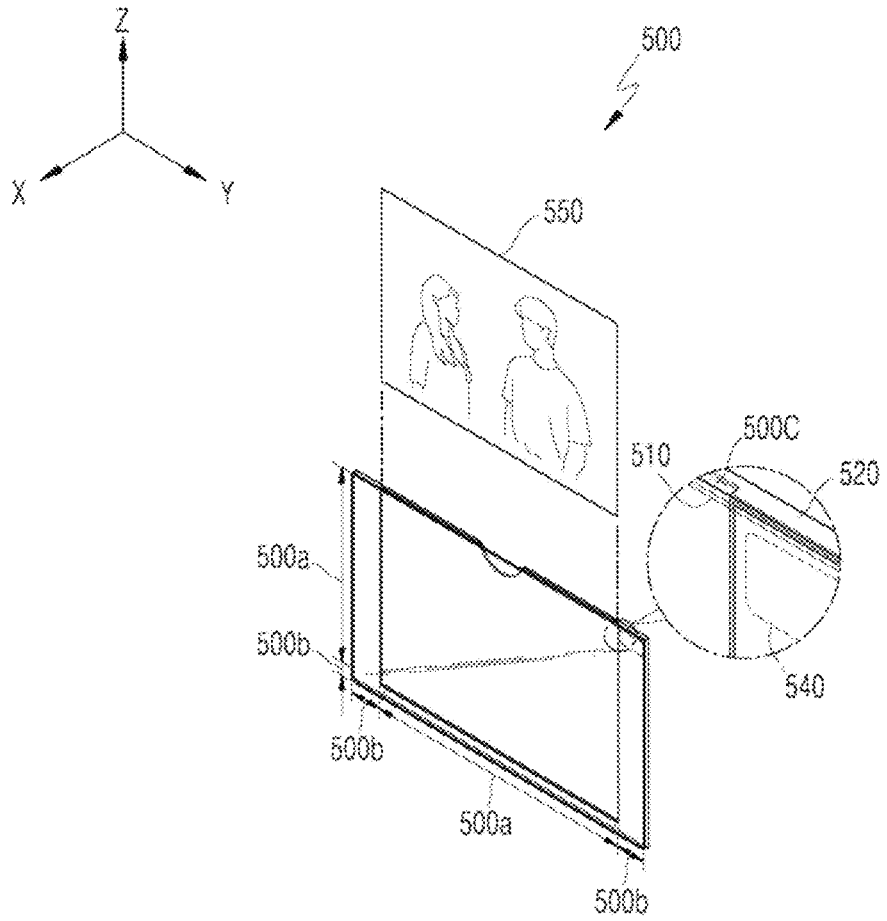
FIG. 25*b* is a perspective view illustrating a state in which the image sheet is withdrawn from the insertion space of the internal panel.
Figure 25C:
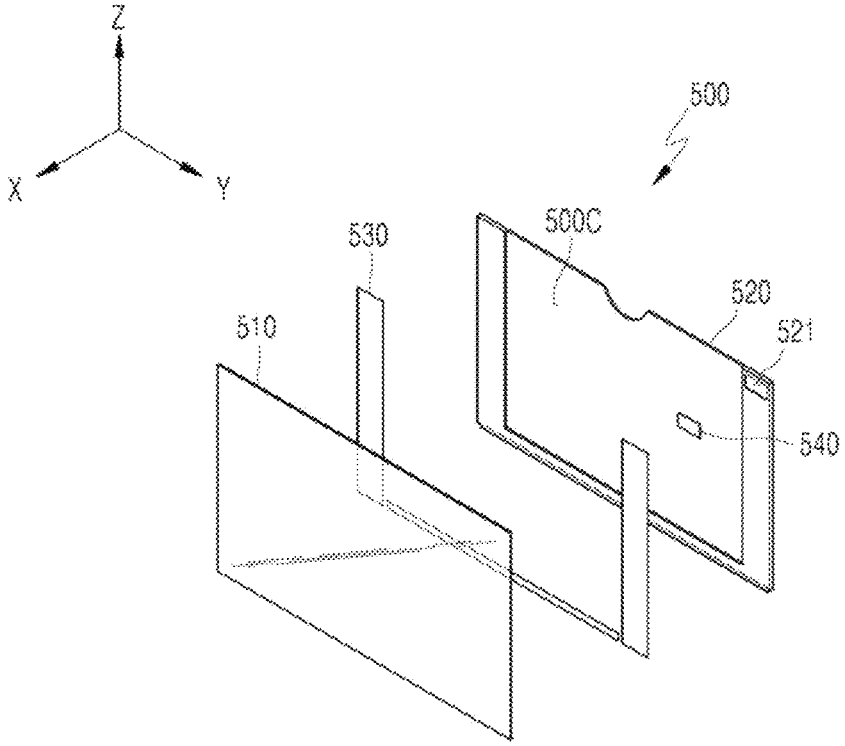
FIG. 25*c* is an exploded perspective view of the internal panel of FIG. 25*b*.

FIG. 25*b* is a perspective view illustrating a state in which the image sheet 550 is withdrawn from the insertion space 500*c* of the internal panel 500. FIG. 25*c* is an exploded perspective view of the internal panel 500 of FIG. 25*b*.

As illustrated in FIGS. 25*a* and 25*b*, the internal panel 500 may include a placement area 500*a* and a border area 500*b*.

The replacement area 500*a* may mean an area forming the insertion space 500*c*. The insertion space 500*c* may mean a space into which the image sheet 550 is insertable. The insertion space 500*c* may be opened to the upper side of the replacement area 500*a*. Therefore, the image sheet 550 may be inserted into the insertion space 500*c* above the replacement area 500*a*.

The image sheet 550 may be formed by a rectangular sheet. The insertion space 500*c* may mean a space corresponding to the shape of the image sheet 550. The insertion space 500*c* may be a space having a hexahedral shape which is narrow in a thickness direction. While the image sheet 550 is coupled to the body 100, the thickness direction of the insertion space 500*c* may be parallel to the first direction X.

The border area 500*b* may mean an area forming a boundary of the insertion space 500*c* on the bottom and both side surface of the replacement area 500*a*. The border area 500*b* may not be provided on the top of the replacement area 500*a*.

That is, the border area 500*b* may not form the boundary of the insertion space 500*c* on the top of the replacement area 500*a*. Therefore, the insertion space 500*c* may be opened to the upper side of the replacement area 500*a*.

As illustrated in FIGS. 25*a* to 25*c*, the replacement area 500*a* may include a front panel 510 and a rear panel 520.

The front panel 510 may penetrate light. The front panel 510 may be made of the transparent or translucent material. The front panel 510 may be manufactured by a glass or resin material.

The front panel 510 may have the rectangular plate shape. As illustrated in FIG. 24*b*, while the internal panel 500 is coupled to the middle body 120, the front panel 510 may form the rear surface of the accommodation space 10.

The second light 420 may illuminate the rear surface of the accommodation space 10. When the internal panel 500 is coupled to the front surface of the middle body 120, the second light 420 may illuminate the front surface of the internal panel 500. The light penetrating the front panel 510 may be reflected on the front surface of the image sheet 550 and exposed to the vision of the user.

The front panel 510 may be manufactured by a material having a large critical angle. The critical angle is an incident angle at which total reflection starts to occur when light is incident on a material having a small refractive index from a material having a large refractive index. When the critical angle is small, transmissivity of the front surface of the front panel 510 is reduced based on the light of the second light to reduce the visibility of the image sheet 550.

As an example, the critical angle of polymethyl methacrylate (PMMA) is 42.0°. The critical angle of polycarbonate (PC) is 40.2°. The critical angle of general purpose polystyrene (GPPS) is 39.3°. Therefore, based on the critical angle, the front panel 510 may be manufactured by PMMA having a largest critical angle among PMMA, PC, and GPPS.

Based on the replacement area 500*a*, the rear panel 520 may be spaced apart from the front panel 510 in the front and rear direction by the insertion space 500*c*. The front panel 510 may have the rectangular plate shape.

As illustrated in FIG. 24*b*, while the internal panel 500 is coupled to the middle body 120, the rear panel 520 may be in close contact with the front surface of the middle body 120.

The internal panel 500 may be selectively coupled to the front surface of the middle body 120. The internal panel 500 may also form the rear surface of the accommodation space 10 while not accommodating the image sheet 550.

While the image sheet 550 is not accommodated in the insertion space 500*c*, the light transmitting the front panel 510 may be reflected on the front surface of the rear panel 520 and exposed to the vision of the user. The rear panel 520 may have the same color as the front surface of the middle body 120. Therefore, even though the internal panel 500 is coupled or not coupled to the middle body 120, the accommodation space 10 may show predetermined aesthetics based on the color.

A part of the upper portion of the rear panel 520 may have a lower height than the front panel 510 at a portion where the insertion space 500*c* is opened.

The front panel 510 and the rear panel 520 may extend to the border area 500*b*. The front panel 510 and the rear panel 520 may be coupled to each other by the adhesive 530.

The adhesive 530 may be provided as an adhesive tape. The thickness of the rear panel 520 may increase in the first direction X in the border area 500*b* further than in the replacement area 500*a*. The insertion space 500*c* may be a space formed by a thickness difference of the rear panel 520 between the replacement area 500*a* and the border area 500*b*.

The internal panel 500 may include one or more first fastening portions 540. A concave portion (hereinafter, referred to as 'concave portion 521') may be formed at the upper portion of the border area 500*b*. The concave portion 521 may be provided in the same number as the first fastening portion 540. The first fastening portion 540 may be inserted into the concave portion 521.

Figure 26:
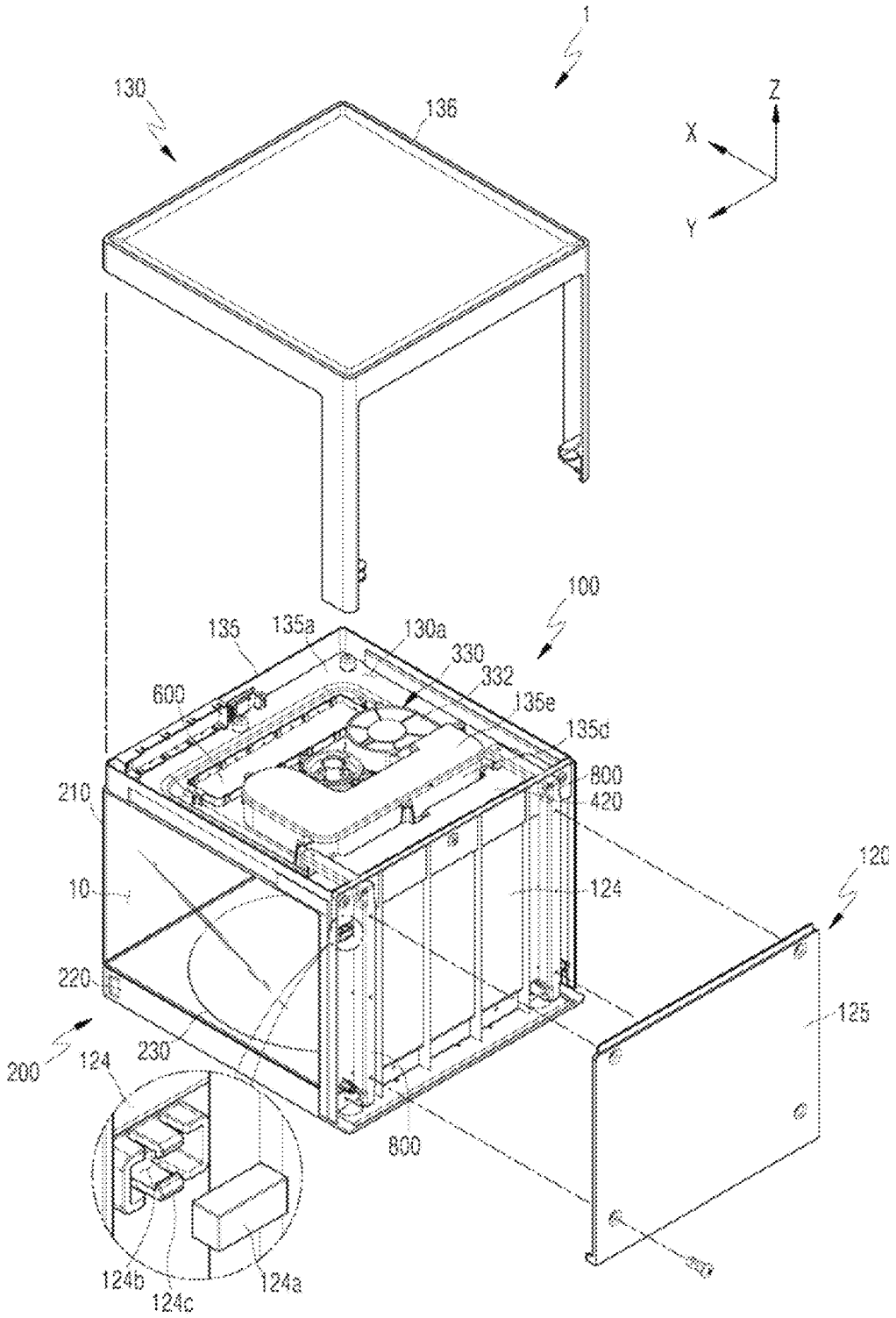
FIG. 26 is a perspective view illustrating a state in which the first external cabinet and the second external cabinet are separated from the body of the showcase of FIG. 1*a*.

FIG. 26 is a perspective view illustrating a state in which the first external cabinet 136 and the second external cabinet 125 are separated from the body 100 of the showcase 1 of FIG. 1*a*.

As illustrated in FIG. 26, the middle body 120 may include one or more second fastening portions 124*a*. The second fastening portion 124*a* may be provided in the same number as the first fastening portion 540.

The middle body 120 may include a second internal cabinet 124 and a second external cabinet 125. The first external cabinet 136 and the second external cabinet 125 may be coupled to the second internal cabinet 124 by a plurality of bolts.

The first internal cabinet 135 and the second internal cabinet 124 may be coupled to a frame body 800. The frame body 800 may be a component that forms a frame of the body 100.

The strength of the body 100 may be reinforced by the frame body 800.

A fastening groove 124*b* may be formed on the rear surface of the second internal cabinet 124. The second fastening portion 124*a* may be inserted into the fastening groove 124*b*. A fastening protrusion 124*c* may be formed on the inner surface of the fastening groove 124*b*. The fastening protrusion 124*c* may prevent detachment of the second fastening portion 124*a* inserted into the fastening groove 124*b*.

At least any one of the first fastening portion 540 and the second fastening portion 124*a* may include a magnet. The magnet may be a permanent magnet. The first fastening portion 540 and the second fastening portion 124*a* may form an attraction by the magnetic force.

As an example, the first fastening portion 540 and the second fastening portion 124*a* may be the permanent magnets. Alternatively, any one of the first fastening portion 540 and the second fastening portion 124*a* may be the permanent magnet, and the other one of the first fastening portion 540 and the second fastening portion 124*a* may be a ferromagnetic substance such as iron, cobalt, nickel, and an alloy.

Hereinafter, for easy understanding of the present invention, a case where the moving body 200 is at a 'first location' (see FIGS. 1*a* and 1*b*) is intended to be defined as a 'closed state'. When the moving body 200 is at the first location, the accommodation space 10 may be closed.

In addition, a case where the moving body 200 is at a 'second location' (see FIGS. 2*a* and 2*b*) is intended to be defined as an 'opened state'. That is, when the moving body 200 is at the second location, the accommodation space 10 may be opened.

The body 100 may include the lower body 110. The lower body 110 may be positioned below the accommodation space 10. The base 220 may be movably coupled to the lower body 110 between the first location and the second location.

The first window 211, the second window 212, and the third window 213 may be coupled to the base 220. The second window 212 may form a second gap from the middle body 120 at the second location. The third window 213 may form a third gap from the middle body 120 at the second location.

Figure 27A:
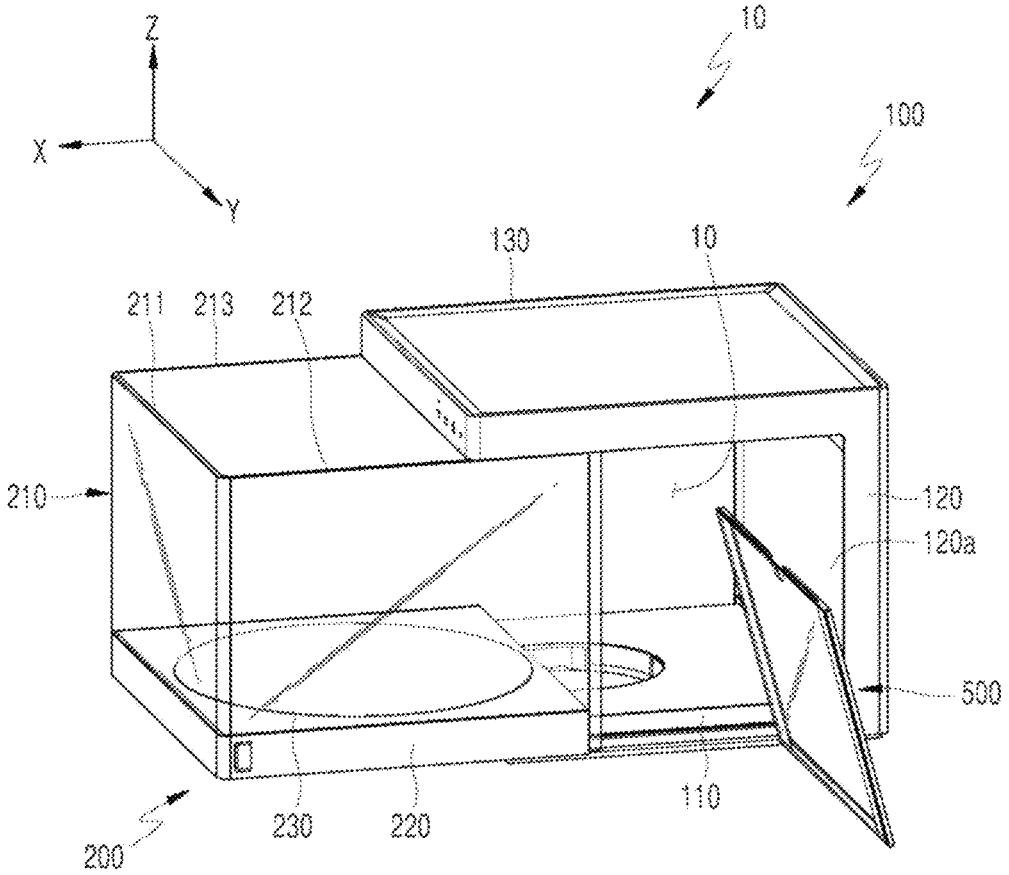
FIG. 27*a* as a perspective view illustrating the opened state of the accommodation space of the showcase of FIG. 1*a* is a diagram illustrating a state in which the internal panel moves through the second gap.

FIG. 27*a* as a perspective view illustrating the opened state of the accommodation space 10 of the showcase 1 of FIG. 1*a* is a diagram illustrating a state in which the internal panel 500 moves through the second gap.

Figure 27B:
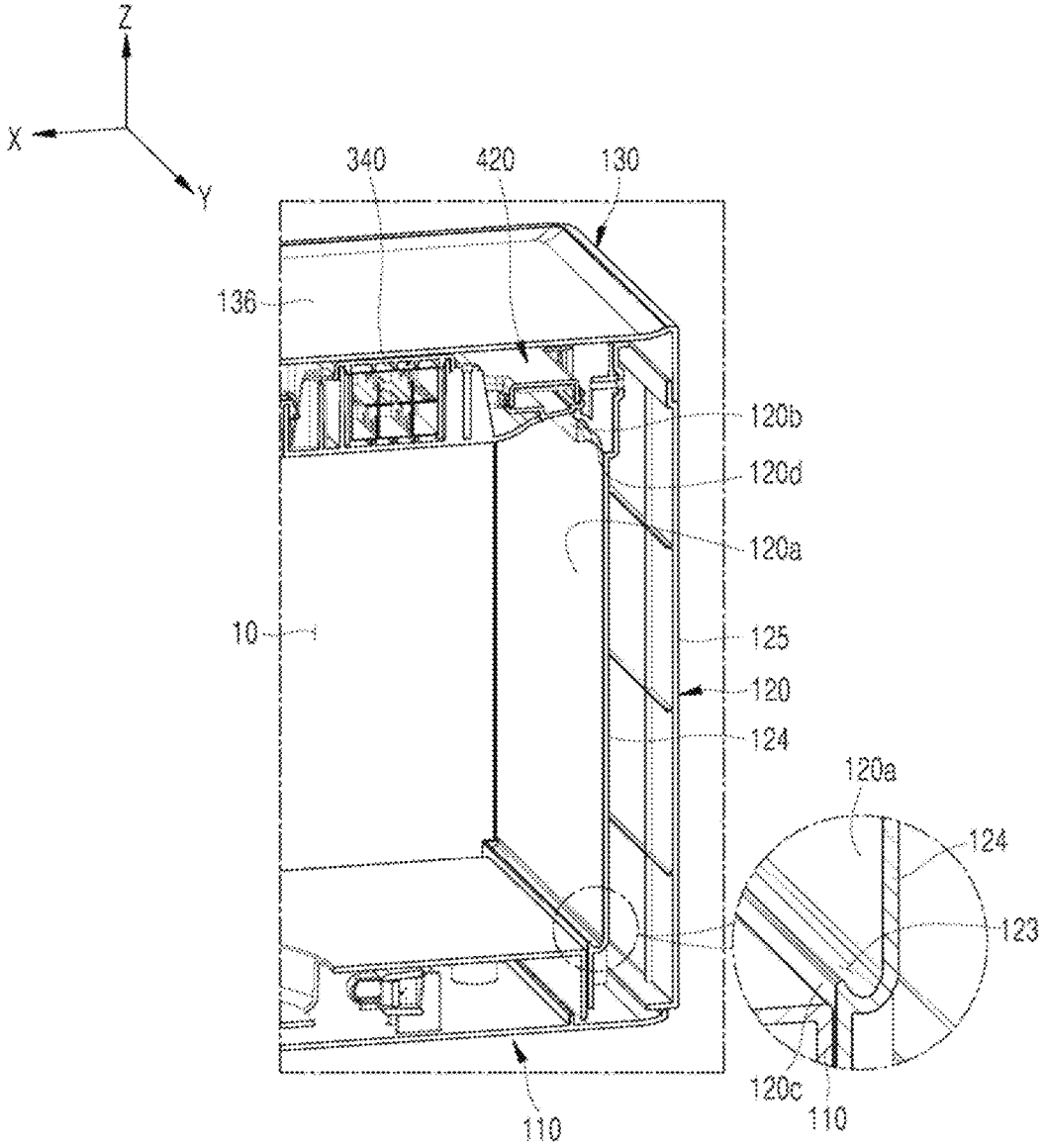
FIG. 27*b* is a partial cross-sectional view of the showcase of FIG. 27*a*.

FIG. 27*b* is a cross-sectional view illustrating the opened state of the accommodation space 10 of the showcase 1 of FIG. 27*a*.

As illustrated in FIG. 27*a*, while the accommodation space 10 is opened, the user may put the internal panel 500 into the accommodation space 10 or withdraw the internal panel 500 from the accommodation space 10 through the second gap. Alternatively, the user may put the internal panel 500 into the accommodation space 10 or withdraw the internal panel 500 from the accommodation space 10 through the third gap while slightly tilting the internal panel 500.

Therefore, the body 100 may include the middle body 120 that forms the rear surface of the accommodation space 10 jointly with the internal panel 500. While the internal panel 500 is separated from the middle body 120, the front surface of the middle body 120 may form the rear surface of the accommodation space 10.

As illustrated in FIG. 27*b*, a fixation groove 123 may be formed at the lower portion of the front surface of the middle body 120. The fixation groove 123 may elongate in the second longitudinal direction Y. The fixation groove 123 may be formed to be concave downward. The inner surface of the fixation groove 123 may have a predetermined curvature.

The normal line of a front surface in the first direction X of the inner surface of the fixation groove 123 may be tilted in the first direction X based on the third direction Z. Therefore, the lower portion of the internal panel 500 may be rotatable at a predetermined angle while being inserted into the fixation groove 123.

The front surface of the middle body 120 may include a first middle front surface 120*a*, a second middle front surface 120*b*, a third middle front surface 120*c*, and a guide surface 120*d*.

The first middle front surface 120*a* may mean a surface closely contacting the internal panel 500. The first middle front surface 120*a* may be provided below the fixation groove 123. The first middle front surface 120*a* may be connected to the inner surface of the fixation groove 123. A rear surface in the first direction X of the inner surface of the fixation groove 123 may be connected to the first middle front surface 120*a*.

The second middle front surface 120*b* may be positioned above the first middle front surface 120*a*. The second middle front surface 120*b* may be provided before the first middle front surface 120*a* in the first direction X.

The third middle front surface 120*c* may be positioned below the first middle front surface 120*a*. The third middle front surface 120*c* may be provided below the fixation groove 123. The third middle front surface 120*c* may be provided before the first middle front surface 120*a* in the first direction X. The base 220 may cover the third middle front surface 120*c* in the closed state.

The guide surface 120*d* may be positioned above the first middle front surface 120*a* jointly with the second middle front surface 120*b*. The guide surface 120*d* may be positioned at the center of the second middle front surface 120*b* based on the second direction Y. The guide surface 120*d* may be positioned behind the second middle front surface 120*b*. The guide surface 120*d* may form a curved surface provided behind the second middle front surface 120*b* downward.

Figure 28A:
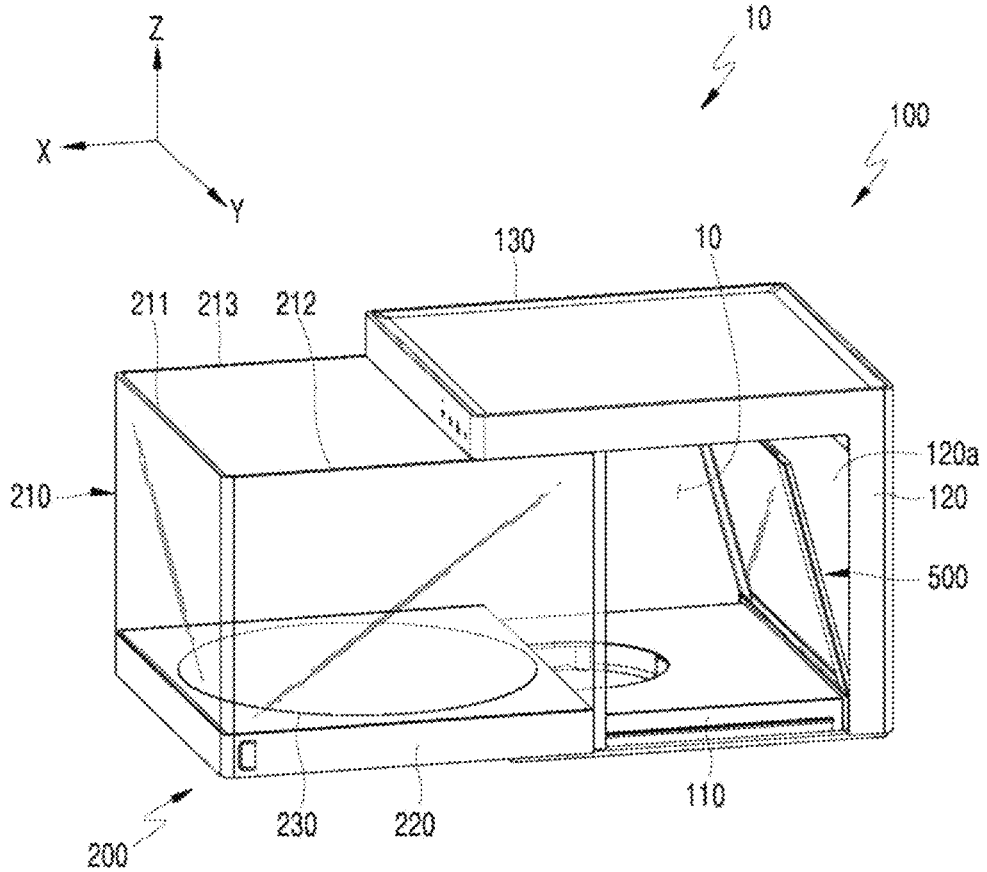
FIG. 28*a* as a perspective view illustrating the opened state of the accommodation space of the showcase of FIG. 1*a* is a diagram illustrating a state in which the lower portion of the internal panel is inserted into the fixation groove.

FIG. 28*a* as a perspective view illustrating the opened state of the accommodation space 10 of the showcase 1 of FIG. 1*a* is a diagram illustrating a state in which the lower portion of the internal panel 500 is inserted into the fixation groove 123.

Figure 28B:
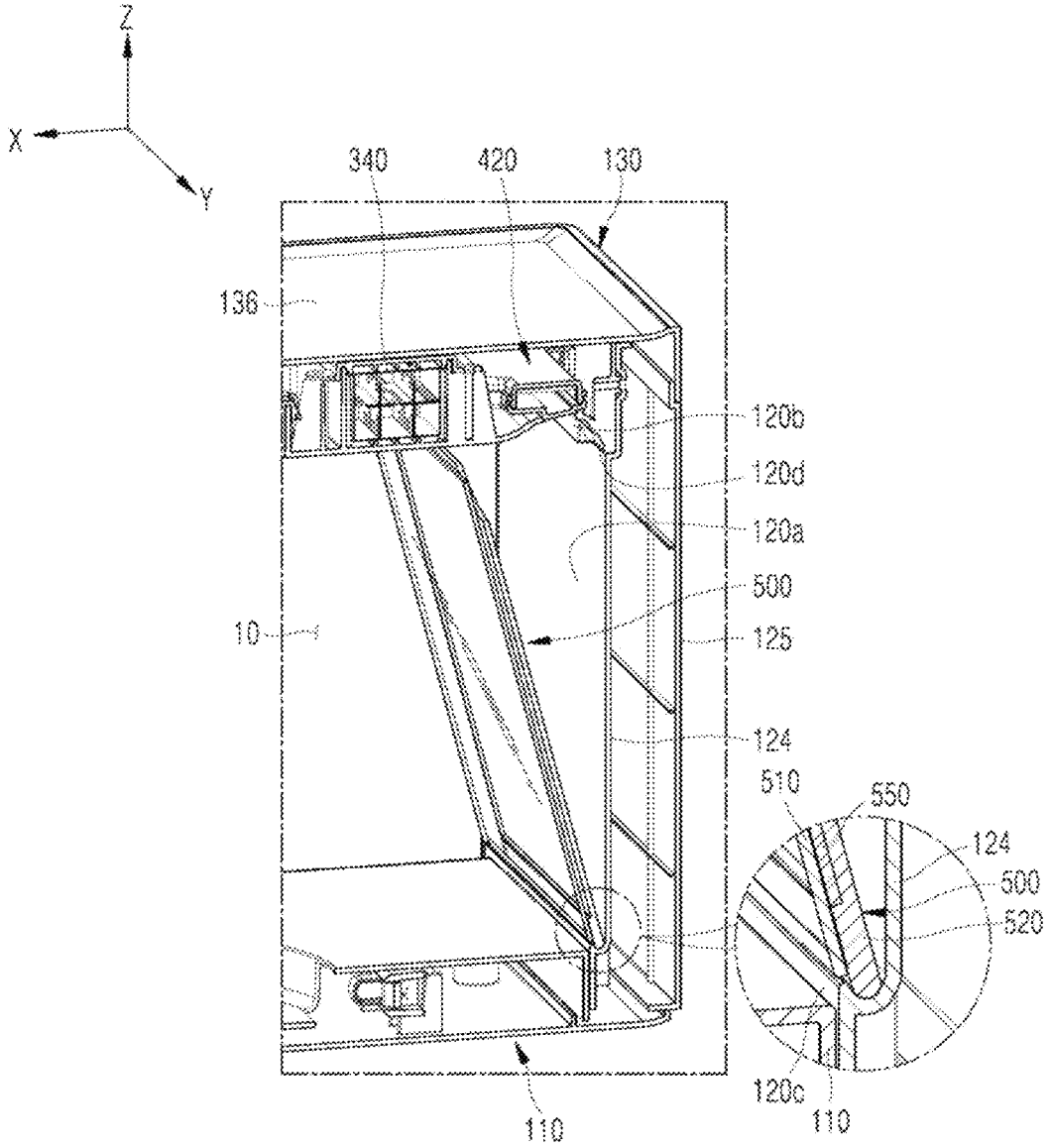
FIG. 28*b* is a partial cross-sectional view of the showcase of FIG. 28*a*.

FIG. 28*b* is a cross-sectional view illustrating the opened state of the accommodation space 10 of the showcase 1 of FIG. 28*a*.

As illustrated in FIGS. 28*a* and 28*b*, while the accommodation space 10 is opened, the user may insert the lower portion of the internal panel 500 into the fixation groove 123. The user may insert the lower portion of the internal panel 500 into the fixation groove 123 while being tilted slightly forward.

The bottom of the internal panel 500 may form the curved surface. The bottom of the internal panel 500 may have a curvature corresponding to the inner surface of the fixation groove 123. Therefore, the lower portion of the internal panel 500 may rotate while smoothly sliding on the inner surface of the fixation groove 123 while being inserted into the fixation groove 123.

Figure 29A:
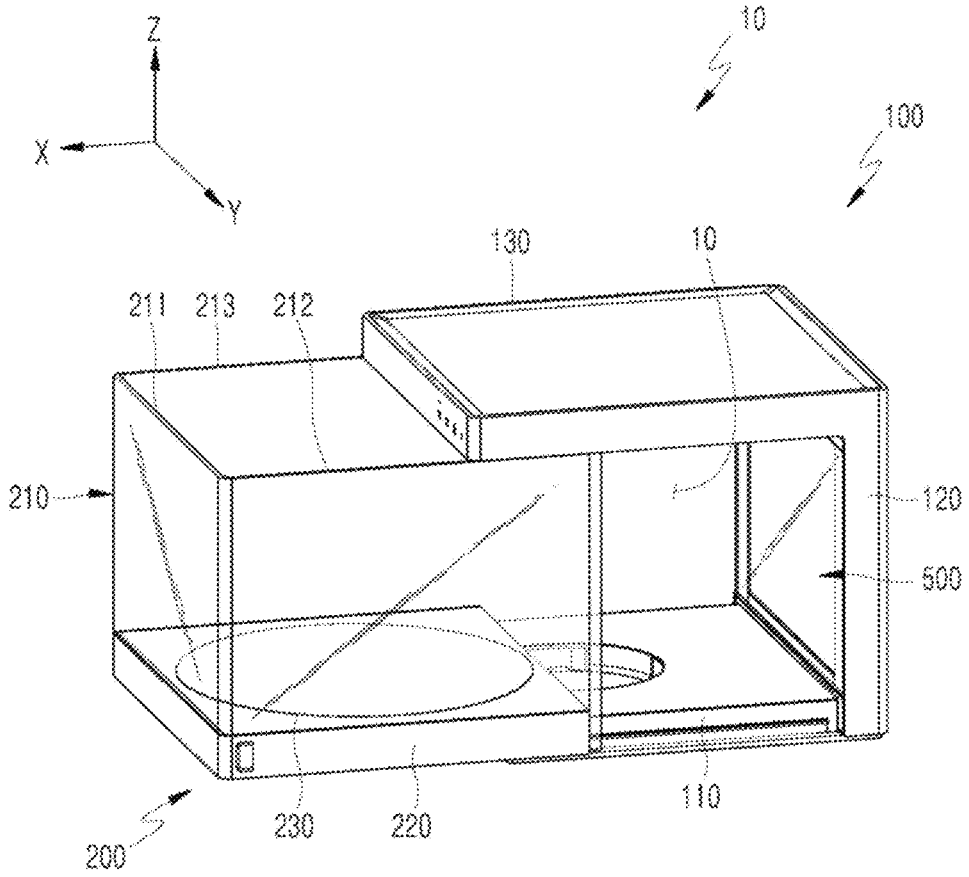
FIG. 29*a* as a perspective view illustrating the opened state of the accommodation space of the showcase of FIG. 1*a* is a diagram illustrating a state in which the internal panel is coupled to the middle body.

FIG. 29*a* as a perspective view illustrating the opened state of the accommodation space 10 of the showcase 1 of FIG. 1*a* is a diagram illustrating a state in which the internal panel 500 is coupled to the middle body 120.

Figure 29B:
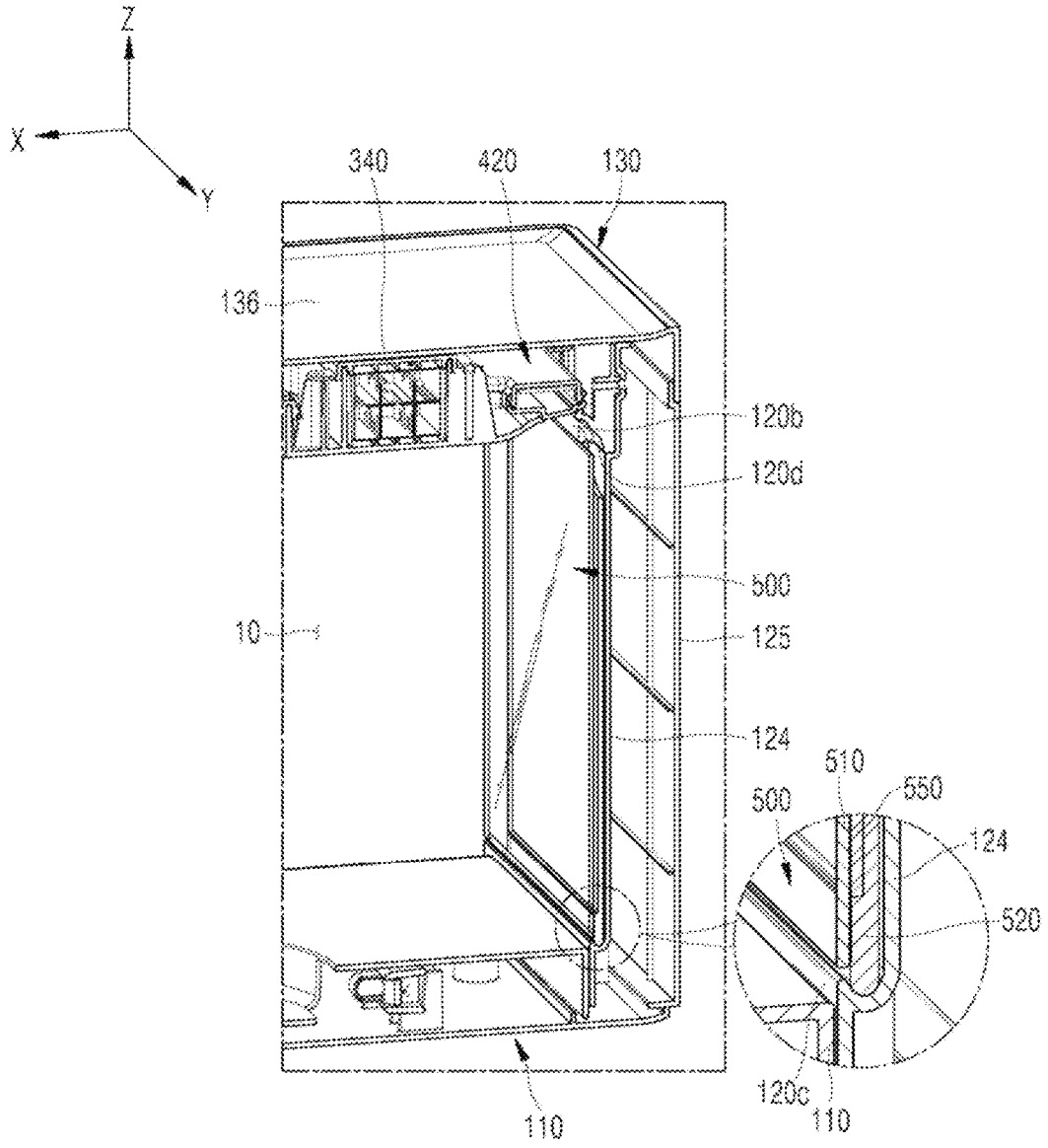
FIG. 29*b* is a partial cross-sectional view of the showcase of FIG. 29*a*.

FIG. 29*b* is a cross-sectional view illustrating the opened state of the accommodation space 10 of the showcase 1 of FIG. 29*a*.

As illustrated in FIGS. 29 and 29*b*, the internal panel 500 rotates around the fixation groove 123 to form the rear surface of the accommodation space 10 to be in close contact with the first middle front surface 120*a*.

The front surface of the internal panel 500 may be positioned below the second middle front surface 120*b*. As the internal panel 500 is in close contact with the first middle front surface 120*a*, the front surface of the internal panel 500 may form the rear surface of the accommodation space 10 jointly with the second middle front surface 120*b*.

In this state, the front surface of the internal panel 500 may form the same location as the second middle front surface 120*b* in the first direction X. Therefore, the front surface of the internal panel 500 and the second middle front surface 120*b* may be observed as an integrated surface. Therefore, the view viewing the shoe S is not distributed to the rear surface of the accommodation space 10 to enhance the display effect of the shoe S.

Figure 30:
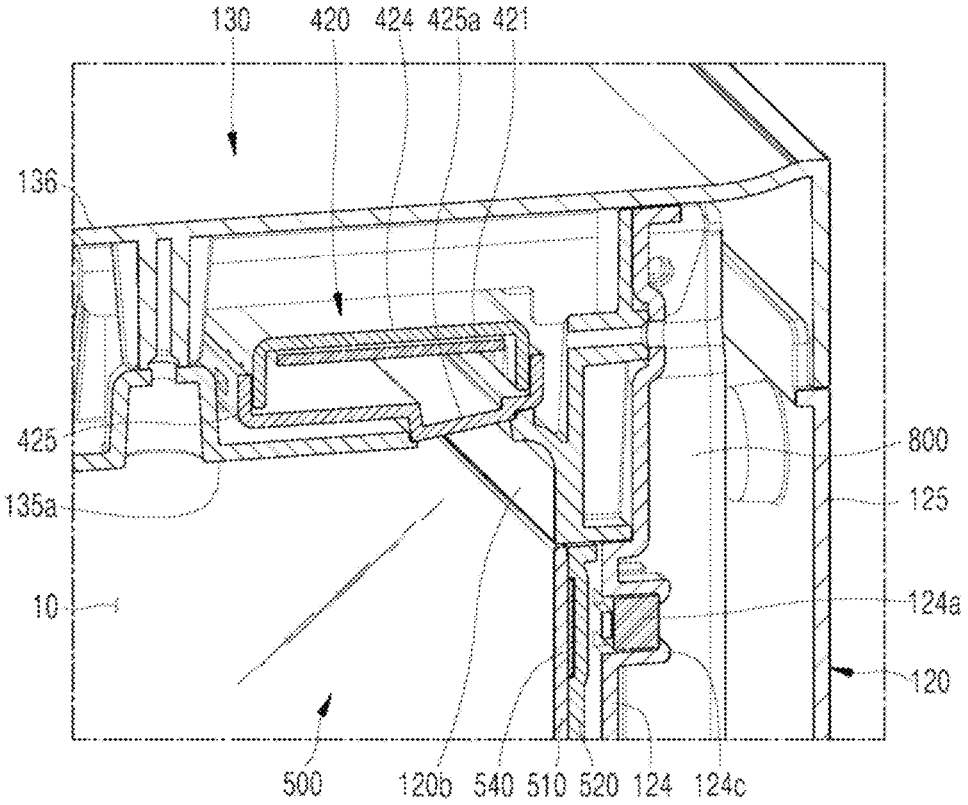
FIG. 30 as a partial cross-sectional view of the showcase of FIG. 1*a* is a diagram illustrating a state in which the first fastening portion and the second fastening portion form a coupling force to each other.

FIG. 30 as a partial cross-sectional view of the showcase 1 of FIG. 1*a* is a diagram illustrating a state in which the first fastening portion 540 and the second fastening portion 124*a* form a coupling force to each other.

As illustrated in FIG. 30, as the internal panel 500 rotates around the fixation groove 123, the first fastening portion 540 may be positioned before the second fastening portion 124*a* in the first direction X. While the internal panel 500 is in close contact with the first middle front surface 120*a*, the first fastening portion 540 and the second fastening portion 124*a* may form the coupling force to each other.

Therefore, as the internal panel 500 rotates around the fixation groove 123, the first fastening portion 540 and the second fastening portion 124*a* form the coupling force to each other, and as a result, the internal panel 500 may be in close contact with the front surface of the middle body 120. Therefore, even though an unintended impact is not delivered to the showcase 1, the internal panel 500 may solidly maintain the state of being in close contact with the front surface of the middle body 120.

The first fastening portion 540 may be a ferromagnetic substance such as iron, cobalt nickel, and an alloy thereof. In addition, the second fastening portion 124*a* may be the permanent magnet. Therefore, as the internal panel 500 rotates around the fixation groove 123, the first fastening portion 540 and the second fastening portion 124*a* may form the attraction by the magnetic force.

In the process in which the user rotates the internal panel 500 around the fixation groove 123, when the attraction by the magnetic force between the first fastening portion 540 and the second fastening portion 124*a* exceeds the rotational force of the internal panel 500 by the gravity, the internal panel 500 rotates by the attraction by the magnetic force between the first fastening portion 540 and the second fastening portion 124*a* to be in close contact with the front surface of the middle body 120.

In this process, the internal panel 500 may move in the second direction Y so that the first fastening portion 540 is positioned just before the second fastening portion 124*a* in the first direction X by the attraction by the magnetic force between the first fastening portion 540 and the second fastening portion 124*a*.

Therefore, the internal panel 500 may be in close contact with the front surface of the middle body 120 at a predetermined location at all times based on the second direction Y by the attraction by the magnetic force between the first fastening portion 540 and the second fastening portion 124*a*.

As illustrated in FIG. 29*b*, while the internal panel 500 is in close contact with the first middle front surface 120*a*, the lower portion of the guide surface 120*d* may be provided behind the front panel 510. In addition, the top of the rear panel 520 may have a lower height than the front panel 510 below the guide surface 120*d*. Therefore, while the internal panel 500 is in close contact with the first middle front surface 120*a*, the lower portion of the guide surface 120*d* may be positioned behind the upper portion of the front panel 510 in the first direction X.

Therefore, while the internal panel 500 is in close contact with the first middle front surface 120*a*, the lower portion of the guide surface 120*d* and the upper portion of the front panel 510 may form a gap in the first direction X.

While the accommodation space 10 is opened, the user may put a finger between the lower portion of the guide surface 120*d* and the upper portion of the front panel 510. In this case, when the front panel 510 is pulled forward in the first direction X with the finger, the internal panel 500 rotates around the fixation groove 123, and as a result, a close contact state of the first middle front surface 120*a* may be released.

As illustrated in FIG. 28*a*, as the state in which the internal panel 500 is in close contact with the first middle front surface 120*a*, the user may withdraw the internal panel 500 from the accommodation space 10 through the second gap and the third gap.

The user may withdraw the internal panel 500 from the accommodation space 10 through the second gap and the third gap while slightly tilting the internal panel 500. The user may replace the image sheet 550 accommodated in the internal panel 500.

Figure 31A:
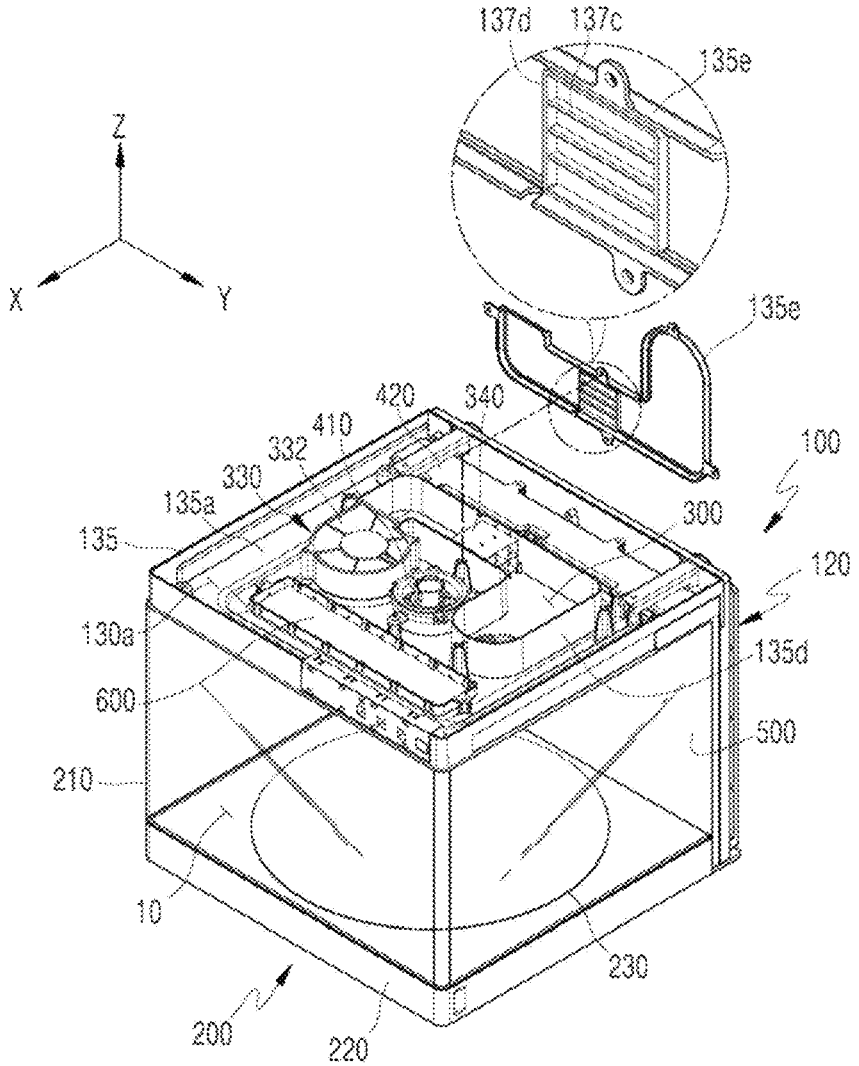
FIG. 31*a* is a perspective view illustrating a state in which the first external cabinet is removed from the body of the showcase of FIG. 1*a*.

FIG. 31*a* is a perspective view illustrating a state in which the first external cabinet 36 is removed from the body 100 of the showcase 1 of FIG. 1*a*. FIG. 31*a* illustrates a state in which a path cover 135*e* of the air path 300 is separated.

Figure 31B:
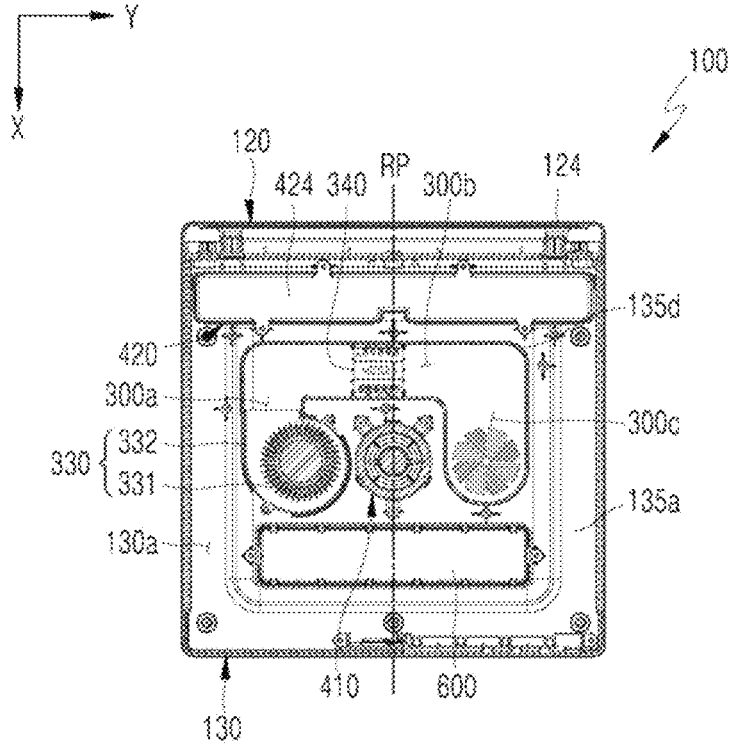
FIG. 31*b* is a cross-sectional view of the showcase of FIG. 3*a* taken along line B-B.

FIG. 31*b* is a cross-sectional view of the showcase 1 of FIG. 3*a* taken along line B-B.

As illustrated in FIGS. 31*a* and 31*b*, the showcase 1 according to the embodiment of the present invention may include the body 100, the moving body 200, the blowing part 330, the first light 410, and the air path 300.

The body 100 and the moving body 200 may form the accommodation space 10 accommodating the shoe S jointly. The body 100 and the moving body 200 may be coupled to move with respect to each other. The moving body 200 may be coupled to the body 100 to reciprocally move in the front and rear direction.

The body 100 may include the upper body 130. The upper body 130 may be positioned above the accommodation space 10. The upper body 130 may have an upper space 130*a* of which gas flow is disconnected from the accommodation space therein. The upper space 130*a* may have a hexahedral shape in which lengths in the first direction X and the second direction Y are larger than a length in the third direction Z.

The upper body 130 may include a first internal cabinet 135 and a first external cabinet 136. The first internal cabinet 135 and the first external cabinet 136 may form the accommodation space 10 jointly.

As illustrated in FIG. 31*a*, the first internal cabinet 135 may have a rectangular box shape opened upward. The first internal cabinet 135 may have an air path 300 connected to the accommodation space 10. The first internal cabinet 135 may include the upper bottom plate 135*a*, a path barrier 135*d*, and the path cover 135*e*.

The upper bottom plate 135*a* may partition the accommodation space 10 and the upper space 130*a*. The upper bottom plate 135*a* may have a plate shape which is wide in the horizontal direction. The lower surface of the upper bottom plate 135*a* may form the upper surface of the accommodation space 10.

The upper surface of the top bottom plate 135*a* may form the bottom of the upper space 130*a*. The suction port 310 and the discharge port 420 may be formed on the upper bottom plate 135*a*. The air in the accommodation space 10 may be suctioned into the air path 300 through the suction port 310. The air in the air flow path 300 may be discharged to the accommodation space 10 through the discharge port 320.

The accommodation space 10 may exchange thermal energy with outside air through the first external cabinet 136. Therefore, the temperature of the accommodation space 10 may vary depending on the temperature of the outside air. The air path 300 is provided above the accommodation space 10, and the air flow the air path 300 to/from the upper space 130*a* may be stopped.

Therefore, the showcase 1 according to the embodiment of the present invention may control the temperature of air circulated in the accommodation space 10 and the air path 300 regardless of the temperature variation of the outside air. Therefore, the accommodation space 10 may maintain an optimal temperature at which the shoe S may be appropriately kept.

The blowing part 330 is a component that circulates the air in the accommodation space 10 and the air path 300. The blowing part 330 and the air path 300 may be provided above the upper bottom plate 135*a*.

The blowing part 330 may include the fan 331 and the fan housing 332. The fan 331 may pressure-feed the air by the rotary movement of the impeller. The fan 331 may be provided inside the air path 300.

A power supply (not illustrated) may be provided in the base 220. The power supply may supply power to the fan 331. The controller 600 may control the power supplied to the fan 331 from the power supply.

The fan housing may be coupled to the top of the upper bottom plate 135*a* above the suction port 310. The fan housing 332 may be provided inside the air path 300 above the suction port 310. Alternatively, the fan housing 332 may constitute a part of the air path 300 above the suction port 310.

The path barrier 135*d* may protrude upward on the top of the upper bottom plate 135*a*. The path barrier 135*d* may form a side all of the air path 300 jointly with the fan housing 332.

The path cover 135*e* may close an upper opening of the path barrier 135*d*. The path cover 1353 may form a ceiling portion of the air path 300 jointly with the fan housing 332. The path cover 135*e* may be detachably coupled to the upper bottom plate 135*e* by the bolt.

Figure 32A:
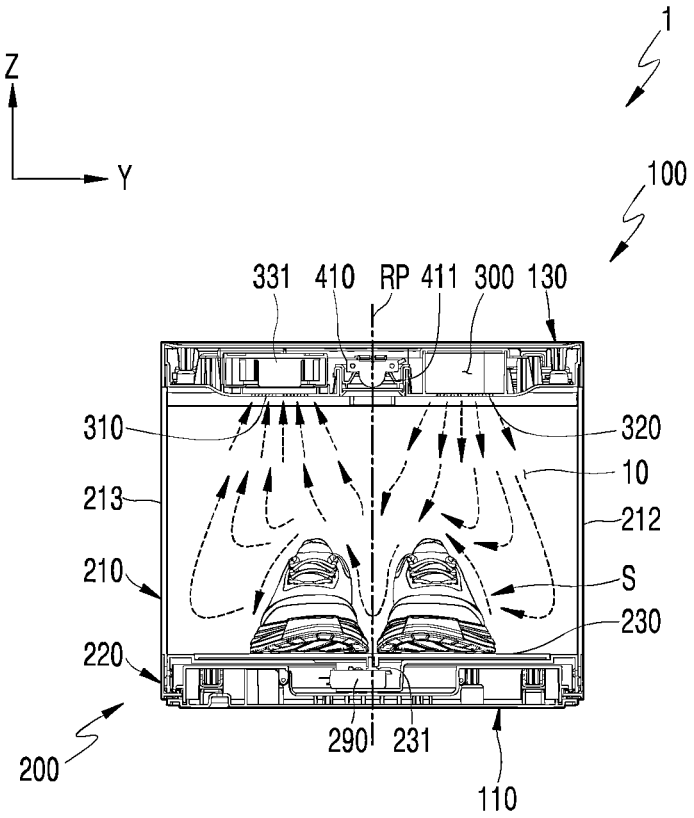
FIG. 32*a* is a cross-sectional view of the showcase of FIG. 3*b* taken along line C-C.

FIG. 32*a* is a cross-sectional view of the showcase 1 of FIG. 3*b* taken along line C-C. FIG. 32*a* illustrates an air flow in the accommodation space while the front side of the shoe S faces the front side in the first direction X.

Figure 32B:
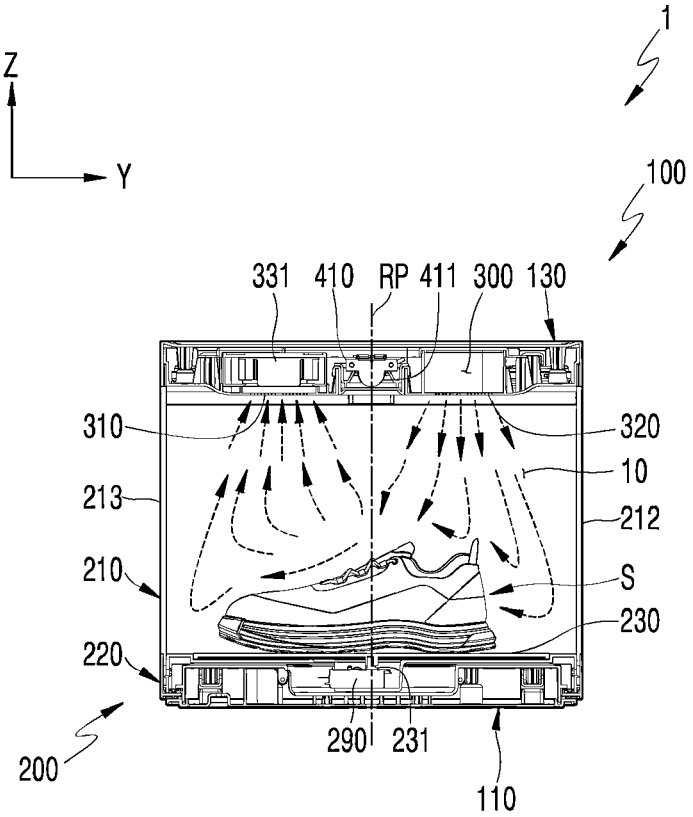
FIG. 32*b* illustrates the air flow in the accommodation space while the front side of the shoe faces the rear side in the second direction.

FIG. 32*b* is a cross-sectional view of the showcase 1 of FIG. 3*b* taken along line C-C. FIG. 32*b* illustrates the air flow in the accommodation space while the front side of the shoe S faces the rear side in the second direction Y.

As illustrated in FIGS. 32*a* and 32*b*, the moving body 200 may include the base 220, the turntable 230, and the transparent window 210.

The body 100 may include the lower body 110. The lower body 110 may be positioned below the accommodation space 10. The base 220 may be coupled to the lower body 110 to be relatively movable in the front and rear direction so as to open/close the accommodation space 10. The transparent window 210 may be coupled to the base 220. The transparent window 210 may form the front surface, and both side surfaces (the left surface and the right surface) of the accommodation space 10.

The turntable 230 may be rotatably coupled to the base 220 around a vertical axis 231. The base 220 and the turntable 230 may form the lower surface of the accommodation space 10 jointly. The upper surface of the turntable 230 may have the circular shape around the vertical axis 231.

The motor 290 may be provided in the base 220. The motor 290 may deliver the rotary movement to the turntable 230. The rotational axis 231 of the turntable 230 may be in line with the vertical direction. The axis of the motor 290 may be directly coupled to the rotational axis 231 of the turntable 230.

The first light 410 may irradiate light to the top of the turntable 230 on which the shoe S is placed on the extension line of the vertical axis 231. The first light 410 may be coupled to the upper bottom plate 135*a*.

As illustrated in FIG. 31*b*, the suction port 310 and the discharge port 320 of the air path 300 may be formed at opposite sides to each other in the horizontal direction based on the first light 410. A path of the air path 300 may be formed along a horizontal circumference of the first light 410.

The first light 410 may be provided on the extension line of the vertical axis 231. Therefore, the suction port 310 and the discharge port 320 of the air path 300 may be formed at opposite sides to each other in the horizontal direction based on the extension line of the vertical axis 231. The accommodation space 10 may be parallel to the first direction X which is the horizontal direction and form the symmetry based on the reference surface RP which is the vertical surface. The extension line of the vertical axis 231 may be positioned within the reference plane RP.

As the first light 410 and the air path 300 are placed in the upper space 130*a* in the horizontal direction, the upper space 130*a* may be formed to have a low height. An increase in height of the upper space 130*a* may be in proportion to an increase in volume of the showcase 1. A volume increase of home appliances may be a major factor which reduces installability and usability, and raises product prices.

The first light 410 and the air path 300 are placed in the upper space 130*a* in the horizontal direction, and as a result, the upper space 130*a* may be efficiently utilized, and the installability and usability of the showcase 1 may be increased.

As an example, the suction port 310 and the discharge port 320 of the air path 300 may be formed at opposite sides to each other based on the first light 410. In this case, the path of the air path 300 may be formed along the horizontal circumference of the first light before or behind the first light 410 in the first direction X.

Alternatively, the suction port 310 and the discharge port 320 of the air path 300 may also be formed at opposite sides to each other in the front and rear direction based on the first light 410. In this case, the path of the air path 300 may be formed along the horizontal circumference of the first light 410 before or behind the first light 410 in the second direction Y.

A placement form of the suction port 310, the discharge port 320, and the air path 300 based on the first light 410 may be decided in association with the placement of the controller 600 and the second light 420.

When the controller 600 is placed in front in the second direction Y in the upper space 130*a*, the suction port 310 and the discharge port 320 of the air path 300 may be formed at opposite sides to each other in the front and rear direction based on the first light 410. In this case, the path of the air path 300 may be formed along the horizontal circumference of the first light 410 behind the first light 410 in the second direction Y.

Alternatively, when the controller 600 is placed in the rear in the second direction Y in the upper space 130*a*, the suction port 310 and the discharge port 320 of the air path 300 may be formed at opposite sides to each other in the front and rear direction based on the first light 410. In this case, the path of the air path 300 may be formed along the horizontal circumference of the first light 410 before the first light 410 in the second direction Y.

As illustrated in FIG. 31*b*, when the controller 600 is placed in front in the first direction X in the upper space 130*a*, the suction port 310 and the discharge port 320 of the air path 300 may be formed at opposite sides to each other in the left and right direction based on the first light 410. In this case, the path of the air path 300 may be formed along the horizontal circumference of the first light 410 behind the first light 410 in the first direction X.

As illustrated in FIGS. 32*a* and 32*b*, the suction port 310 and the discharge port 320 may form the same gap from the vertical axis 231. That is, the suction port 310 and the discharge port 320 of the air path 300 may be formed at opposite sides to each other in the horizontal direction based on the vertical axis 231, and spaced apart with the same gap from the vertical axis 231.

Therefore, an area where the air drops descends at the discharge port 320 as a starting point and an area where the air rises at the suction port 310 as an ending point in the accommodation space 10 are parallel to the first direction X which is the horizontal direction, and are divided based on the reference plane RP which is the vertical plane, and as a result, the air circulation in the accommodation space 10 may be smooth. Further, even though a direction in which the shoe S is placed is changed while the turntable 230 rotates, a uniform air flow may be formed on the entire surface of the shoe S placed on the top.

As illustrated in FIGS. 31*a* and 31*b*, the air path 300 may include a first path 300*a*, a second path 300*b*, and a third 300*c*.

The first path 300*a* may be formed to extend to the rear side in the first direction X from the upper portion of the suction port 310. The first path 300*a* may form a path in which the air in the accommodation space 10 suctioned from the suction port 310 by the blowing part 330 flows to the rear in the first direction X.

The fan housing may form a part of the first path 300*a*. The path barrier 135*d* constituting the first path 300*a* may be coupled to a side portion of the fan housing 332. The path cover 1353 constituting the first path 300*a* may be coupled to a top portion of the fan housing 332. The upper bottom plate 135*a* may form the bottom of the first path 300*a*.

The third path 300*c* may be formed to extend to the rear side in the first direction X from the upper portion of the discharge port 320. The third path 300*c* may form a path in which the air in the second path 300*b* flows to the front in the first direction X. The air in the third path 300*c* may be discharged to the accommodation space 10 through the discharge port 320.

The second path 300*b* may be formed to connect the first path 300*a* and the third path 300*c* in the second direction Y. The second path 300*b* may form a path in which the air in the first path 300*a* flows to the front in the second direction Y. The heating part 340 may be provided in the second path 300*b*. The heating part 340 may deliver thermal energy to the air which moves in the air path 300.

The path barrier 135*d* may form side surfaces of the second path 300*b* and the third path 300*c*. The path cover 1353 may form tops of the second path 300*b* and the third path 300*c*. The upper bottom plate 135*a* may form bottoms of the second path 300*b* and the third path 300*c*.

Figure 33:
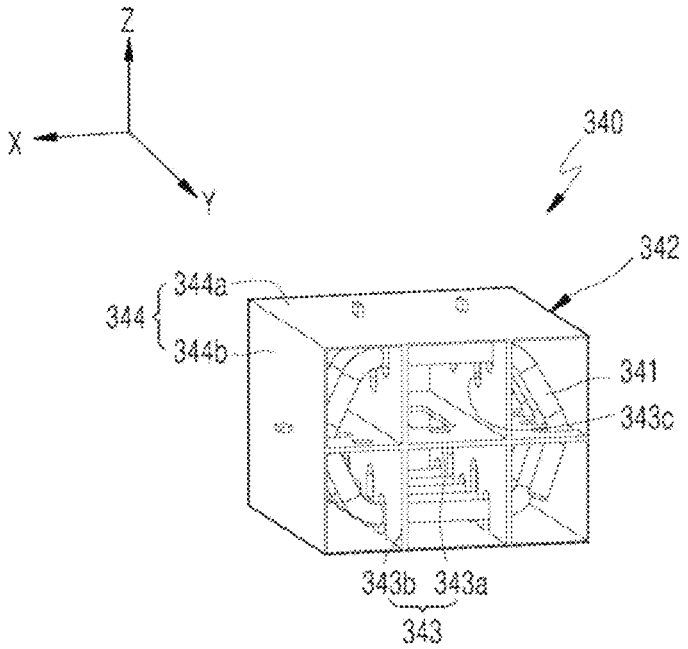
FIG. 33 is a perspective view illustrating the heating part of the showcase of FIG. 31*a*.

FIG. 33 is a perspective view illustrating the heating part 340 of the showcase 1 of FIG. 31*a*.

Figure 34:
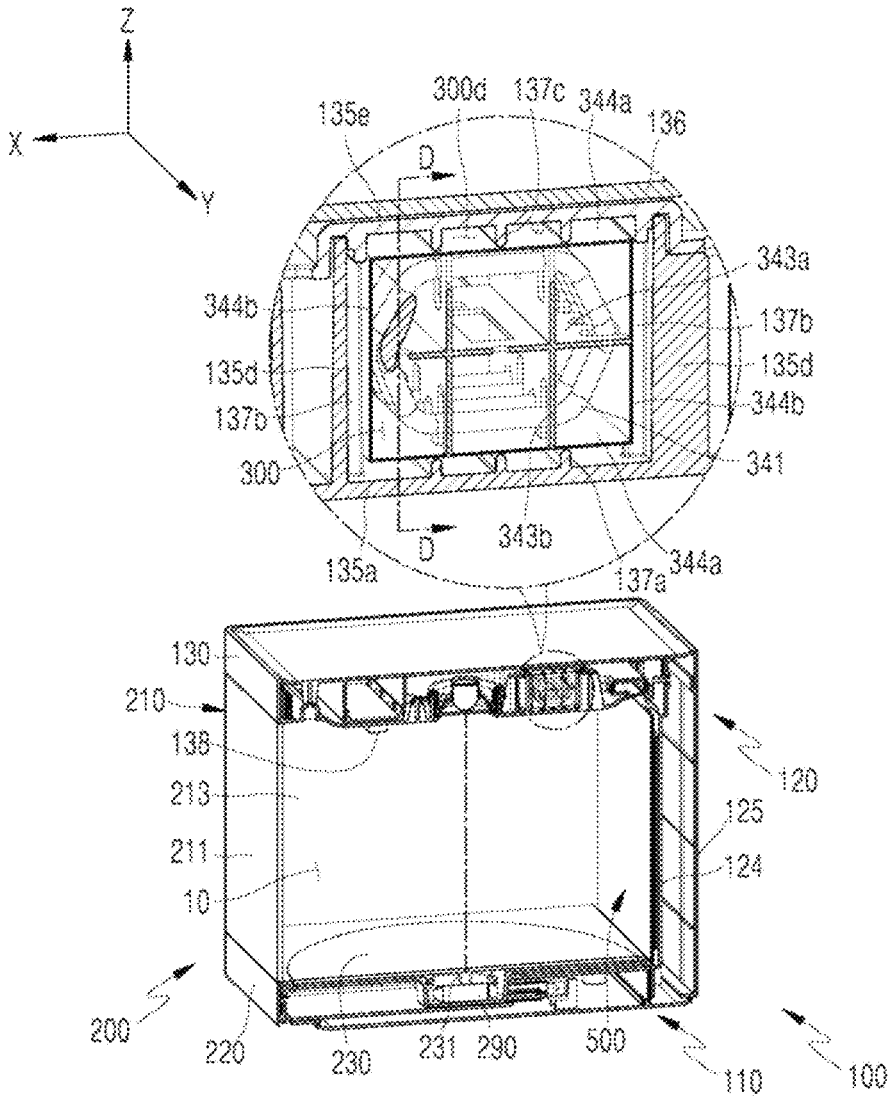
FIG. 34 is a perspective cross-sectional view of the showcase of FIG. 3*a* taken along line A-A.

FIG. 34 is a perspective cross-sectional view of the showcase 1 of FIG. 3*a* taken along line A-A. FIG. 34 does not illustrate the shoe S.

As illustrated in FIGS. 33 and 34, the heating part 340 may include the heat wire 341 and the heat dissipation member 342.

The heat wire 341 may be a hot wire for generating heat through current. The controller 600 controls the current which flows on the heat wire 341 to control the temperature of the heating part 340. The heat wire 341 may be connected to the heat dissipation member 342.

A power supply (not illustrated) may be provided in the base 220. The power supply may supply power to the heat wire 341. The controller 600 may control the power supplied to the heat wire 341 from the power supply.

The measurement sensor 138 that measures the temperature and/or the humidity of the accommodation space 10 may be installed at one side of the accommodation space 10. The measurement sensor 138 may be installed in the upper body 130, the middle body 120, or the base 220. As an example, the measurement sensor 138 may be installed on the upper bottom plate 135*a*. The controller 600 may receive the measurement value of the measurement sensor 138.

The operating time and the operating pattern of the blowing part 330 and the heating part 340, and the current amount applied to the heating part 340 according to the measurement value of the load sensor may be set in the controller 600.

The user may input the operating time and the operating pattern of the blowing part 330 and the heating part 340, and the current amount applied to the heating part 340 according to the temperature and/or the humidity of the accommodation space 10 into the controller through the operating button 610.

The controller 600 may control the current applied to the heat wire 341 according to the measurement value of the measurement sensor 138. The temperature of the heat wire 341 may vary depending on the measurement value of the measurement sensor 138. Therefore, the showcase 1 according to the embodiment of the present invention controls the temperature and/or the humidity of the accommodation space 10 to completely interrupt the deformation or the contamination of the shoe S.

As illustrated in FIG. 31*b*, the heat dissipation member 342 may form a contact surface with the air which moves in the air path 300. Therefore, the thermal energy of the heat wire 341 may be delivered to the air which flows in the air path 300 through the heat dissipation member 342.

As illustrated in FIGS. 33 and 34, the heat dissipation member 342 may include a first heat dissipation plate 343 and a second heat dissipation plate 344. The first heat dissipation plate 343 may include a first horizontal heat dissipation plate 343*a* and a first vertical heat dissipation plate 343*b*.

The first horizontal heat dissipation plate 343*a* may be formed in a plate shape parallel to the upper bottom plate 135*a*. The top and the bottom of the first horizontal heat dissipation plate 343*a* may form the contact surface with the air which flows in the air path 300. One or more first horizontal heat dissipation plates 3 may be provided. A plurality of first horizontal heat dissipation plates 3 may be spaced apart in the vertical direction.

The first vertical heat dissipation plate 343*b* may be formed in the plate shape parallel to an adjacent path barrier 135*d*. Both surfaces of the first vertical heat dissipation plate 343*b* may form the contact surface with the air which flows in the air path 300. One or more first vertical heat dissipation plates 343*b* may be provided. A plurality of first vertical heat dissipation plates 343*b* may be spaced apart in the width direction of the air path 300.

A thermal fuse may be coupled to any one of the first horizontal heat dissipation plate 343*a* and the first vertical heat dissipation plate 343*b*. The thermal fuse is deformed or melted at a setting temperature to open an electrical circuit. Therefore, overheating and fire of the showcase 1 may be prevented.

A plurality of winding holes 343*c* may be formed on the first horizontal heat dissipation plate 343*a* and the first vertical heat dissipation plate 343*b*.

Figure 35A:
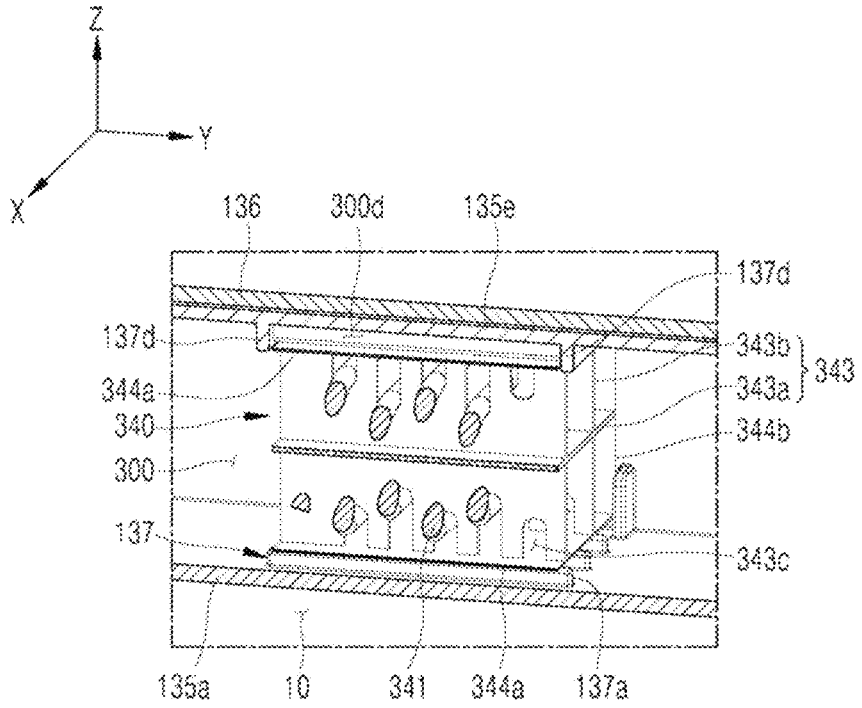
FIG. 35*a* is a perspective cross-sectional view of the air path of the showcase of FIG. 34 taken along line D-D.

FIG. 35*a* is a perspective cross-sectional view of the air path 300 of the showcase 1 of FIG. 24 taken along line D-D.

As illustrated in FIG. 35*a*, the winding holes 343*c* of the first horizontal heat dissipation plate 343*a* may be spaced apart from each other in a movement direction of the air which flows in the air path 300. The winding holes 343*c* of the first vertical heat dissipation plate 343*b* may be spaced apart from each other in the movement direction of the air which flows in the air path 300. The heat wire 341 may be wound while passing through the winding holes 343*c* of the first horizontal heat dissipation plate 343*a* and the first vertical heat dissipation plate 343*b*.

The winding holes 343*c* may be formed in a zigzag form in a path direction of the air path 300. All of the winding holes 343*c* of the first horizontal heat dissipation plate 343*a* and the first vertical heat dissipation plate 343*b* may be formed in the zigzag form in the path direction of the air path 300. Alternatively, only the winding holes 343*c* of any one of the first horizontal heat dissipation plate 343*a* and the first vertical heat dissipation plate 343*b* may be formed in the zigzag form in the path direction of the air path 300.

As illustrated in FIG. 35*a*, only the winding holes 343*c* of the first vertical heat dissipation plate 343*b* may be formed in the zigzag form in the path direction of the air path 300. Therefore, the heat wire 341 wound on the winding holes 343*c* of the first vertical heat dissipation plate 343*b* may be undulated with each other in the vertical direction. Therefore, thermal energy directly delivered from the heat wire 341 to the air may increase.

Therefore, even though the controller 600 supplies relatively small current to the heat wire 341, larger thermal energy may be delivered to the air which flows in the accommodation space 10. Therefore, a current amount required for operating the showcase 1 may be reduced.

Figure 35B:
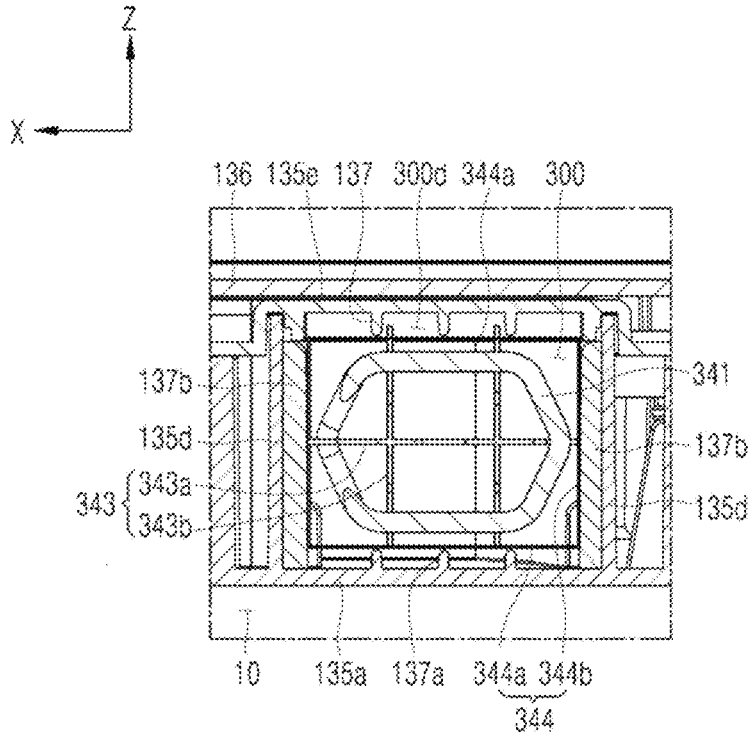
FIG. 35*b* as a partial enlarged diagram of the showcase of FIG. 34 is a diagram illustrating the air path and the heating part.

FIG. 35*b* as a partial enlarged diagram of the showcase 1 of FIG. 24 is a diagram illustrating the air path 300.

As illustrated in FIGS. 35*a* and 35*b*, a spacing projection portion 137 may be formed on the inner surface of the air path 300. The spacing projection portion 137 may be project from the inner surface of the air path 300. The heat dissipation member 342 may be separated from the inner surface of the air path 300 by the spacing projection portion 137.

The spacing projection portion 137 may include a first spacing projection portion 137*a*, a second spacing projection portion 137*b*, and a third spacing projection portion 137*c*.

The first spacing projection portion 137*a* may be projected toward the air path 300 from the top of the upper bottom plate 135*a*. The second spacing projection portion 137*b* may be projected toward the air path 300 from both inner surfaces of the path barrier 135*d*. The third spacing projection portion 137*c* may be projected toward the air path 300 from the bottom of the path cover 135*e*.

As illustrated in FIGS. 35*a* and 35*b*, the second heat dissipation plate 344 may be formed to be in line with the inner surface of the air path 300. The second heat dissipation plate 344 may include a second horizontal heat dissipation plate 344*a* and a second vertical heat dissipation plate 344*b*.

The second horizontal heat dissipation plate 344*a* may be coupled to each of the upper portion and the lower portion of the first horizontal heat dissipation plate 343*a*. The second horizontal heat dissipation plate 344*a* may form the contact surface with the air which flows in the air path 300.

The lower second horizontal heat dissipation plate 344*a* may be formed in the plate shape parallel to the upper bottom plate 135*a*. The lower second horizontal heat dissipation plate 344*a* may be spaced upward from the top of the upper bottom plate 135*a* by the first spacing projection portion 137*a*.

The first spacing projection portion 137*a* may be formed to be long in line with the path direction of the air path 300. Therefore, a path in which air flows may be formed between the lower second horizontal heat dissipation plate 344*a* and the upper bottom plate 135*a*. Therefore, the thermal energy of the air path 300 may be delivered to the accommodation space 10 in the form of heat conducting through the upper bottom plate 135*a*. Therefore, operation efficiency of the heating part 340 may be enhanced.

The upper second horizontal heat dissipation plate 344*a* may be formed in the plate shape parallel to the path cover 135*e*. The upper second horizontal heat dissipation plate 344*a* may be spaced downward from the bottom of the path cover 1353 by the third spacing projection portion 137*c*.

As illustrated in FIGS. 35*a* and 35*b*, the upper body 130 may include the first external cabinet 136 that partitions the outside and the upper space 130*a*. A wall surface of the air path 300 may be spaced apart from the first external cabinet 136 in the upper and lower direction. That is, the path cover 135*e* may be spaced apart from the first external cabinet 136 in the upper and lower direction.

As described above, an increase in height of the upper space 130*a* may be in proportion to an increase in volume of the showcase 1. A volume increase of home appliances may be a major factor which reduces installability and usability, and raises product prices. Therefore, an up-down direction spacing distance between the path cover 135*e* and the first external cabinet 136 should be minimized.

However, as the up-down direction spacing distance between the path cover 135*e* and the first external cabinet 136 decreases, an amount of the thermal energy of the air path 300, which is dispersed to the outside air increases by the heat delivery through the path cover 135*e* and the first external cabinet 136, so the operating efficiency of the heating part 340 may be lowered.

As illustrated in FIG. 31*a*, an isolation projection portion 137*d* may be formed at a portion close to the first external cabinet 136 on the inner surface of the air path 300. The portion close to the first external cabinet 136 on the inner surface of the air path 300 may mean the bottom of the path cover 135*e*.

As illustrated in FIGS. 35*a* and 35*b*, the isolation projection portion 137*d* may be formed to surround the edge of the upper second horizontal heat dissipation plate 344*a*. Therefore, the isolation projection portion 137*d* may isolate space (hereinafter, referred to as 'heat insulation space 300*d*') between the bottom of the path cover 135*e* and the upper second horizontal heat dissipation plate 344*a* from the air path 300.

The heat insulation space 300*d* may form a space isolated from the air path 300 and the upper space 130*a*. Therefore, the thermal energy of the air path 300 delivered to the path cover 135*e* may be reduced by the heat insulation space 300*d*.

Therefore, even though the up-down direction spacing distance between the path cover 135*e* and the first external cabinet 136 decreases, the amount of the thermal energy of the air path 300, which is dispersed to the outside air is minimized by the heat delivery through the path cover 135*e* and the first external cabinet 136, so the operating efficiency of the heating part 340 may be enhanced.

The second horizontal heat dissipation plate 344*b* may be coupled to each of the left side and the right side of the first horizontal heat dissipation plate 343*a*. The second vertical heat dissipation plate 344*b* may be formed in the plate shape parallel to the adjacent path barrier 135*d*. The second vertical heat dissipation plate 344*b* may form the contact surface with the air which flows in the air path 300. The second vertical heat dissipation plate 344*b* may be spaced apart from the path barrier 135*d* by the second spacing projection portion 137*d*.

When the thermal energy of the air path 300 is dispersed to the upper space 130*a* by the heat delivery through the path barrier 135*d*, the operating efficiency of the heating part 340 may be lowered.

The second spacing projection portion 137*b* may be formed to be long in an orthogonal direction to the path direction of the air path 300. The second spacing projection portion 137*b* may prevent the air flow between the path barrier 135*d* and the second vertical heat dissipation plate 344*b*. Therefore, the thermal energy of the air path 300 delivered to the upper space 130*a* between the path barrier 135*d* and the second vertical heat dissipation plate 344*b* may be reduced.

Therefore, even though the spacing distance between the path barrier 135*d* and the second vertical heat dissipation plate 344*b* decreases, the amount of the thermal energy of the air path 300, which is dispersed to the upper space 130*a* is minimized by the heat delivery through the path barrier 135*d*, so the operating efficiency of the heating part 340 may be enhanced.

Figure 36:
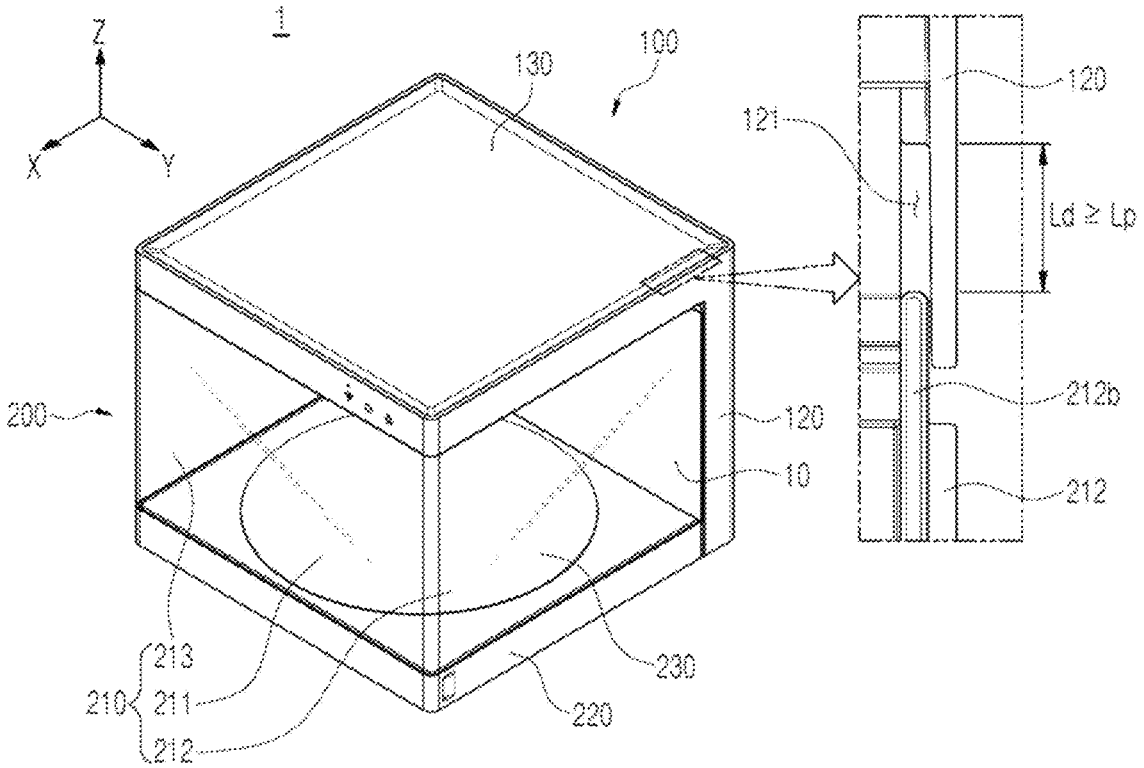
FIG. 36 is a diagram illustrating the closed state of the showcase 1 according to an embodiment of the present invention.
Figure 37:
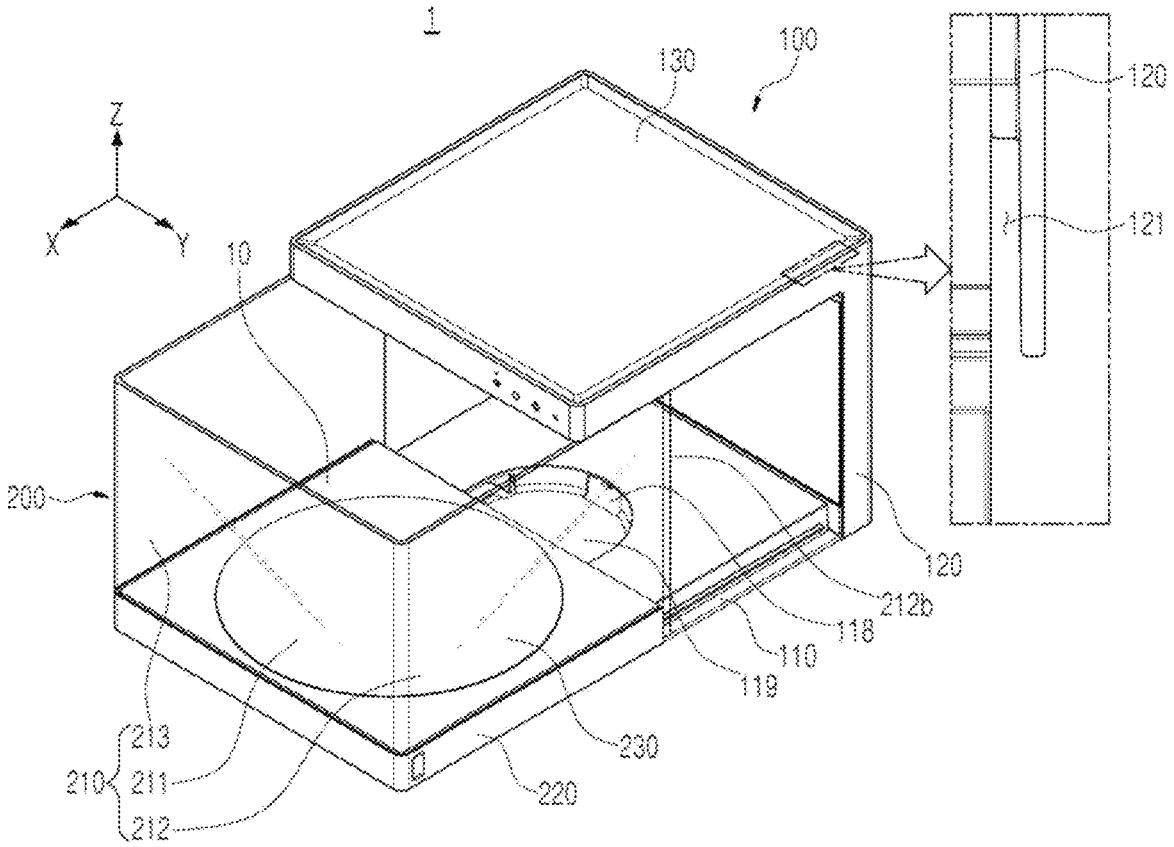
FIG. 37 is a diagram illustrating the opened state of the showcase 1 according to an embodiment of the present invention.
Figure 38:
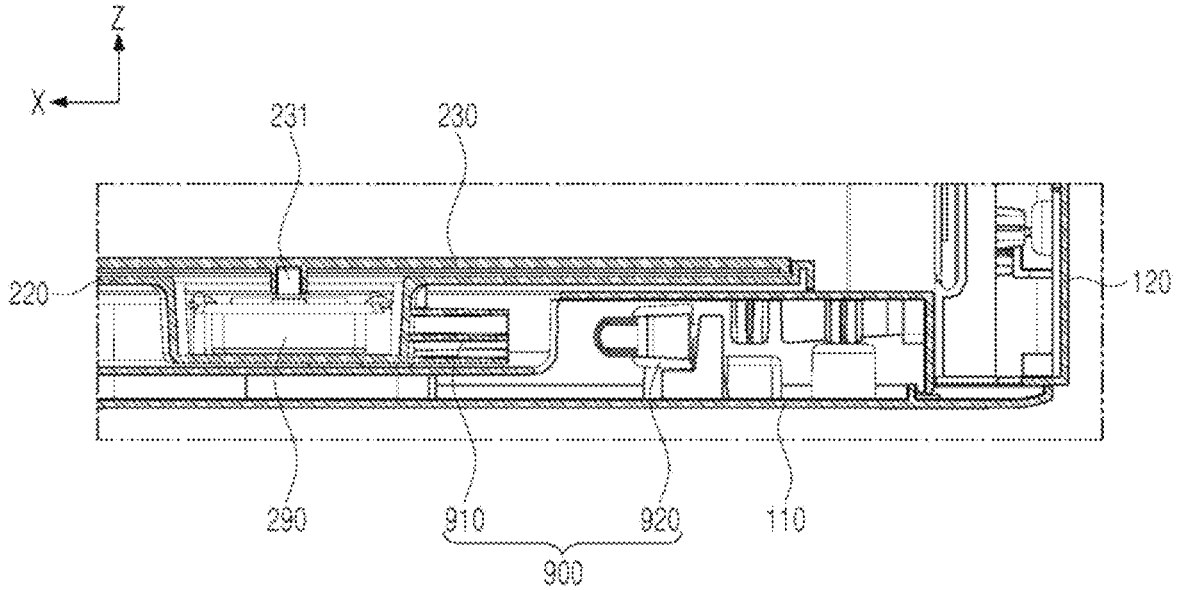
FIG. 38 is a diagram illustrating a locking body in the showcase according to an embodiment of the present invention.
Figure 39:
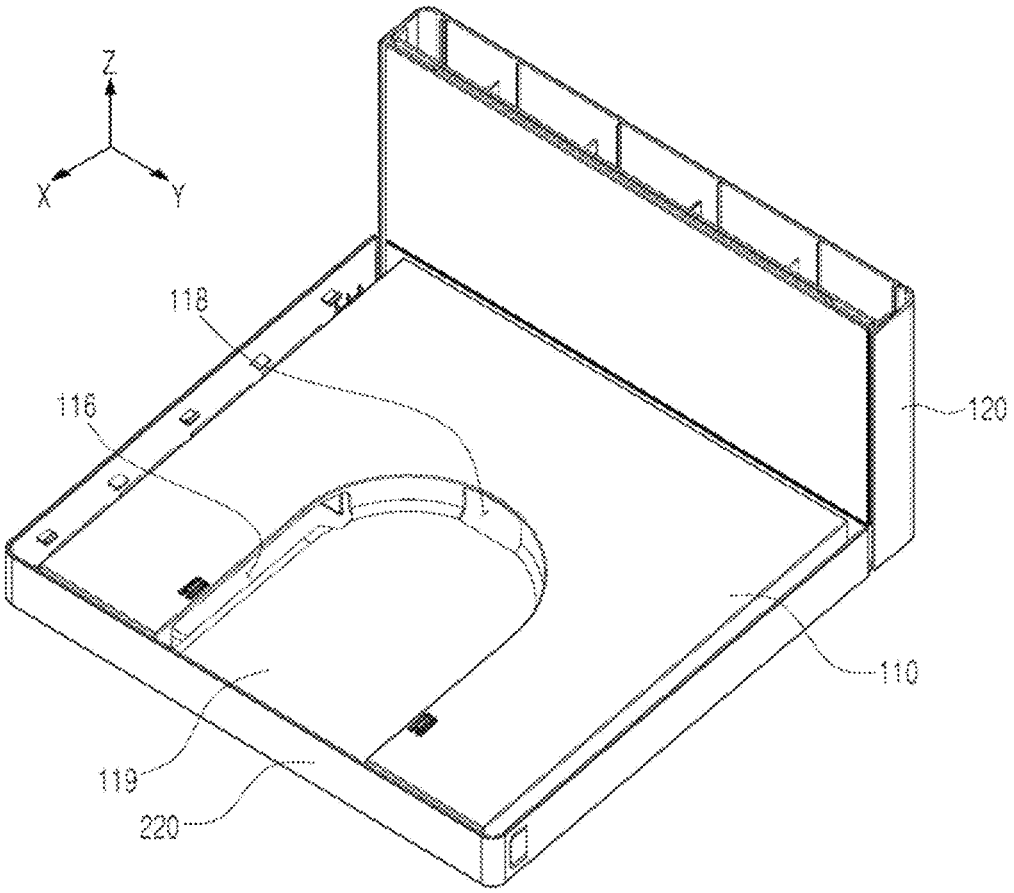
FIG. 39 is a diagram illustrating the lower body of the body in the showcase according to an embodiment of the present invention.
Figure 40:
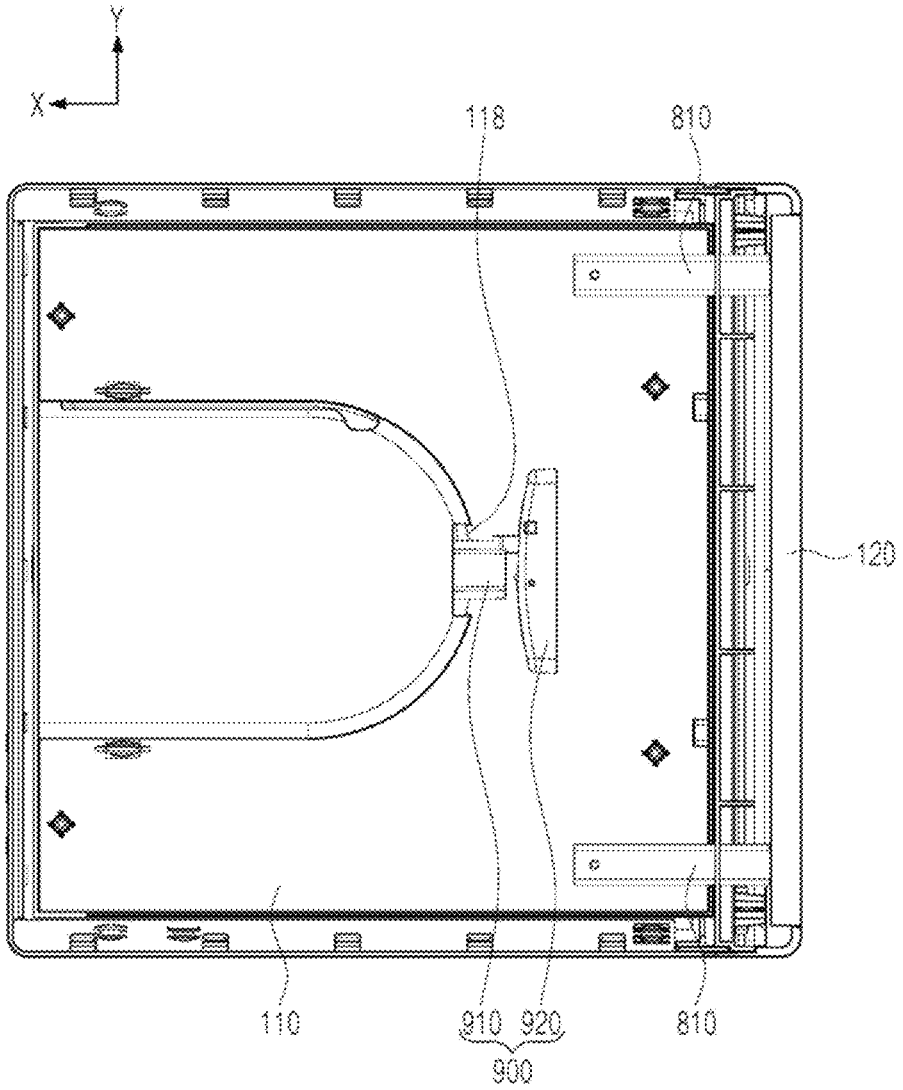
FIG. 40 is a diagram illustrating a coupling structure of a locking lever and a locking holder in the showcase according to an embodiment of the present invention.

FIG. 36 is a diagram illustrating the closed state of the showcase 1 according to an embodiment of the present invention. FIG. 37 is a diagram illustrating the opened state of the showcase 1 according to an embodiment of the present invention. FIG. 38 is a diagram illustrating a locking body 900 in the showcase 1 according to an embodiment of the present invention. FIG. 39 is a diagram illustrating the lower body 110 of the body 100 in the showcase 1 according to an embodiment of the present invention. FIG. 40 is a diagram illustrating a coupling structure of a locking lever 910 and a locking holder 920 in the showcase 1 according to an embodiment of the present invention.

The showcase 1 according to an embodiment of the present invention may include the body 100, the moving body 200, the blowing part 330, and a locking body 900.

The body 100 as a part that forms a part of the accommodation space 10 may constitute a reference location for the moving body 200 which slidably moves.

The moving body 200 is a part that forms the accommodation space 10 jointly with the body 100, and is coupled to the body 100 to slidably move between the first location and the second location in front of the first location.

That is, the moving body 200 is a part that forms the remaining part of the accommodation space, and while the moving body 200 slidably moves with respect to the body 100, the accommodation space 10 may be opened/closed.

In particular, the moving body 200 may be configured to reciprocally move between the first location and the second location in the front and rear direction with respect to the body 100. In this case, a state in which the moving body 200 is at the first location may be defined as a closed state and a state in which the moving body 200 is at the second location may be defined as an opened state.

In the opened state of the showcase, the accommodation space 10 may be sealed from outside air. Therefore, when the shoe is accommodated in the accommodation space 10 and the accommodation space 10 is closed, the contact of the shoe with dust and moisture of the outside air may be interrupted.

The blowing part 330 as a part configured to circulate the air in the accommodation space 10 may allow the shoe accommodated in the accommodation space 10 to be placed in an appropriate environment by adjusting an air state (in particular, humidity) of the accommodation space 10.

In this case, each of the suction port 310 and the discharge port 320 may be formed in a part of the accommodation space 10. In addition, the air in the accommodation space 10 is suctioned into the air path 300 through the suction port 310 by the blowing part 330, and the air in the accommodation space 10 may be discharged to the accommodation space 10 through the discharge port 320 again. Therefore, air forcibly blown by the blowing part 330 may be circulated in the accommodation space 10 and the air path 300.

As such, in the showcase 1 according to the exemplary embodiment, the shoe is accommodated in the accommodation space 10 formed by both the body 100 and the moving body 200, and the state is switched to the closed state to display the shoe and the air is circulated in the accommodation space 10 through the blowing part 330 to adjust the state of the accommodation space 10, thereby effectively implementing both the shoe display effect and the shoe care effect.

Further, in the showcase 1 according to the exemplary embodiment, since the accommodation space 10 is opened and closed while the moving body 200 slidably coupled to the body 100 moves between the first location and the second location, the shoe may be effectively stored and withdrawn.

The locking body 900 as a part configured to lock sliding movement of the moving body 200 with respect to the body 100 may slidably move the moving body after releasing locking by the locking body 900 in order to switch the closed state of the showcase 1 to the opened state.

In this case, the locking body 900 may be configured to switch the closed state and the opened state through a push-pull scheme locking structure.

That is, when the moving body 200 is pressed backward with respect to the body 100 in the closed state of the showcase 1, the locking is released, and as a result, the moving body 200 may be placed to be movable forward with respect to the body 100.

Further, when the moving body 200 is moved backward with respect to the body 100 in the opened state of the showcase 1, and then the moving body 200 is pressed backward so as to completely close the showcase 1, the locking may be made between the body 10 and the moving body 200.

To this end, the locking body 900 may be configured to include a locking lever 910 and a locking holder 920.

The locking lever 910 as a part installed in any one of the body 100 and the moving body 200 may be configured in a structure to be fastened to the locking holder 920.

The locking holder 920 as a part installed in the remaining one of the body 100 and the moving body 200 and fastened to the locking lever 910 alternately when being pressed by the locking lever 910. That is, if the locking lever 910 and the locking holder 920 are fastened to each other when the locking lever 910 first presses the locking holder 920, the fastening between the locking lever 910 and the locking holder 920 may be released when the locking lever 910 presses the locking holder 920 again.

The fastening (locking) between the locking lever 910 and the locking holder 920 is kept in the closed state of the showcase, and when the moving body 200 is pressed backward with respect to the body 100, the locking between the locking lever 910 and the locking holder 920 is released, and as a result, the moving body 200 may be placed to be movable forward with respect to the body 100.

When the moving body 200 is pressed backward with respect to the body 100 in the opened state of the showcase 1, the locking may be made between the body 10 and the moving body 200 while the locking lever 910 and the locking holder 920 are fastened to each other.

In respect to such a configuration of the locking body 900, only a structure in which the locking lever 910 is placed in the moving body 200 and the locking holder 920 is placed in the body 100 is illustrated on the drawing, but the present invention is not particularly limited thereto, and the locking lever 910 may be placed in the body 100 and the locking holder 920 may be placed in the moving body 200.

As such, in the showcase according to the embodiment, the locking holder 910 and the locking holder 920 are installed in the body 100 and the moving body 200, and the locking holder 920 and the locking lever 910 are fastened alternately by pressing by the locking lever 910, and it is possible to lock the sliding movement of the moving body 200 with respect to the body 100, and as a result, the closed state and the opened state may be stably and easily switched.

The showcase 1 according to an embodiment of the present invention may further include the heating part 340 configured to heat the circulated air in the accommodation space 10.

That is, the heating part 340 configured to deliver the thermal energy to the circulated air to allow the shoe accommodated in the accommodation space 10 to be placed in the appropriate environment by adjusting the air state (in particular, humidity) of the accommodation space 10.

As such, in the showcase 1 according to the embodiment, since the state of the accommodation space is adjusted by heating the air in the accommodation space 10 through the heating part 340, the shoe may be more effectively cared by appropriately maintaining the environment of the accommodation space 10.

In the showcase 1 according to an embodiment of the present invention, the body 100 may be configured to include the upper body 130 forming the top of the accommodation space 10, the lower body 110 positioned below the accommodation space 10, and the middle body 120 forming the rear surface of the accommodation space 10 by connecting rear sides of the upper body 130 and the lower body 110.

In addition, the moving body 200 may be configured to include the base 220 slidably coupled to the lower body 110 and the transparent window 210 extending upward on the base 220, and forming the front surface and both side surfaces of the accommodation space 10.

In this case, the body 100 in which the lower body 110, the middle body 120, and the upper body 130 are combined may be configured in a C shape when viewed from the side. Therefore, the body 100 may constitute three surfaces of the showcase 1 in a 3D space.

In addition, the transparent window 210 placed on the base 220 may constitute the remaining three surfaces of the showcase 1 in the 3D space.

As a result, the accommodation space 10 may be formed between the body 100 and the moving body 200 in the closed state, and when the moving body 200 slidably moves forward from the body 100, a gap for storing and withdrawing the shoe may be formed between the body 100 and the moving body 200.

Further, the lower body 110 of the body 100 and the base 220 of the moving body 200 are connected to each other in the opened state of the showcase 1, and side parts of the upper body 130 of the body 100 and the transparent window 210 of the moving body 200 are connected to each other.

That is, the body 100 and the moving body 200 may be connected to each other at the lower side and the upper side even in the opened state of the showcase 1. Such a connection structure may cause a stable structure to be maintained even in the opened state of the showcase 1.

As such, in the showcase according to the embodiment, since the body 100 includes the upper body 130, the lower body 110, and the middle body 120, and the moving body 200 is configured to include the base 220 and the transparent window 210, the connection structure of the body 100 and the moving body 200 may be stably maintained in the process of the sliding movement of the moving body 200 with respect to the body 100.

In the showcase 1 according to an embodiment of the present invention, the locking lever 910 may be installed in the base 220, and the locking holder 920 may be installed in the lower body 110.

In the showcase 1, the body 100 is a member relatively fixed, and the moving body 200 is a member which needs to reciprocally move. Therefore, for smooth movement of the moving body 200, the structure of the moving body is preferably light-weighted and simplified as possible.

Meanwhile, since the locking holder 920 in the locking body 900 requires a component for fastening to the locking lever 910 and a component for alternately performing the fastening, the structure may be relatively more complicated and the volume may be larger than the locking lever 910.

Therefore, it may be more preferable to place the locking lever 910 having the relatively simple structure in the moving body 200 and place the locking holder 920 having the relatively complicated structure in the body 100 in terms of the structure of the showcase 1.

In addition, it is preferable that the upper portion of the transparent window 210 is opened without a separate component for a visual opening sense and entering convenience of the shoe. Therefore, it may be more preferable that both the locking lever 910 and the locking holder 920 constituting the locking body 900 are installed in the base 220 and the lower body 110 below the transparent window 210.

As such, in the showcase 1 according to the embodiment, since the sliding movement is locked through the locking lever 910 and the locking holder 920 installed in the lower body 110, the movement may be smoothly achieved by relatively simplifying the structure of the moving body 200 compared with the body 100.

In the showcase 1 according to an embodiment of the present invention, a lower body groove 119 opened forward may be formed in the lower body 110 and the locking lever 910 may be placed in the lower body groove 119.

As such, when the base 220 is coupled to the lower body 110, the base 220 may slidably move with respect to the lower body 110 upon the sliding movement of the moving body 200.

In this case, a member which needs to be installed in the base 220 and coupled to the lower body 110 needs to be placed at an appropriate location so as not to interrupt the sliding movement of the moving body 200. Therefore, the lower body groove 119 which is concave downward is formed at the central portion of the lower body 110, and the member which needs to be installed in the base 220 and coupled to be lower body 110 may be placed at the lower body groove 119.

In particular, since the lower body groove 119 is formed in a shape in which the front side is opened, the member installed in the base 220 may smoothly move through the front side of the lower body groove 119 even in the process of the sliding movement of the moving body 200.

As a result, by the locking lever installed in the base 220 is placed at the lower body groove 119, the sliding movement of the moving body 200 may not be interrupted and the locking lever 910 may be smoothly fastened to the locking holder 920.

As such, in the showcase 1 according to the embodiment, since the locking lever 910 is placed at the lower body groove 119 formed in the lower body 110, the locking lever 910 may be prevented from interfering with the body 100 in the process of the sliding movement of the moving body 200.

In the showcase 1 according to an embodiment of the present invention, the locking holder 920 is placed in the rear of the lower body groove 119 and a rear entrance 118 is formed at a rear side of the lower body groove 119, and as a result, the locking lever 910 may be fastened to the locking holder 920 through the rear entrance 118.

As such, when the locking holder 920 is placed in the lower body 110, the locking holder 920 may also be placed in the lower body groove 119, but the lower body groove 119 needs to be formed to be large for placement of the locking holder 920 having the relatively large volume. However, in that when the lower body groove 119 is formed to be excessively large, the rigidity of the lower body 110 may be lowered, it may be preferable to minimize the size of the lower body groove 119.

Further, since it is preferable to preferentially place the member which needs to be installed in the base 220 and coupled to the lower body 110 at the lower body groove 119, it may be more preferable to place the locking holder 910 at a portion of the lower body 110 other than the lower body groove 119.

In particular, in that the locking lever 910 reciprocally moves in the front and rear direction along the lower body groove 119, it may be efficient to place the locking holder 920 in the rear of the lower body groove 119 for fastening to the locking lever 910.

In this case, in order to fasten the locking holder 920 placed in the rear of the lower body groove 119 and the locking lever 910 placed at the lower body groove 119, the rear entrance 118 is formed at the rear side of the lower body groove 119 to expose the locking holder 920 at the lower body groove 119.

That is, the locking lever 910 installed in the base 220 may enter and exit through the rear entrance 118, and the locking holder 920 of the lower body 110 and the locking lever 910 of the base 220 may be fastened to each other.

As such, in the showcase 1 according to the embodiment of the present invention, since the locking holder 920 placed in the rear of the lower body groove 119 and the locking lever 910 placed at the lower body groove 119 are fastened through the rear entrance 118, the locking lever 910 and the locking holder 920 may be smoothly fastened even though the lower body groove 119 is not formed to be excessively large.

In the showcase 1 according to an embodiment of the present invention, the transparent window 210 may include the first window 211 forming the front surface, the second window 212 forming the left surface, and the third window 213 forming the right surface, and the first window 211, the second window 212, and the third window 213 may be integrally formed.

That is, the transparent window 210 may be formed to have three surfaces in a bent shape. As a result, the transparent window 210 may have the C shape on the plan view as a whole.

In particular, the transparent window 210 may be integrally formed so that a support member such as a separate frame is not interposed between portions where the first window 211, the second window 212, and the third window 213 are connected.

As such, in the showcase 1 according to the embodiment of the present invention, since the first window 211, the second window 212, and the third window 213 of the transparent window 210 are integrally formed, the support member such as the separate frame is not interposed between connection portions to provide a sense of unity and a sense of opening visually.

In the showcase 1 according to the embodiment of the present invention, the third insertion groove 121 and the fourth insertion groove 122 may be formed at portions of the middle body 120 coupled to the second window 212 and the third window 213, respectively, and the third fin portion 212*b* and the fourth fin portion 213*b* which may be inserted into the third insertion groove 121 and the fourth insertion groove 122 may be formed at rear ends of the second window 212 and the third window 213, respectively.

That is, in the closed state of the showcase 1, the rear ends of the second window 212 and the third window 213 may be inserted into the third insertion groove 121 and the fourth insertion groove 122 formed in the middle body 120, respectively.

Therefore, displacements of the body 100 and the moving body 200 (in particular, the middle body 120 and the transparent window 210) in the left and right direction are restricted in the closed state, and as a result, the coupling structure may be firmly maintained.

As such, in the showcase 1 according to the embodiment, since the rear ends of the second window 212 and the third window 213 are inserted into the third insertion groove 121 and the fourth insertion groove 122 of the middle body 120, the transparent window 210 of the moving body 200 and the middle body 120 of the body 100 may maintain a stable connection structure in the closed state.

In the showcase 1 according to an embodiment of the present invention, the locking lever 910 may be pressed toward the locking holder 920 by a first pressing length Lp and may press the locking holder 920, and the third insertion groove 121 and the fourth insertion groove 122 may be formed to be deeper than insertion lengths of the third fin portion 212*b* and the fourth fin portion 213*b*.

When the locking body 900 is configured in the push-pull scheme structure, the moving body 200 needs to be pressed toward the body 100 by a predetermined length for locking and unlocking the locking body 900.

In this case, if there is no spare space in the third insertion groove 121 and the fourth insertion groove 122 into which the rear ends of the second window 212 and the third window 213 are inserted, the transparent window 210 may not be pressed toward the middle body 120 any longer, so push-pull scheme implementation may be impossible.

Therefore, it is necessary to secure spare spaces at the third insertion groove 121 and the fourth insertion groove 122 for the push-pull scheme implementation in addition to the spaces into which the third fin portion 212*b* and the fourth fin portion 213*b* of the second window 212 and the third window 213.

That is, spare spaces having a spare length Ld equal to or more than the first pressing length Lp may be formed at the third insertion groove 121 and the fourth insertion groove 122.

As such, in the showcase 1 according to the embodiment, since spare insertion spaces are formed in the third insertion groove 121 and the fourth insertion groove 122 by a pressed length of the locking lever 910 to press the locking holder 920, a spare space in which the moving body 200 is pressed toward the body 100 may be secured for the push-pull scheme.

The showcase 1 according to an embodiment of the present invention may further include a stopping part 130*s* configured to restrict the sliding movement of the moving body 200 with respect to the body 100 within the second location.

As such, in the showcase 1 according to the embodiment, since the stopping part 130*s* restricts the sliding movement of the moving body 200 with respect to the body 100 not to cross the second location, it is possible to prevent separation of the body 100 and the moving body 200 or a reverse which occurs due to a change in center of gravity when the moving body 200 excessively moves for the opened state.

In the showcase 1 according to an embodiment of the present invention, the moving body 200 may further include the turntable 230 coupled to the base 220 rotatably around the vertical axis, and forming the bottom of the accommodation space 10 jointly with the base 220.

That is, the turntable 230 may form a seating surface on which the shoe is placed in the accommodation space 10, and may be configured to rotate with respect to the base 22 on the bottom of the moving body 200. As a result, the shoe seated on the top of the turntable 230 may be jointly rotated when the turntable 230 rotates.

As such, in the showcase 1 according to the embodiment of the present invention, since the turntable 230 is placed on the bottom of the accommodation space 10 and rotates around the vertical axis, the shoe may be rotated and displayed, and the air flow is made in various directions of the shoe, thereby achieving the uniform care throughout the shoe.

In the showcase 1 according to an embodiment of the present invention, the moving body 200 may further include the motor 290 coupled to apply the rotational force to the turntable 230, and the lower body groove 119 having the shape in which the front side is opened may be formed in the lower body 110, and the motor 290 may be placed at the lower body groove 119.

The motor 290 should be coupled tin order to rotate the turntable 230, but it may not be preferable that the motor 290 is not directly exposed to the user in appearance. Therefore, the motor need not be exposed to the outside by placing the motor 290 below the base 220, but in this case, there is a risk that the motor 290 will interfere in the body 100 upon the sliding movement of the moving body 200.

Therefore, it may be preferable that the sliding movement of the moving body 200 is not interrupted by the motor 290 by placing the motor 290 installed in the base 220 at the lower body groove 119.

As such, in the showcase 1 according to the embodiment, since the motor 290 applying the rotational force to the turntable 230 is placed at the lower body groove 119 formed in the lower body 110, the motor 290 may be prevented from interfering in the body 100 in the process of the sliding movement of the moving body 200.

Figure 41:
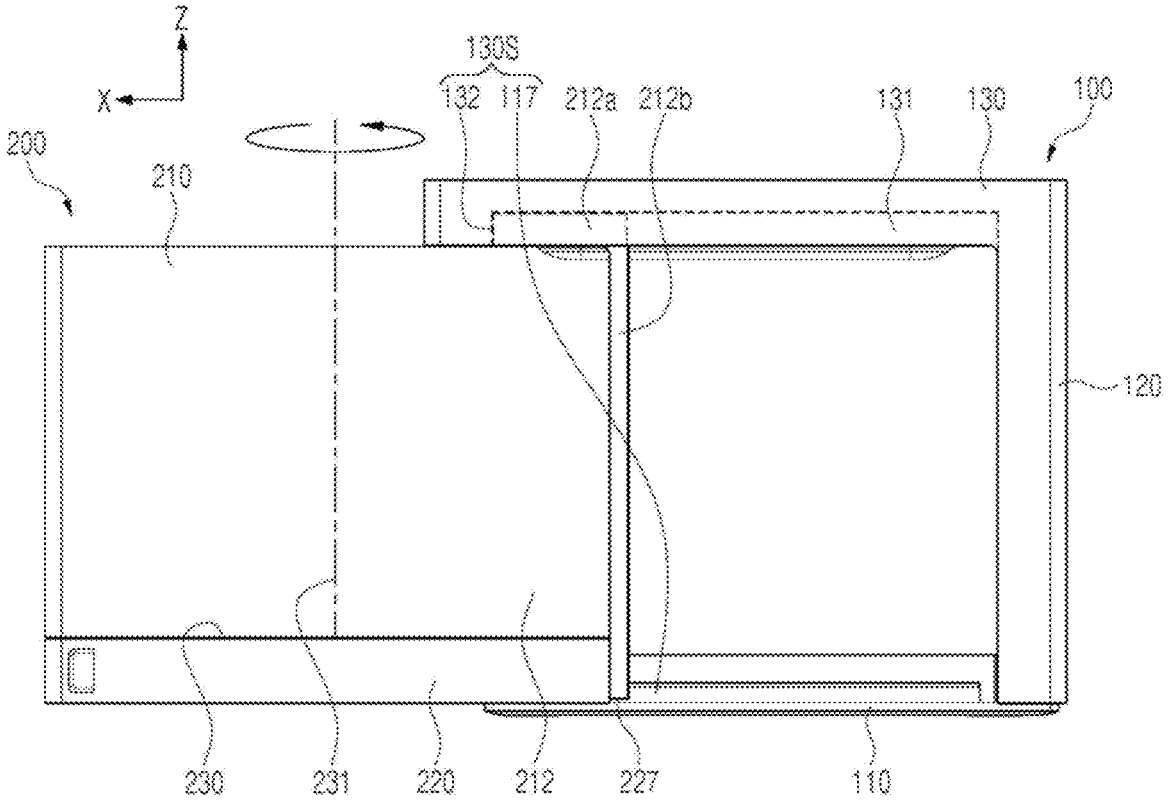
FIG. 41 is a diagram illustrating the stopping part in the opened state of the showcase according to an embodiment of the present invention.
Figure 42:
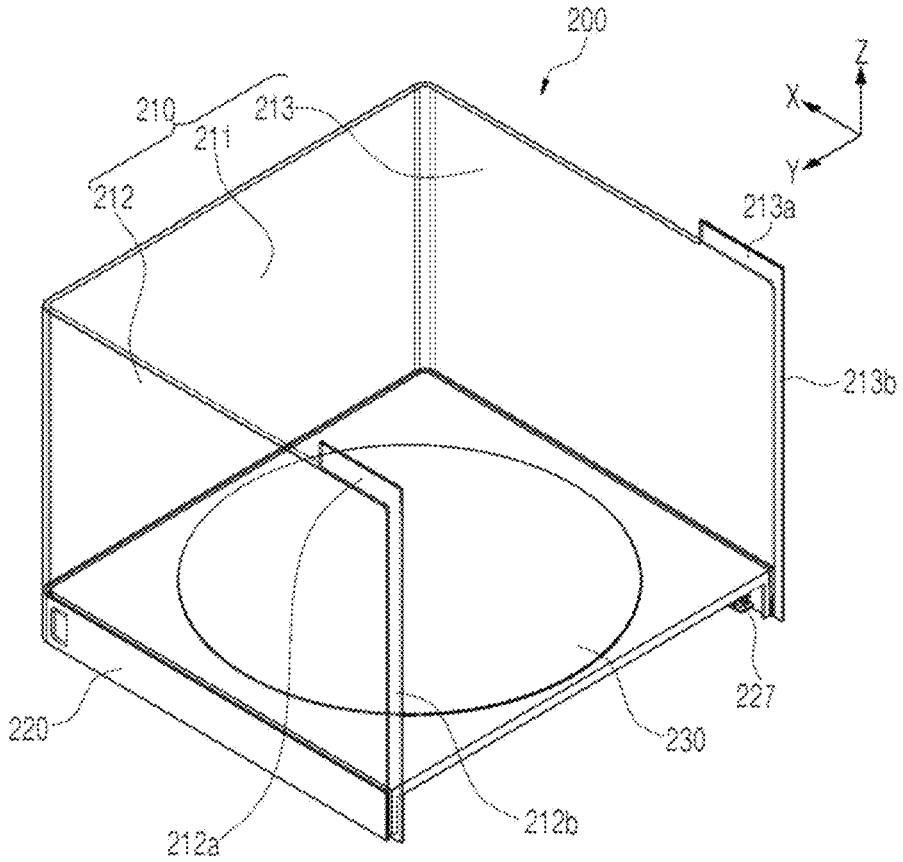
FIG. 42 is a diagram illustrating the transparent window of the moving body in the showcase according to an embodiment of the present invention.
Figure 43:
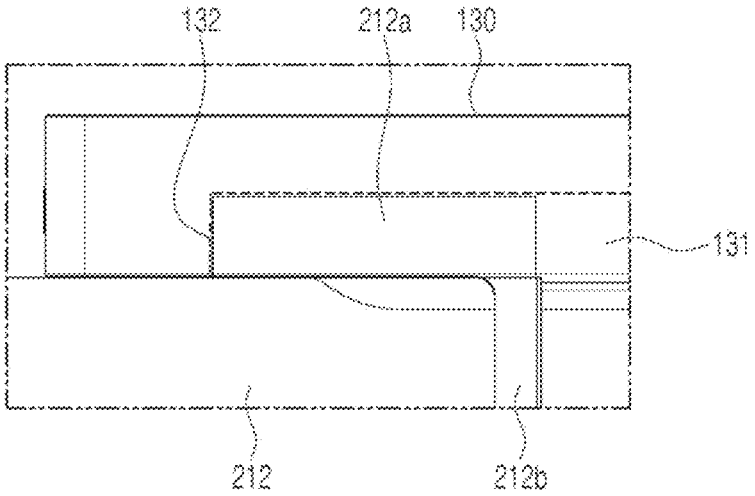
FIG. 43 is a diagram illustrating the first fin portion and the first stopper in the showcase according to an embodiment of the present invention.
Figure 44:
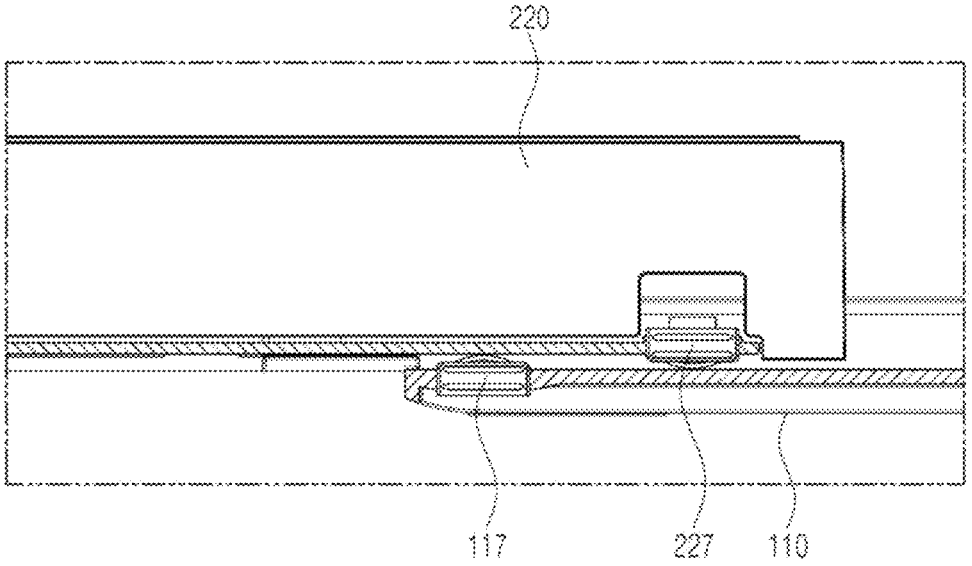
FIG. 44 is a diagram illustrating a hooking portion and a hooking groove in the showcase according to an embodiment of the present invention.

FIG. 41 is a diagram illustrating the stopping part 130*s* in the opened state of the showcase 1 according to an embodiment of the present invention. FIG. 42 is a diagram illustrating the transparent window 210 of the moving body 200 in the showcase 1 according to an embodiment of the present invention. FIG. 43 is a diagram illustrating the first fin portion 212*a* and the first stopper 132 in the showcase 1 according to an embodiment of the present invention. FIG. 44 is a diagram illustrating a hooking portion 227 and a hooking groove 117 in the showcase 1 according to an embodiment of the present invention.

According to an embodiment of the present invention, the showcase 1 may include the body 100, the moving body 200, the blowing part 330, and the stopping part 130*s*.

The body 100 as a part that forms a part of the accommodation space 10 may constitute a reference location for the moving body 200 which slidably moves.

The moving body 200 is a part that forms the accommodation space 10 jointly with the body 100, and is coupled to the body 100 to slidably move between the first location and the second location in front of the first location.

The blowing part 330 as a part configured to circulate the air in the accommodation space 10 may allow the shoe accommodated in the accommodation space 10 to be paced in an appropriate environment by adjusting an air state (in particular, humidity) of the accommodation space 10.

The stopping part 130*s* as a part configured to restrict the sliding movement of the moving body 200 with respect to the body 100 within the second location may restrict the moving body 200 to excessively move forward with respect to the body 100 when the opened state of the showcase 1 is switched to the opened state.

In order to easily put the show into the accommodation space 10 or easily withdraw the shoe from the accommodation space 10 in the opened state of the showcase 1, the moving body 200 needs to sufficiently move forward with respect to the body 100.

However, when the moving body 200 excessively moves to the front of the body 100, the center of gravity of the moving body 200 is positioned in front of the front end of the body 100, and as a result, there is a risk that the showcase 1 will be reversed as a whole.

Further, when the moving body 200 excessively moves to the front of the body 100, the moving body 200 and the body 100 are separated, so there is a risk that the showcase 1 will be damaged or the usability will be lowered.

Therefore, it may be preferable to restrict the sliding movement of the moving body 200 not to cross the second location when switching the opened state of the showcase 1.

As such, in the showcase 1 according to the embodiment, since the stopping part 130*s* restricts the sliding movement of the moving body 200 with respect to the body 100 not to cross the second location, it is possible to prevent separation of the body 100 and the moving body 200 or a reverse which occurs due to a change in center of gravity when the moving body 200 excessively moves for the opened state.

The showcase 1 according to an embodiment of the present invention may further include the heating part 340 configured to heat the circulated air in the accommodation space 10 to appropriately maintain the environment of the accommodation space 10, thereby more effectively caring the shoe.

Further, in the showcase 1 according to an embodiment of the present invention, the body 100 includes the upper body 130 forming the top of the accommodation space 10, the lower body positioned below the accommodation space 10, and the middle body 120 forming the rear surface of the accommodation space 10 by connecting the rear sides of the upper body 130 and the lower body 110, and the moving body 200 includes the base 220 slidably coupled to the lower body 110 and the transparent window 210 extending upward on the base 220 and forming the front surface and both side surfaces of the accommodation space 10 to stably maintain the connection structure of the body 100 and the moving body 200 in the process of the sliding movement of the moving body 200 with respect to the body 100.

In the showcase 1 according to an embodiment of the present invention, the first fin portion 212*a* of which a part is projected upward may be formed at the upper portion of the part forming one side surface of the accommodation space 10 in the transparent window 210.

In addition, the stopping part 130*s* may be configured to include a first stopper 132 which is formed on one side surface of the upper body 130 spaced apart from the front end of the upper body 130, and engages with the first fin portion 212*a* upon the sliding movement of the moving body 200 with respect to the body 100.

That is, the first fin portion 212*a* may be formed the transparent window (210) part forming the side surface of the accommodation space 10, which is projected upward. The first fin portion 212 may maintain the engaged state with the first insertion groove 131 formed on the side surface of the upper body 130.

Therefore, in the process in which the showcase 1 is switched to the closed state and the opened state, the first fin portion 212*a* of the transparent window 210 may slidably move while engaging with the first insertion groove 131 of the upper body 130.

As a result, a left-right direction clearance between the transparent window 210 and the body 100 may be appropriately prevented in the process of the sliding movement of the moving body 200 with respect to the body 100.

Further, since the first stopper 132 is formed at the portion spaced apart from the front end of the upper body 130, a range of the first fin portion 212*a* engaging with the first stopper 132, which may move to the front of the body 100 may be restricted.

As such, in the showcase 1 according to the embodiment, since the first fin portion 212*a* formed in the transparent window 210 engages with the first stopper 132 formed in the upper body 130, and the moving body 200 slidably moves with respect to the body 100, the transparent window 210 of the moving body 200 may be restricted from excessively moving in front of the front end of the upper body 130.

In the showcase 1 according to an embodiment of the present invention, since the transparent window 210 includes the first window 211 forming the front surface, the second window 212 forming the left surface, and the third window 213 forming the right surface, and the first window 211, the second window 212, and the third window 213 are integrally formed, the support member such as the separate frame is not interposed between the connection portions to provide the sense of unity and the sense of opening visually.

In the showcase 1 according to an embodiment of the present invention, the second fin portion 213*a* of which a part is projected upward may be formed at the upper portion of the part forming the other side surface of the accommodation space 10 in the transparent window 210.

In addition, the stopping part 130*s* may be configured to further include a second stopper 134 which is formed on the other side surface of the upper body 130 spaced apart from the front end of the upper body 130, and engages with the second fin portion 213*a* upon the sliding movement of the moving body 200 with respect to the body 100.

In this case, the first stopper 132 and the second stopper 134 may be formed to be symmetric to each other.

That is, the first fin portion 212*a* and the second fin portion 213*a* are formed to protrude upward from the rear ends of the second window 212 and the third window 213, and as a result, the accommodation space 10 may be maximally opened within a range in which the moving body 200 is not separated from the body 100.

In particular, the first fin portion 212*a* and the second fin portion 213*a* may be formed as a pair which are symmetric to each other in the left and right direction of the transparent window 210, and the first stopper 132 and the second stopper 134 corresponding to the first fin portion 212*a* and the second fin portion 213*a* may also be formed as a pair which are symmetric to each other in the left and right direction of the upper body 130.

Therefore, the second window 212 and the third window 213 of the transparent window 210 may be uniformly moved in the processing of the sliding movement of the moving body 200, and locations of the second window 212 and the third window 213 may be symmetric to each other in the opened state of the showcase 1.

As such, in the showcase 1 according to the embodiment, since the first stopper 132 and the second stopper 134 are formed on both side surfaces to be symmetric to each other, the moving body 200 may be uniformly moved without being twisted upon the sliding movement of the moving body 200 with respect to the body 100.

In the showcase 1 according to an embodiment of the present invention, a hooking portion 227 which protrudes inward may be formed on the side surface of the base 220, and the stopping part 130*s* may further include a hooking groove 117 which is formed on the side surface of the lower body 110 spaced apart from the front end of the lower body 110, and engages with the hooking portion 227 upon the sliding movement of the moving body 200 with respect to the body 100.

That is, the hooking portion 227 which protrudes inward may be formed on the side surface of the base 220 which is slidably movable with respect to the lower body 110. The hooking portion 227 may maintain the engaged state with the hooking groove 117 formed on the side surface of the lower body 110.

Therefore, in the process in which the showcase 1 is switched to the closed state and the opened state, the hooking portion 227 of the base 220 may be slidably moved while engaging with the hooking groove 117 of the lower body 110.

As a result, a left-right direction clearance between the base 220 and the body 100 may be appropriately prevented in the process of the sliding movement of the moving body 200 with respect to the body 100.

Further, since the hooking groove 117 is formed only up to the portion spaced apart from the front end of the lower body 110, a range of the hooking portion 227 engaging with the hooking groove 117, which may move to the front of the body 100 may be restricted.

Meanwhile, the showcase 1 may be configured to include a first slider holder to which a first slider is fixed and a second slider holder to which a second slider is fixed. The first slider holder may be configured integrally with the first slider. The second slider holder may be configured integrally with the second slider.

When the closed state of the showcase 1 is switched to the opened state, the second slider holder may be configured to be hooked to the first slider holder if the second slider holder moves forward. As a result, the first slider holder and the second slider holder may also serve as the hooking portion 227 and the hooking groove 117.

As such, in the showcase 1 according to the embodiment, since the hooking portion 227 formed in the base 220 engages with the hooking groove 117 formed in the lower body 110, and the moving body 200 slidably moves with respect to the body 100, the base 220 of the moving body 200 may be restricted from excessively moving in the front of the front end of the lower body 110.

In the showcase 1 according to an embodiment of the present invention, the hooking portion 227 may be formed as a pair which are symmetric to both side surfaces of the rear end of the base 220, and the hooking groove 117 may be formed as a pair which are symmetric to both side surfaces of the lower body 110.

That is, the hooking portion 227 is formed to be projected from the rear end of the base 220, so the accommodation space 10 may be maximally opened within the range in which the moving body 200 is not separated from the body 100.

In particular, the hooking portion 227 may be formed as a pair which are symmetric in the left and right direction of the base 220, and the hooking groove 117 corresponding to the hooking portion 227 may also be formed as a pair which are symmetric in the left and right direction of the lower body 110.

Therefore, the left and right side surfaces of the base 220 may be uniformly moved in the process of the sliding movement of the moving body 200, and left and right side surface locations of the base 220 may be symmetric to each other in the opened state of the showcase 1.

As such, in the showcase 1 according to the embodiment, since the hooking portion 227 and the hooking groove 117 are formed on both side surfaces, respectively as a pair which are symmetric, the moving body 200 may be uniformly moved without being twisted upon the sliding movement of the moving body 200 with respect to the body 100.

In the showcase 1 according to an embodiment of the present invention, the moving body 200 further includes the turntable 230 coupled to the base 220 rotatably around the vertical axis, and forming the bottom of the accommodation space 10 jointly with the base 220 to rotate and display the shoe, and the air flow is formed in various directions of the shoe to achieve the uniform care throughout the shoe.

In the showcase 1 according to an embodiment of the present invention, the rotational axis 231 of the turntable 230 may be positioned in front of the front end of the body 100 based on the state in which the moving body 200 is at the second location.

That is, the location of the moving body 200 which slidably moves from the body 100 in the opened state of the showcase 1 may be set by comparing the rotational axis 231 of the turntable 231 and the front end of the body 100.

In that the rotational axis 231 of the turntable 230 which axially rotates is substantially in proximity to or coincides with the center of the plane of the base 220, the state in which the rotational axis 231 of the turntable 230 is positioned in front of the front end of the body 100 may be a state in which a half or more of the accommodation space 10 is opened. Therefore, the state may be a state in which the accommodation space 10 for storing and withdrawing the shoe is sufficiently opened.

As such, in the showcase 1 according to the embodiment, since the rotational axis 231 of the turntable 230 is positioned in front of the front end of the body 100 in the opened state, sufficient opening for storing and withdrawing the shoe may be made while maintaining a stable state in the opening process of the accommodation space 10.

The showcase 1 according to an embodiment of the present invention may further include a frame body 800 coupled to the body 100 in a shape connecting the upper body 130, the lower body 110, and the middle body 120 to support the upper body 130, the lower body 110, and the middle body 120.

As such, in the showcase 1 according to the embodiment, since the frame body 800 is coupled to the body 100 in a shape connecting the upper surface, the lower surface, and the rear surface of the body 100 to support the body 100, the showcase 1 may maintain a stable state by reinforcing a structural vulnerable part in the body 100.

In the showcase 1 according to an embodiment of the present invention, the frame body 800 may include an upper frame 830 coupled to the upper body 130, a lower frame 810 coupled to the lower body 110, and a middle frame 820 connecting rear sides of the upper frame 830 and the lower frame 810 and coupled to the middle body 120.

In this case, the upper frame 830, the lower frame 810, and the middle frame 820 may be formed by bending one member which is formed to extend in a longitudinal direction.

As such, in the showcase 1 according to the embodiment, since the frame body 800 including the upper frame 830, the lower frame 810, and the middle frame 820 is formed by bending one member which is formed to extend in the longitudinal direction, the frame body 800 may be easily manufactured, and a cutting surface of the frame body 800 corresponding to a reinforcing member may be minimized.

Figure 45:
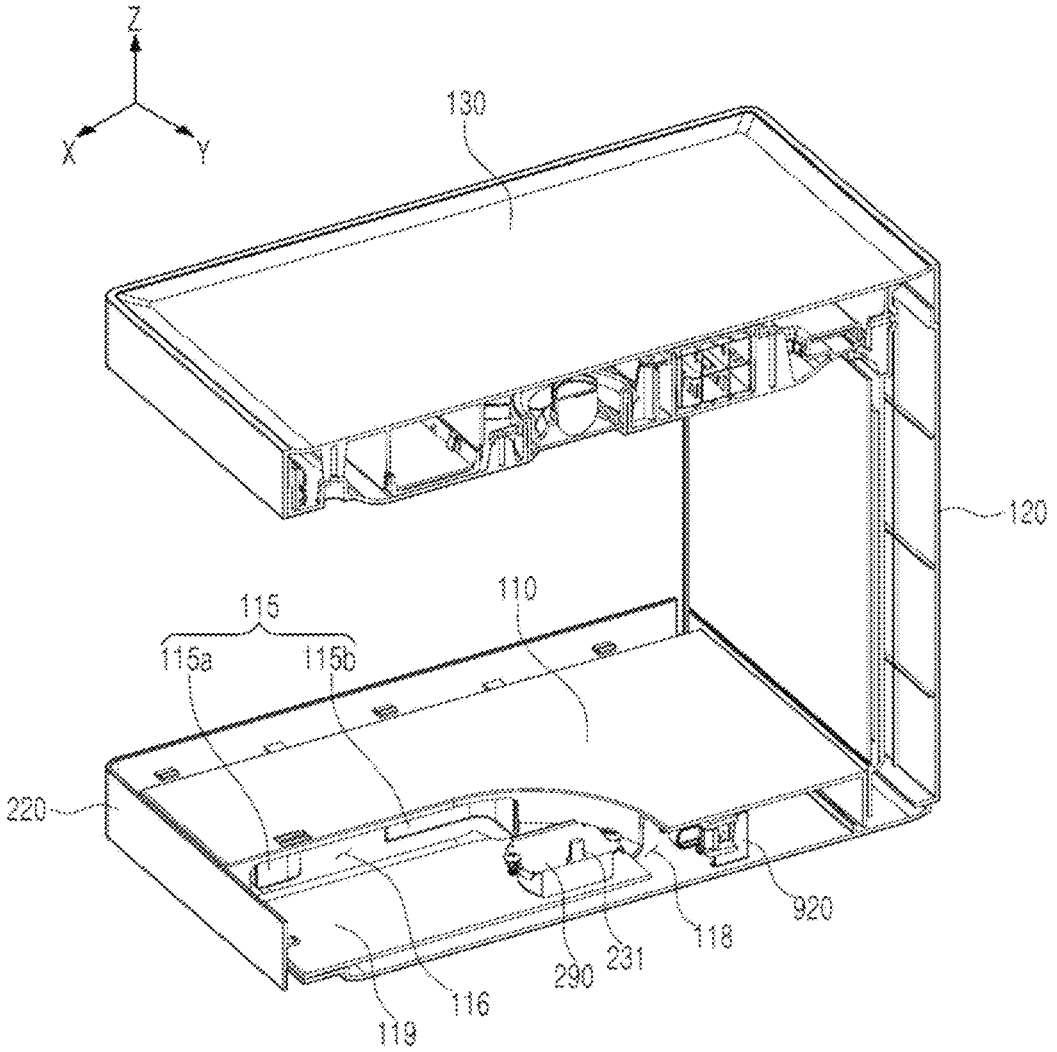
FIG. 45 is a diagram illustrating a cross-section state of some components of the showcase according to an embodiment of the present invention.
Figure 46:
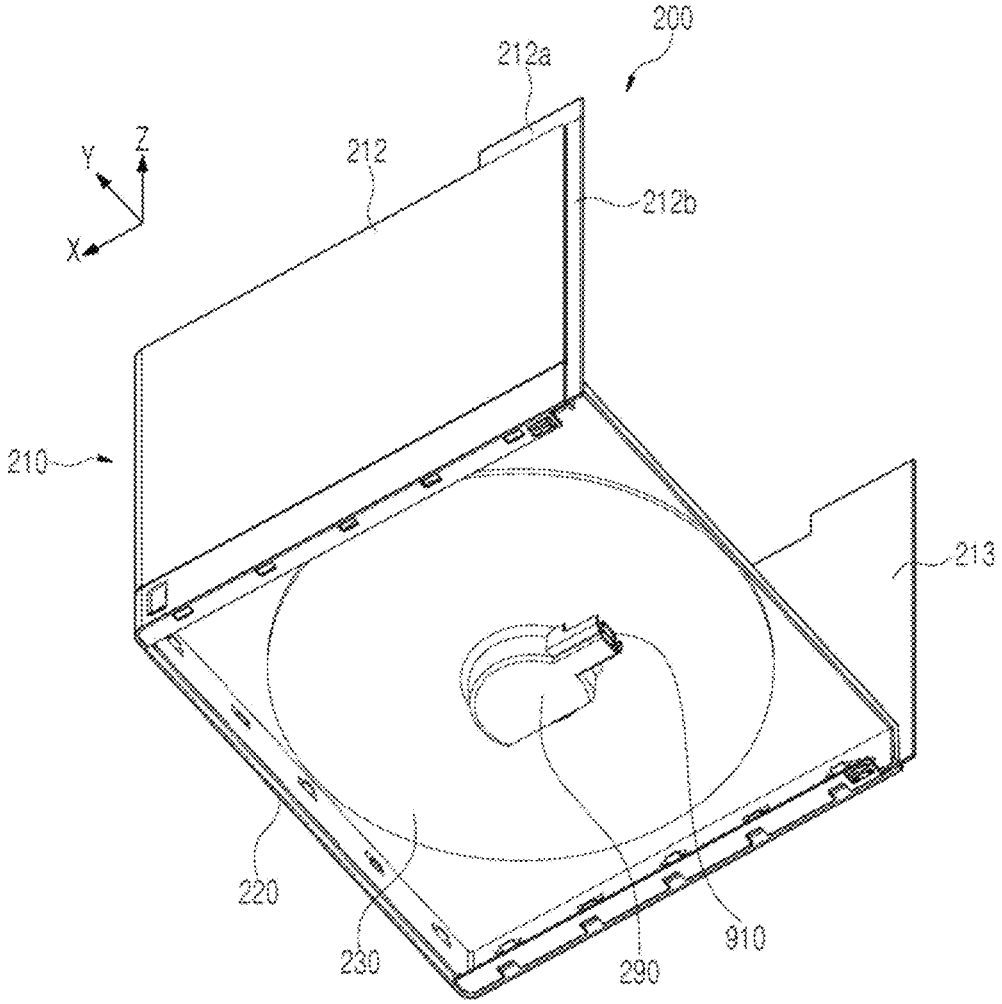
FIG. 46 is a diagram illustrating the bottom of the moving body in the showcase according to an embodiment of the present invention.
Figure 47:
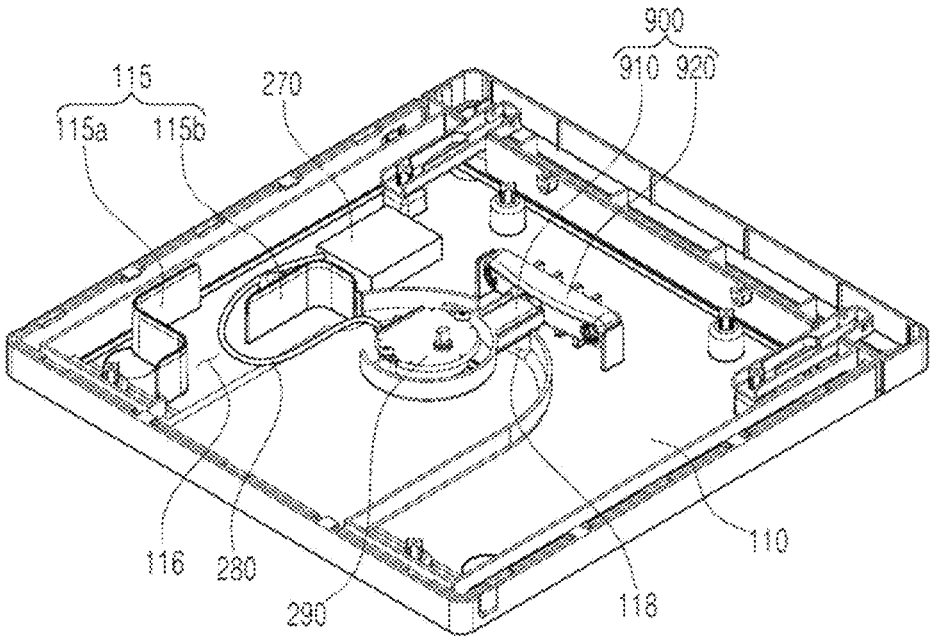
FIG. 47 is a diagram illustrating placement of the motor and a cable in the closed state of the showcase according to an embodiment of the present invention.
Figure 48:
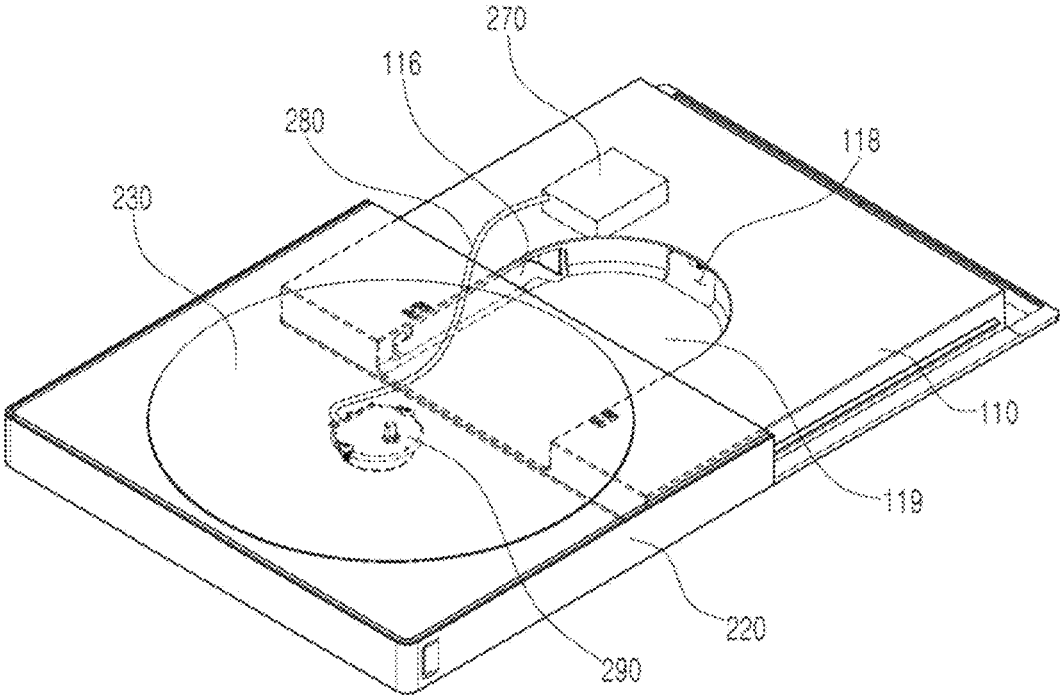
FIG. 48 is a diagram illustrating the placement of the motor and the cable in the opened state of the showcase according to an embodiment of the present invention.

FIG. 45 is a diagram illustrating a cross-section state of some components of the showcase 1 according to an embodiment of the present invention. FIG. 46 is a diagram illustrating the bottom of the moving body 200 in the showcase 1 according to an embodiment of the present invention. FIG. 47 is a diagram illustrating placement of the motor 290 and a cable 280 in the closed state of the showcase 1 according to an embodiment of the present invention. FIG. 48 is a diagram illustrating the placement of the motor 290 and the cable 280 in the opened state of the showcase 1 according to an embodiment of the present invention.

According to an embodiment of the present invention, the showcase 1 may include the body 100, the moving body 200, and the blowing part 330.

The body 100 as a part that forms a part of the accommodation space 10 may constitute a reference location for the moving body 200 which slidably moves.

The moving body 200 is a part that forms the accommodation space 10 jointly with the body 100, and is coupled to the body 100 to slidably move between the first location and the second location in front of the first location.

The blowing part 330 as a part configured to circulate the air in the accommodation space 10 may allow the shoe accommodated in the accommodation space 10 to be paced in an appropriate environment by adjusting an air state (in particular, humidity) of the accommodation space 10.

In this case, the body 100 may be configured to include the lower body 110 positioned below the accommodation space 10, and having the lower body groove 119 having a shape in which the front side is opened.

In addition, the moving body 200 may be configured to include the base 220 slidably coupled to the lower body 110, the turntable 230 rotatably coupled to the base 220 around the vertical axis, and forming the bottom of the accommodation space 10 jointly with the base 220, and the motor 290 placed in the lower body groove 119 and coupled to apply the rotational force to the turntable 230.

That is, the lower body groove 119 which is concave downward and opened forward is formed at the central portion of the lower body 110 to prevent interference with the body 100 in the process of the sliding movement of the moving body 200.

In particular, the motor 290 also needs to be coupled to the base 220 in order to rotate the turntable 230 coupled to the base 220 of the moving body 200, and it may be preferable to place the motor 290 below the base 220 in appearance. Therefore, when the motor 290 is placed below the base 220, it may be more preferable to place the motor 290 at the lower body groove 119 so as to prevent the motor 290 from interfering with the body 100 in the process of the sliding movement of the moving body 200.

As such, in the showcase 1 according to the embodiment, since the motor 290 applying the rotational force to the turntable 230 is placed at the lower body groove 119 formed in the lower body 110, the motor 290 may be prevented from interfering in the body 100 in the process of the sliding movement of the moving body 200.

The showcase 1 according to an embodiment of the present invention may further include the heating part 340 configured to heat the circulated air in the accommodation space 10 to appropriately maintain the environment of the accommodation space 10, thereby more effectively caring the shoe.

The showcase 1 according to an embodiment of the present invention may further include the power supply 270 which is placed at a portion other than the lower body groove 119 in the lower body 110, and the cable 280 electrically connecting the motor 290 and the power supply 270.

In this case, a side entrance 116 of which a part is opened is formed at a side of the lower body groove 119, so the cable 280 may connect the motor 290 and the power supply 270 through the side entrance 116.

As such, the motor 290 needs to be coupled to the base 220. When the power supply 270 supplying the power to the motor 290 is also coupled to the base 220, the structure of the moving body 200 becomes complicated, and a weight also increases, so the sliding movement of the moving body 200 may be difficult.

Therefore, even though the motor 290 is coupled to the base 220, it may be preferable that the power supply 270 is placed, and the motor 290 and the power supply 270 are connected by a flexible cable 280.

In this case, the power supply 270 may also be placed at the lower body groove 119, but the lower body groove 119 also needs to be formed to be larger in order to place the power supply 270 occupying a predetermined space. However, in that when the lower body groove 119 is formed to be excessively large, the rigidity of the lower body 110 may be lowered, it may be preferable to minimize the size of the lower body groove 119.

Further, it is preferable that the power supply 270 is placed relatively on an outer portion of the lower body 110 in order to facilitate connection with an external power supply.

Further, since it is preferable to preferentially place the member which needs to be installed in the base 220 and coupled to the lower body 110 at the lower body groove 119, it may be more preferable to place the power supply 270 at a portion of the lower body 110 other than the lower body groove 119.

In addition, in order to connect the power supply 270 placed at the portion other than the lower body groove 119 and the motor 290 placed at the lower body groove 119, the side entrance 116 is formed on the side of the lower body groove 119 and the cable 280 may be inserted into the side entrance 116.

As described above, since it is preferable that the rear entrance 118 for fastening the locking body 900 is formed on the rear side of the lower body groove 119, it may be preferable that the side entrance 116 for placement of the cable 280 is placed on the side of the lower body groove 119.

As such, in the showcase 1 according to the embodiment, since the cable 280 connects the motor 290 and the power supply 270 through the side entrance 116 formed on the side of the lower body groove 119, the motor 290 and the power supply 270 may be smoothly connected while stably placing the power supply 270 in the lower body 110.

In the showcase 1 according to an embodiment of the present invention, a guide wall 115 guiding a movement section of the cable 280 crossing the side entrance 116 may be formed in the lower body 110.

When the moving body 200 moves forward and backward with respect to the body 100, the cable 280 connecting the power supply 270 and the motor 290 needs to be transformed to a predictable form while moving in an allowed section.

As a result, it may be preferable that the guide wall guiding the movement section of the cable 280 is formed in the lower body 110 to prevent the damage to the cable 280 and achieve a stable operation when the moving body 200 moves with respect to the body 100.

In this case, the guide wall 115 may be configured to be projected upward on the bottom of the lower body 110, and formed at a plurality of continuous or intermittent locations.

As such, in the showcase 1 according to the embodiment, since the movement section of the cable 280 is guided through the guide wall 115 formed in the lower body 110, the cable 280 may be prevented from being damaged or separated in the process of the sliding movement of the moving body 200.

In the showcase 1 according to an embodiment of the present invention, the guide wall 115 may be configured to include a first guide barrier 115*a* placed at the front side of the side entrance 116 and a second guide barrier 115*b* placed at the rear side of the side entrance 116.

The first guide barrier 115*a* and the second guide barrier 115*b* may be configured to be projected upward on the bottom of the lower body 110, and formed to be spaced apart from each other. In addition, the cable 280 may be placed between the first guide barrier 115*a* and the second guide barrier 115*b*. That is, a gap may be formed between the first guide barrier 115*a* and the second guide barrier 115*b*, and the cable 280 may connect the motor 290 and the power supply 270 through the gap.

In particular, since the first guide barrier 115*a* and the second guide barrier 115*b* are formed to cover the front side and the rear side of the side entrance 116 except for only the gap for connecting the cable 280, the first guide barrier 115*a* and the second guide barrier 115*b* may partially prevent foreign substances from passing through the side entrance 116.

As such, in the showcase 1 according to the embodiment, since the guide wall 115 is configured to include the first guide barrier 115*a* and the second guide barrier 115*b*, the guide wall 115 may partially prevent foreign substances from being introduced into the lower body 110 other than the lower body groove 119.

In the showcase 1 according to an embodiment of the present invention, the second guide barrier 115*b* may be formed to extend to the front of the location of the motor 290 based on the state in which the moving body 200 is at the first location.

That is, the second guide barrier 115*b* may be formed to extend to the front of the location of the motor 290 in the closed state of the showcase 1.

The motor 290 which is driven primarily in the closed state of the showcase 1 may generate vibration depending on kinetic energy, and foreign substances which are present around the motor 290 may be scattered.

Therefore, it may be preferable that the second guide barrier 115*b* blocks the placement location of the motor 290 in the closed state to prevent the foreign substances from being directly introduced into the side entrance 116.

As such, in the showcase 1 according to the embodiment, since the second guide barrier 115*b* is formed to extend to the front of the location of the motor 290 in the closed state, the foreign substances scattered by the driving of the motor 290 may be minimized from being introduced into the lower body 110 other than the lower body groove 119.

In the showcase 1 according to an embodiment of the present invention, the first guide barrier 115*a* may be formed to extend in a shape in which a part is bent toward the side surface of the lower body 110 from the front side of the side entrance 116.

That is, a part of the first guide barrier 115*a* may cover the front side of the side entrance 116, and may be formed to extend toward the side surface of the lower body 110 from the part. In addition, a part of the extending first guide barrier 115*a* is formed to be bent, and as a result, a gap in the front and rear direction and a gap in the left and right direction from the second guide barrier 115*b* may be formed.

As a result, the cable 280 connecting the power supply 270 and the motor 290 may be stably placed at the gap between the first guide barrier 115*a* and the second guide barrier 115*b*.

As such, in the showcase 1 according to the embodiment, since the first guide barrier 115*a* is formed to extend up to the side surface of the lower body 110 from the front side of the side entrance 116 in the shape in which a part is bent, the cable 280 may be stably placed through gaps in the front and rear direction and the left and right direction between the first guide barrier 115*a* and the second guide barrier 115*b*.

In the showcase 1 according to an embodiment of the present invention, a bent portion of the first guide barrier 115*a* may be configured to include the curved surface.

The shape and the location of the cable 280 may be changed in the process of the sliding movement of the moving body 200, and the cable 280 may hit the first guide barrier 115*a* and the second guide barrier 115*b*. In this case, if the bent portion of the first guide barrier 115*a* is sharp, there is a risk that the cable 280 will be damaged.

Therefore, it may be preferable that the bent portion of the first guide barrier 115*a* is formed by the curve surface to prevent the first guide barrier 115*a* from damaging the cable 280 even though the cable 280 contacts the first guide barrier 115*a*.

As such, in the showcase 1 according to the embodiment, since the bent portion of the first guide barrier 115*a* is formed in the curved surface shape, it is possible to minimize the cable 280 from being damaged due to the contact with the first guide barrier 115*a* in the process of the sliding movement of the moving body 200.

In the showcase 1 according to an embodiment of the present invention, since the body 100 may further include the upper body 130 forming the top of the accommodation space 10 and the middle body 120 forming the rear surface of the accommodation space 10 by connecting the rear sides of the upper body 130 and the lower body 110, and the moving body 200 may further include the transparent window 210 which extends upward on the base 220 and forms the front surface and the both side surfaces of the accommodation space 10, the connection structure of the body 100 and the moving body 200 may be stably maintained in the process of the sliding movement of the moving body 200 with respect to the body 100.

In the showcase 1 according to an embodiment of the present invention, since the transparent window 210 includes the first window 211 forming the front surface, the second window 212 forming the left surface, and the third window 213 forming the right surface, and the first window 211, the second window 212, and the third window 213 may be integrally formed, the support member such as the separate frame is not interposed between the connection portions to provide the sense of unity and the sense of opening visually.

The showcase 1 according to an embodiment of the present invention may further include the locking body 900 configured to lock the sliding movement of the moving body 200 with respect to the body 100.

In this case, since the locking body 900 ma include the locking lever 910 installed in the base 220 and placed at the lower body groove 119, and the locking holder 920 installed in the lower body 110 and fastened to the locking lever 910 alternatively when being pressed by the locking lever 910, the closed state and the opened state may be stably and easily switched.

In the showcase 1 according to an embodiment of the present invention, the locking holder 920 is placed in the rear of the lower body groove 119 and the rear entrance 118 for exposing the locking holder 920 is formed at the rear side of the lower body groove 119, and as a result, the locking lever 910 may be fastened to the locking holder 920 through the rear entrance 118. Therefore, even though the lower body groove 119 is not formed to be excessively large, the locking lever 910 and the locking holder 920 may be smoothly fastened.

Figure 49:
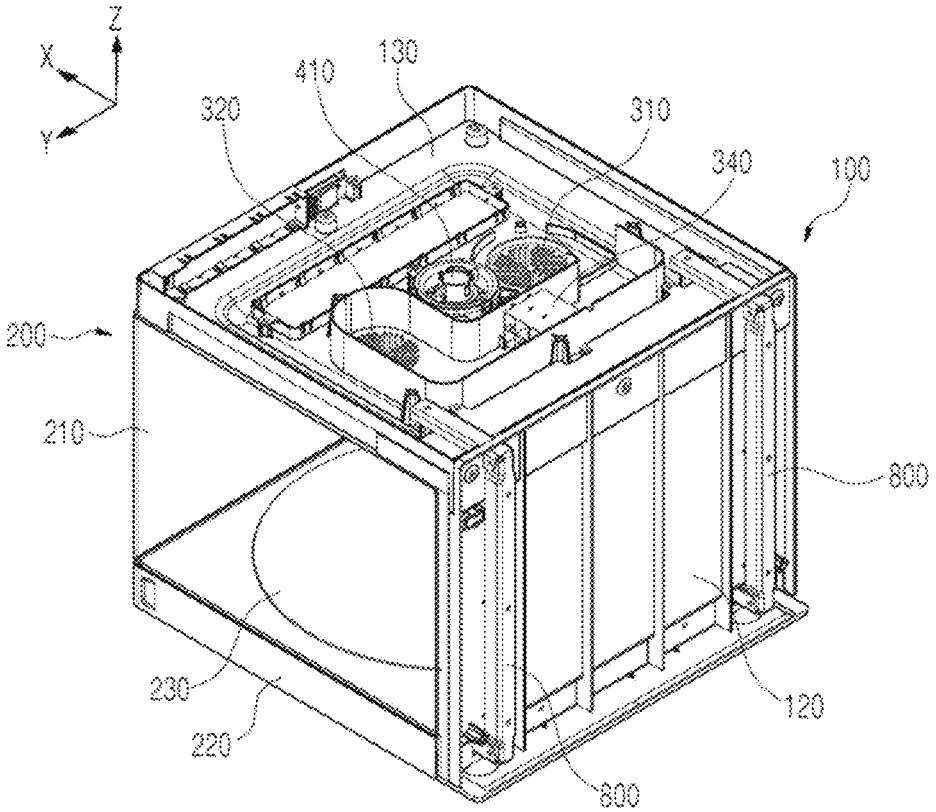
FIG. 49 is a diagram illustrating a state in which the body is reinforced by a frame body in the showcase according to an embodiment of the present invention.
Figure 50:
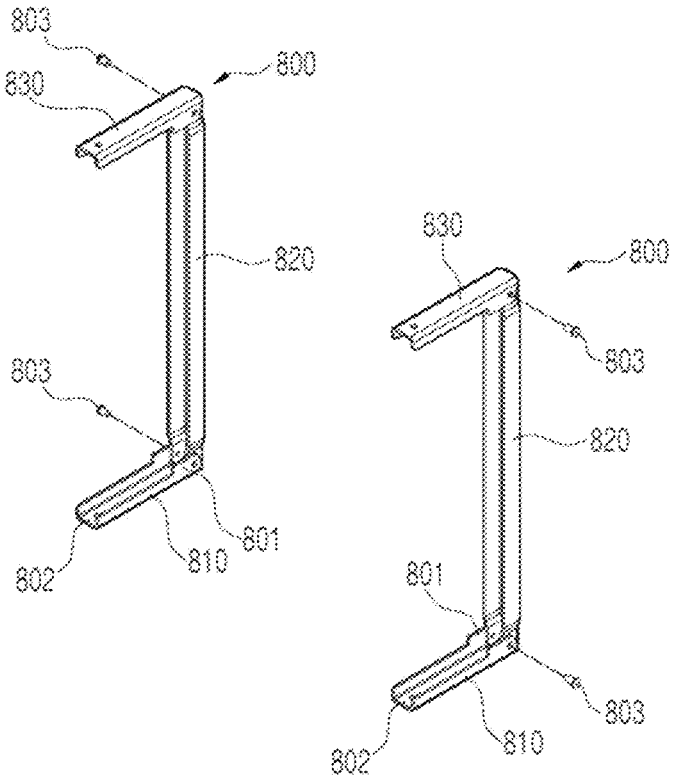
FIG. 50 is a diagram illustrating the frame body in the showcase according to an embodiment of the present invention.
Figure 51:
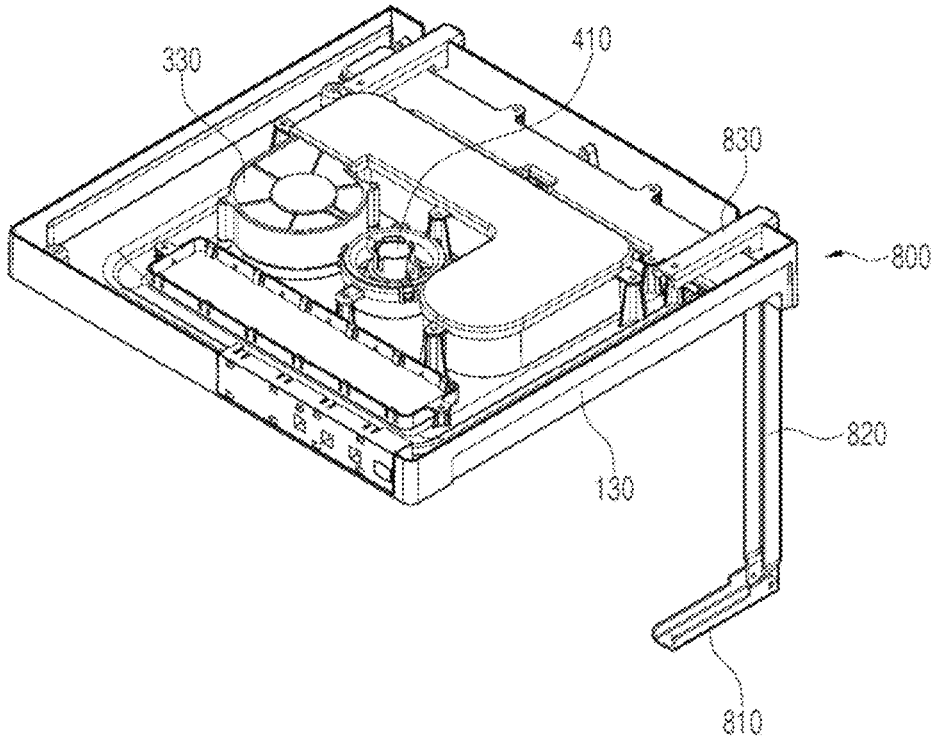
FIGS. 51 to 55 are diagrams exemplarily illustrating a coupling state of the body 100 and the frame body 800 in the showcase 1 according to an embodiment of the present invention.
Figure 52:
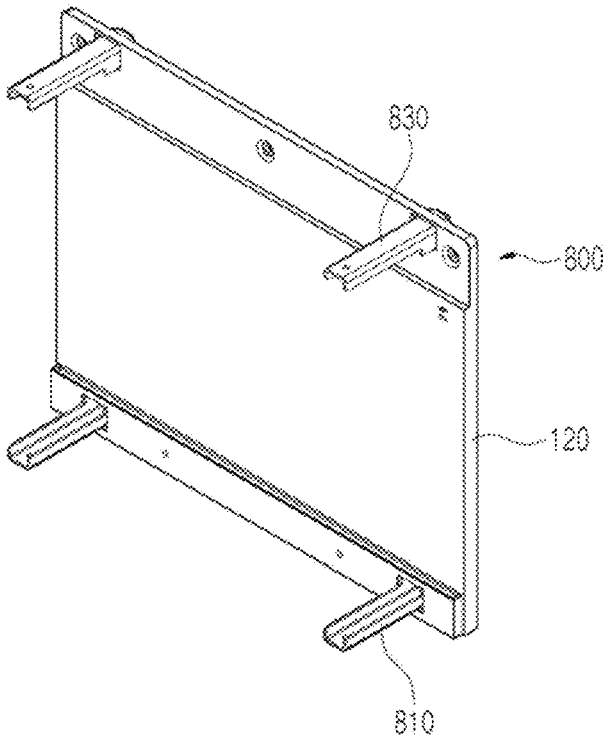
Figure 53:
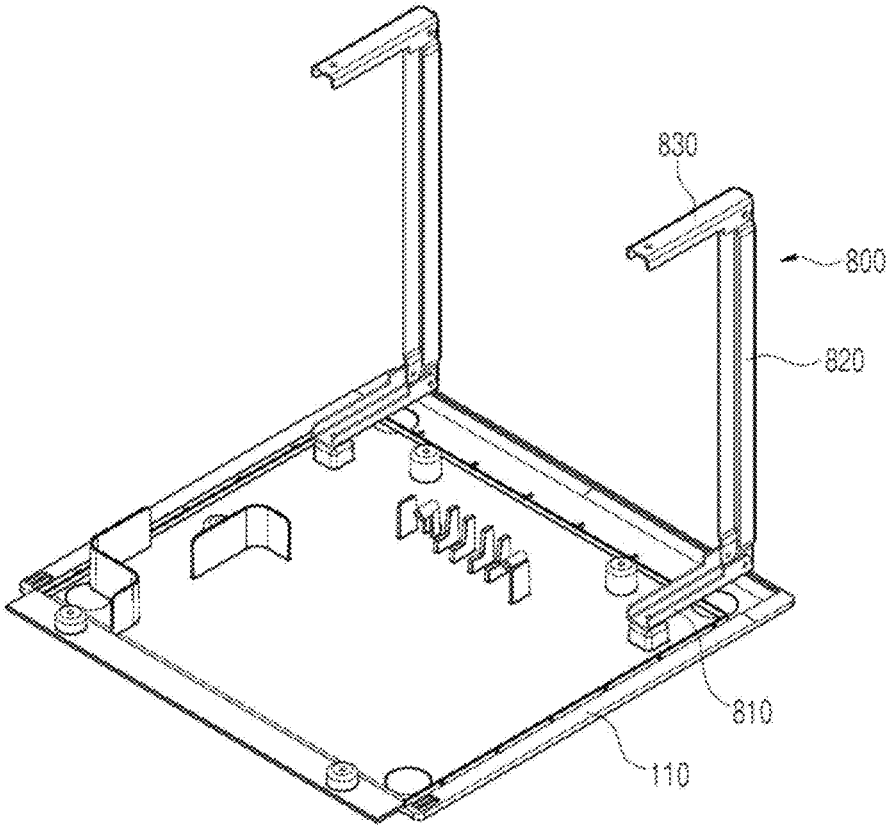
Figure 54:
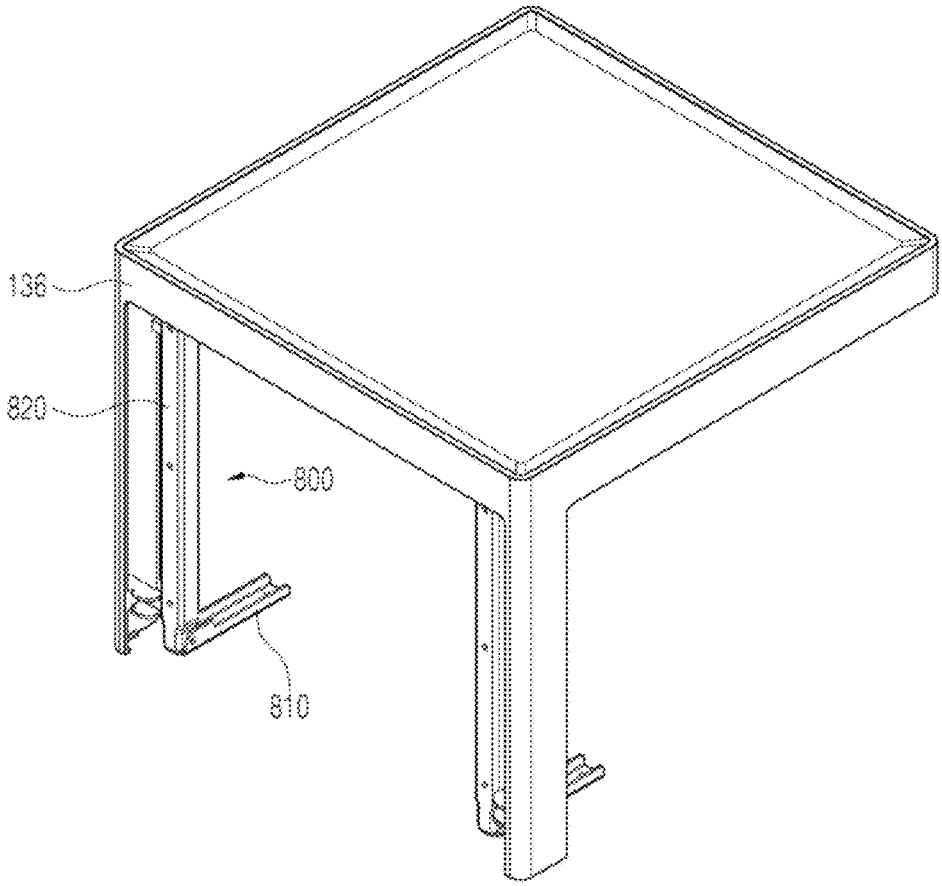
Figure 55:
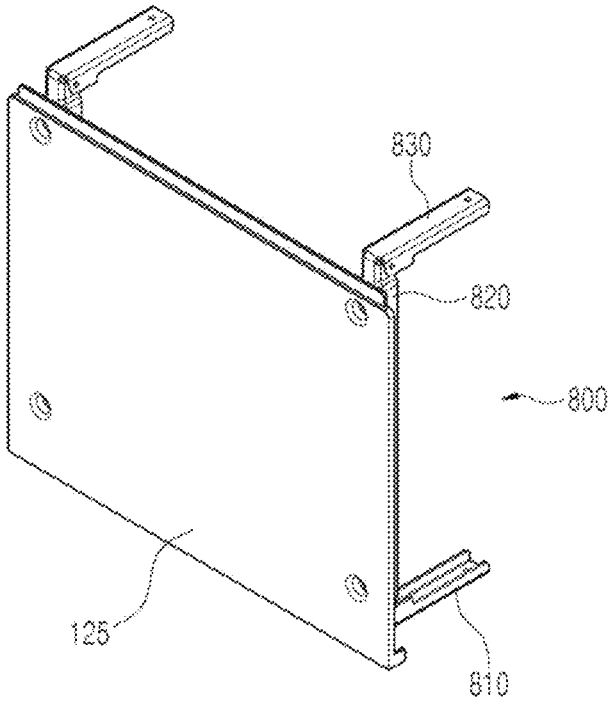

FIG. 49 is a diagram illustrating a state in which the body 100 is reinforced by a frame body 800 in the showcase 1 according to an embodiment of the present invention. FIG. 50 is a diagram illustrating the frame body 800 in the showcase 1 according to an embodiment of the present invention. FIGS. 51 to 55 are diagrams exemplarily illustrating a coupling state of the body 100 and the frame body 800 in the showcase 1 according to an embodiment of the present invention.

According to an embodiment of the present invention, the showcase 1 may include the body 100, the moving body 200, the blowing part 330, and the frame body 800.

The body 100 as a part that forms a part of the accommodation space 10 may constitute a reference location for the moving body 200 which slidably moves.

The moving body 200 is a part that forms the accommodation space 10 jointly with the body 100, and is coupled to the body 100 to slidably move between the first location and the second location in front of the first location.

The blowing part 330 as a part configured to circulate the air in the accommodation space 10 may allow the shoe accommodated in the accommodation space 10 to be paced in an appropriate environment by adjusting an air state (in particular, humidity) of the accommodation space 10.

The frame body 800 as a part that is coupled to the body 100 and supports the body 100 in a shape of connecting the upper surface, the lower surface, and the rear surface of the body 100 may reinforce each connection portion of the body 100 which has a relatively vulnerable rigidity structurally.

As described above, in order to for the moving body 200 to slidably move with respect to the body 100, the front surface of the body 100 needs to be opened to correspond to the shape of the moving body 200. Therefore, the body 100 should be formed in a structure to approximately support even a load applied to the opened front surface at portions other than the front surface.

However, in that the body 100 has various components placed therein, and it is possible to form the size or the rigidity to be unlimitedly large, it is necessary to reinforce a structurally vulnerable portion with a separate reinforcing member.

In particular, when the body 100 is formed in a shape in which the front surface is opened, it is necessary to support even the load applied to the front surface on the reaming upper surface, lower surface, and the rear surface, so it may be preferable to reinforce each connection portion of the parts.

As such, in the showcase 1 according to the embodiment, since the frame body 800 is coupled to the body 100 in a shape connecting the upper surface, the lower surface, and the rear surface of the body 100 to support the body 100, the showcase 1 may maintain a stable state by reinforcing a structural vulnerable part in the body 100.

The showcase 1 according to an embodiment of the present invention may further include the heating part 340 configured to heat the circulated air in the accommodation space 10 to appropriately maintain the environment of the accommodation space 10, thereby more effectively caring the shoe.

Further, in the showcase 1 according to an embodiment of the present invention, the body 100 includes the upper body 130 forming the top of the accommodation space 10, the lower body positioned below the accommodation space 10, and the middle body 120 forming the rear surface of the accommodation space 10 by connecting the rear sides of the upper body 130 and the lower body 110, and the moving body 200 includes the base 220 slidably coupled to the lower body 110 and the transparent window 210 extending upward on the base 220 and forming the front surface and both side surfaces of the accommodation space 10 to stably maintain the connection structure of the body 100 and the moving body 200 in the process of the sliding movement of the moving body 200 with respect to the body 100.

In the showcase 1 according to an embodiment of the present invention, the frame body 800 may be configured to include an upper frame 830 coupled to the upper body 130, a lower frame 810 coupled to the lower body 110, and a middle frame 820 connecting rear sides of the upper frame 830 and the lower frame 810 and coupled to the middle body 120.

As described above, the body 100 in which the lower body 110, the middle body 120, and the upper body 130 are combined is configured in the C shape when viewed from the side, so the body 100 may form three surfaces of the showcase 1 in the 3D space.

Therefore, since the upper body 130 and the lower body 110 are formed in a shape of being projected forward from the middle body 120, the structure for supporting the load there may not actually be present at the front ends of the upper body 130 and the lower body 110.

In particular, in that the upper body 130 is a kind of cantilever structure formed to be projected from the middle body 120, if the middle body 120 does not appropriately support the upper body 130, there may be a problem in that the front end of the upper body 130 is drooped.

In this case, in that there is a structural limit to support the upper body 130 only with the middle body 120, it may be preferable to reinforce the connection portion of the lower body 110 and the middle body 120 through the frame body 800, and then reinforce both the middle body 120 and the upper body 130 through the frame body 800.

Therefore, it may be preferable to achieve reinforcement in a structure of connecting the upper body 130, the lower body 110, and the middle body 120 of the body 100 to each other through the upper frame 830, the lower frame 810, and the middle frame 820 of the frame body 800.

That is, the frame body 800 may also be formed in the C shape when viewed from the side, so it is possible to reinforce the structural vulnerable portion of the body 100 formed in the C shape.

As such, in the showcase 1 according to the embodiment, since the frame body 800 is configured to include the upper frame 830, the lower frame 810, and the middle frame 820, the vulnerable portion of the body 100 may be reinforced in the structure of connecting the upper body 130, the lower body 110, and the middle body 120 to each other.

In the showcase 1 according to an embodiment of the present invention, the upper frame 830, the lower frame 810, and the middle frame 820 may be formed by bending one member which is formed to extend in a longitudinal direction.

As such, in order to form the frame body 800 in the C shape, it may be considered that the frame body 800 is manufactured by connecting three members to each other.

However, since multiple separate connection members for connecting three members to each other are required, manufacturing may be complicated, and there is a risk that there will be the structural vulnerability in that at least two complete cut surfaces are present in the frame body 800.

Therefore, it may be preferable that at least two in one member are bent and formed in the C shape to easily and firmly manufacture the frame body 800.

As such, in the showcase 1 according to the embodiment, since the frame body 800 including the upper frame 830, the lower frame 810, and the middle frame 820 is formed by bending one member which is formed to extend in the longitudinal direction, the frame body 800 may be easily manufactured, and a cutting surface of the frame body 800 corresponding to a reinforcing member may be minimized.

In the showcase 1 according to an embodiment of the present invention, the upper frame 830, the lower frame 810, and the middle frame 820 may be formed in a form of cutting a part of a flange 801 and bending a part of a web 802 in C-shaped channel steel.

By considering a secondary section modulus, it may be advantageous that the reinforcing member has a tubular or a C-shaped structure rather than a plate type structure. Among them, it may be preferable to form the frame body 800 with the C-shaped channel steel which is relatively easily bent in that it is difficult to bend the tubular structure.

Meanwhile, since it is difficult to bend the C-shaped channel steel as it is, the web 802 is not cut and only a part of the flange 801 is cut to relatively minimize the cut surface. In addition, the web 802 of the cut portion of the flange 801 is bent to form the frame body 800 having the C shape as a whole.

Therefore, one C-shaped channel steel may be easily formed as the frame body 800 including the upper frame 830, the lower frame 810, and the middle frame 820 while minimizing the cut surface.

As such, in the showcase 1 according to the embodiment, since the frame body 800 is formed in a form of cutting a part of the flange 801 and bending a part of the web 802 in the C-shaped channel steel, the rigidity of the frame body 800 formed by one C-shaped channel steel may be configured to be larger.

In the showcase 1 according to an embodiment of the present invention, in the upper frame 830, the lower frame 810, and the middle frame 820, a fastening member 803 may be fastened to the flange (801) portion overlapped after bending the web 802.

As such, when a part of the flange 801 is cut, and then the web 802 of the corresponding part is bent, cut flanges 801 may partially overlap with each other. Therefore, the fastening member 803 is fastened to the overlapped portions to stably maintain the bent portion in a stable state.

In particular, in that the cut part of the flange 801 may have relatively lowered rigidity, and the bent portion is a most vulnerable portion in terms of the structure of the frame body 800, it may be preferable to reinforce the corresponding portion with the fastening member 803.

As such, in the showcase 1 according to the embodiment, since the frame body 800 is formed in the structure in which the fastening member 803 is fastened to the overlapped portion of the flange 801 after bending the web 802, it is possible to prevent the bent portion of the C-shaped channel steel from being structurally vulnerable.

In the showcase 1 according to an embodiment of the present invention, the frame body 800 may be placed inside the body 100.

As such, the frame body 800 need not be visually exposed to the user in that the frame body 800 is a member for reinforcing the structural vulnerable portion of the body 100.

In particular, when the frame body 800 is made of a metallic material such as the C-shaped channel steel, there is a risk that a problem such as corrosion of the frame body 800 exposed to the outside will occur.

Therefore, it may be preferable that the frame body 800 is placed inside the body 100 so as not to be exposed to the outside.

As such, in the showcase 1 according to the embodiment, since the frame body 800 is placed not to be exposed to the outside, the aesthetics may be visually provided by minimizing the exposure of a member not directly related to the function of the showcase 1.

In the showcase 1 according to an embodiment of the present invention, a plurality of frame bodies 800 may be placed in the left and right direction of the body 100.

It may be preferable to place the frame body 800 on an entire surface of the body 100 in order to reinforce the vulnerable portion of the body 100, but such a structure is uneconomical and there is a risk of increasing the load of the showcase 1.

Therefore, placing the plurality of frame bodies 800 at a predetermined interval within a range to securing the structural stability may be most effective by considering the structural rigidity and the economics of the product.

In this case, in order to prevent deformation such as structural distortions according to the rigidity imbalance of the showcase 1, it may be preferable that the frame body 800 is placed symmetric in the left and right direction of the body 100.

As such, in the showcase 1 according to the embodiment, since the plurality of frame bodies 800 are placed in the left and right direction of the body 100 to reinforce the body 100, the body 100 may be structurally reinforced more uniformly and stably.

In the showcase 1 according to an embodiment of the present invention, the moving body 200 further includes the turntable 230 coupled to the base 220 rotatably around the vertical axis, and forming the bottom of the accommodation space 10 jointly with the base 220 to rotate and display the shoe, and the air flow is formed in various direction of the shoe to achieve the uniform care throughout the shoe.

Further, in the showcase 1 according to an embodiment of the present invention, since the rotational axis 231 of the turntable 230 is positioned in front of the front end of the body 100 based on the state in which the moving body 200 is at the second location, sufficient opening for storing and withdrawing the shoe may be made while maintaining a stable state in the opening process of the accommodation space 10.

The showcase 1 according to an embodiment of the present invention further includes the stopping part 130*s* configured to restrict the sliding movement of the moving body 200 with respect to the body 100 to prevent separation of the body 100 and the moving body 200 or a reverse which occurs due to a change in center of gravity when the moving body 200 excessively moves for the opened state.

Meanwhile, as illustrated in FIGS. 51 to 55, for stable coupling of the body 100 and the frame body 800, each component of the body 100 and each component of the frame body 800 may be coupled in the following state.

The lower frame 810 may be configured to be long in the front and rear direction. The middle frame 820 may extend upward on the rear end of the lower frame 810. The upper frame 830 may extend upward on the upper end of the middle frame 820.

The upper body 130 may be coupled to the upper frame 830 of the frame body 800. In this case, while the member such as the bolt is fastened to the upper frame 830 and the upper body 130, the upper body 130 and the frame body 800 may be coupled. The member such as the bolt may be coupled to the upper body 130 in front of the upper frame 830 and further, coupled to the upper body 130 in the rear of the upper frame 830.

In addition, the middle body 120 and the middle frame 820 may be coupled in a form in which the inner wall of the middle body 120 is in close contact with the middle frame 820 inside the middle frame 820. In this case, the member such as the bolt may be fastened to the middle body 120 and the middle frame 820.

In addition, the lower body 110 may be coupled to the lower frame 810 of the frame body 800. The bottom plate of the lower body 110 may be coupled to the lower frame 810 in close contact with the lower side of the lower frame 810. In this case, while the member such as the bolt is fastened to the lower frame 810 and the bottom plate of the lower body 110, the lower body 110 and the frame body 800 may be coupled. The member such as the bolt may be coupled to the lower body 110 in front of the lower frame 810 and further, coupled to the lower body 110 in the rear of the lower frame 810.

An external cabinet of the body 100 may be coupled to the middle frame 820 of the frame body 800. The external cabinet may be divided into a first external cabinet 136 and a second external cabinet 125.

The external cabinet may be coupled to the middle frame 820 while being in close contact with the outside of the frame body 800. In this case, while the member such as the bolt is fastened to the middle frame 820 and the first external cabinet 136, the first external cabinet 136 and the frame body 800 may be coupled. The member such as the bolt may be coupled to the first external cabinet 136 above the middle frame 820 and further, coupled to the first external cabinet 136 below the middle frame 820.

Further, while the member such as the bolt is fastened to the middle frame 820 and the second external cabinet 125, the second external cabinet 125 and the frame body 800 may be coupled.

Hereinabove, a specific embodiment of the present disclosure is described and illustrated, but the present invention is not limited to the disclosed embodiment, and it may be appreciated by those skilled in the art that the embodiment can be variously modified and transformed to another specific embodiment without departing from the spirit and the scope of the present invention. Therefore, the scope of the present disclosure will not be defined by the described embodiment, but defined by the technical spirit disclosed in the claims.

INDUSTRIAL APPLICABILITY

According to an embodiment of the present invention, a showcase can be provided in which air in the accommodation space can be controlled, an item can be completely exposed at a front side, a left side, and a right side, and the item can be effectively managed and displayed.

The invention claimed is:

1. A showcase comprising:

an accommodation space for accommodating an item therein;

a lower body defining a lower surface of the showcase;

a middle body extending upward from a rear side of the lower body to define a rear surface of the showcase;

an upper body defining an upper surface of the showcase, the upper body extending forward from an upper side of the middle body;

a transparent window comprising:

a first window defining a front surface of the transparent window;

a second window defining a left surface of the transparent window; and a third window defining a right surface of the transparent window;

a base coupled to a lower side of the transparent window, the base having an upper side configured to support the item, the base being slidably coupled to the lower body to be movable forward and rearward with respect to the lower body such that the upper body and the first window are opened/closed therebetween, the middle body and the second window are opened/closed therebetween, and the middle body and the third window are opened/closed therebetween;

a blower located in the upper body, the blower being configured to circulate air in the accommodation space; and a turntable rotatably coupled to the upper side of the base.

2. The showcase of claim 1, wherein a lower side of the second window and a lower side of the third window are supported by the lower body, and wherein an upper side of the second window and an upper side of the third window are supported by the upper body.

3. The showcase of claim 1, wherein the transparent window further comprises:

a first curved surface portion connecting the first window to the second window to define a first vertical corner portion of the transparent window; and a second curved surface portion connecting the first window to the third window to define a second vertical corner portion of the transparent window.

4. The showcase of claim 3, wherein the transparent window is integrally formed.

5. The showcase of claim 1, wherein the transparent window is made of polymethyl methacrylate (PMMA).

6. The showcase of claim 1, wherein the showcase further comprises a lower guard coupled to an outer side of a border of the base, and wherein the lower side of the transparent window is interposed between the base and the lower guard.

7. The showcase of claim 6, wherein the transparent window further comprises a plurality of first through holes extending through the transparent window at a lower side of each of the first window, the second window, and the third window, wherein the base comprises a plurality of second through holes located at positions corresponding to the first through holes on a front side of the base, a left side of the base, and a right side of the base, and wherein the lower guard comprises a plurality of hooks protruding inward from an inner surface of the lower guard, the plurality of hooks being configured to be hooked into the plurality of second through holes by extending through the plurality of first through holes.

8. The showcase of claim 7, wherein the plurality of hooks comprises a plurality of first hooks and a plurality of second hooks, and wherein hooking locations of the plurality of first hooks in the plurality of second through holes and hooking locations of the plurality of second hooks in the plurality of second through holes are opposite to each other.

9. The showcase of claim 8, wherein the plurality of first hooks and the plurality of second hooks are alternately arranged.

10. The showcase of claim 1, wherein the transparent window further includes:

a first fin portion extending upward from a rear end of the second window; and a second fin portion extending upward from a rear end of the third window, and wherein the upper body comprises:

a first insertion groove located on a lower portion of a left side of the upper body, the first insertion groove extending in a front and rear direction such that the first fin portion is movable in the first insertion groove;

a first stopper located in front of the first insertion groove to limit forward movement of the first fin portion;

a second insertion groove located on a lower portion of a right side of the upper body, the first insertion groove extending in the front and rear direction such that the second fin portion is movable in the second insertion groove; and a second stopper located in front of the second insertion groove to limit forward movement of the second fin portion.

11. The showcase of claim 10, wherein the first fin portion is integrally formed with the second window, and wherein the second fin portion is integrally formed with the third window.

12. The showcase of claim 10, wherein the first fin portion is thinner than an adjacent portion of the second window, and wherein the second fin portion is thinner than an adjacent portion of the third window.

13. The showcase of claim 1, wherein the transparent window further comprises a third fin portion extending rearward from a rear end of the second window; and a fourth fin portion extending rearward from a rear end of the third window, and wherein the middle body comprises:

a third insertion groove located on a front surface of the middle body, the third insertion groove extending in a vertical direction, the third insertion groove being configured to receive the third fin portion therein; and a fourth insertion groove located on the front surface of the middle body, the fourth insertion groove extending in the vertical direction, the fourth insertion groove being configured to receive the fourth fin portion therein.

14. The showcase of claim 13, wherein the third fin portion is integrally formed with the second window, and wherein the fourth fin portion is integrally formed with the third window.

15. The showcase of claim 13, wherein the third fin portion is thinner than an adjacent portion of the second window, and wherein the fourth fin portion is thinner than an adjacent portion of the third window.

16. The showcase of claim 1, wherein the upper body comprises:

a suction port located on a lower portion of the upper body;

a discharge port located on the lower portion of the upper body; and an air flow path located inside the upper body, the air flow path connecting the suction port to the discharge port, the blower being located in the air flow path.

17. The showcase of claim 16, wherein the upper body further comprises a heater located in the air flow path.

18. The showcase of claim 1, wherein the upper body further comprises:

a first light located on a lower surface of the upper body to illuminate the accommodation space; and a second light located behind the first light on the lower surface of the upper body to illuminate the middle body.

19. The showcase of claim 1, further comprising an internal panel releasably mounted to a front surface of the middle body, the internal panel being configured to display an image.

* * * * *